US005996372A

United States Patent [19]

Koda et al.

[11] Patent Number: 5,996,372

[45] Date of Patent: Dec. 7, 1999

[54] ACCUMULATOR

[75] Inventors: Toshihide Koda; Masahiro Sugihara; Mihoko Shimoji; Naoki Tanaka; Hitoshi Iijima; Masaki Toyoshima, all of Tokyo, Japan

[73] Assignee: Mitsubishi Denki Kabushiki Kaisha, Tokyo, Japan

[21] Appl. No.: 09/067,038

[22] Filed: Apr. 28, 1998

[30] Foreign Application Priority Data

Jun. 24, 1997 [JP] Japan ..... 9-167328

[51] Int. Cl.[6] ..... F25B 3/00

[52] U.S. Cl. ..... 62/503; 62/83; 62/471; 62/512

[58] Field of Search ..... 62/83, 503, 512, 62/471

[56] References Cited

U.S. PATENT DOCUMENTS

| | | | |
|---|---|---|---|
| 1,735,995 | 11/1929 | Davenport | 62/503 |
| 1,994,037 | 3/1935 | Gay | 62/126 |
| 3,084,523 | 4/1963 | Bottum et al. | 62/296 |
| 3,180,567 | 4/1965 | Quiggle | 230/206 |
| 5,007,247 | 4/1991 | Danig | 62/174 |

FOREIGN PATENT DOCUMENTS

| | | |
|---|---|---|
| 0360034 | 3/1990 | European Pat. Off. . |
| 0360034 | 7/1992 | European Pat. Off. . |
| 3829263 | 3/1990 | Germany . |
| 56-168068 | 12/1981 | Japan . |
| 58-87079 | 6/1983 | Japan . |
| 62-55588 | 11/1987 | Japan . |
| 539409 | 10/1993 | Japan . |
| 9410583 | 10/1994 | Rep. of Korea . |

*Primary Examiner*—Henry Bennett
*Assistant Examiner*—Marc Norman
*Attorney, Agent, or Firm*—Leydig, Voit & Mayer

[57] ABSTRACT

An accumulator is capable of preventing an excessive enlargement of the flow rate of a liquid refrigerant which is discharged from the accumulator, reducing the quantity of refrigerating machine oil which is accumulated in the accumulator, and maintaining a required quantity of refrigerating machine oil in a compressor. Liquid and a gas which circulate in a refrigerating and air-conditioning circuit are introduced into a first space by a suction pipe, and the gas refrigerant is discharged to a refrigerating and air-conditioning circuit through a gas passage pipe, a second space and a discharge pipe 5. A liquid-level maintaining mechanism prevents a rise in the height of the accumulated liquid introduced into the first space. When the height has been made to be not lower than a predetermined height, a gas communication mechanism moves liquid in the first space from the first space to the second space. A returning mechanism discharges refrigerating machine oil accumulated in the first space to the refrigerating and air-conditioning circuit.

10 Claims, 35 Drawing Sheets

FLOWING DIRECTION OF GAS REFRIGERANT

FLOWING DIRECTION OF LIQUID REFRIGERANT

FLOWING DIRECTION OF OIL

FLOWING DIRECTION OF GAS REFRIGERANT

FLOWING DIRECTION OF LIQUID REFRIGERANT (OIL DISSOLVED)

ACCUMULATOR

BACKGROUND OF THE INVENTION

The present invention relates to an accumulator for forming a refrigerating and air-conditioning circuit for use in an air conditioning machine or a refrigerator.

A conventional accumulator for forming a refrigerating and air-conditioning circuit by using, for example, a refrigerant, for example, refrigerant R22, and mineral oil (refrigerating machine oil) having mutual solubility will now be described.

FIG. 31 is a vertical cross sectional view showing the structure of a representative accumulator disclosed in a document ("Closed Compressor" written by Mutsuyoshi Kawahira, Issued by Japan Refrigeration Association, Jul. 30, 1981).

Referring to the drawing, reference numeral 151 represents a container, 152 represents a suction pipe, 153 represents a discharge pipe and 153*a* represents an oil-recovery hole formed in the bottom portion of the discharge pipe 153. Reference numeral 153*b* represents a discharge-pipe inlet opening formed at an end of the discharge pipe 153. Reference numeral 154 represents a liquid refrigerant (in a state in which refrigerating machine oil is dissolved) having a soluble relationship with refrigerating machine oil which is accumulated in the container 151. Reference numeral 155 represents a gas refrigerant.

The operation of the foregoing accumulator will now be described. In a refrigerating and air-conditioning circuit including the accumulator, the gas refrigerant 155 and the liquid refrigerant (including refrigerating machine oil) 154 flow through the suction pipe 152, and then introduced into the container 151 as indicated by an arrow A. In the internal space of the container 151, the refrigerant gas and the liquid refrigerant (including refrigerating machine oil) 154 are subjected to a process for separating the gas and the liquid from each other. Then, the gas refrigerant 155 is allowed to flow from the discharge-pipe inlet opening 153*b* to pass the discharge pipe 153, and then discharged to the outside of the container 151. On the other hand, the liquid refrigerant (including refrigerating machine oil) 154 is accumulated in the lower portion of the container 151. Then, refrigerating machine oil dissolved in the liquid refrigerant (including refrigerating machine oil) 154 is allowed to pass through the oil-recovery hole 153*a* and, together with the gas refrigerant 155 and the liquid refrigerant (including refrigerating machine oil) 154, allowed to flow to a compressor as indicated by an arrow B. The size of the oil-recovery hole 153*a* is determined to enable recovery of refrigerating machine oil to reliably be performed.

Problems experienced with the conventional accumulator shown in FIG. 31 will now be described.

When the refrigerating and air-conditioning circuit is operated, a state is realized in which the liquid refrigerant (including refrigerating machine oil) 154 is accumulated in the container 151 as shown in FIG. 31 depending upon a state of the operation.

The flow rate of the liquid refrigerant (including refrigerating machine oil) 154 which flows from the oil-recovery hole 153*a* into the discharge pipe 153 is enlarged as the flow velocity of the gas which flows in the discharge pipe 153 is raised and as the quantity of the liquid refrigerant which is accumulated in the container 151 is enlarged, that is, as the height H of the liquid refrigerant is enlarged. The characteristic of the flow rate realized when the velocity of the gas is made to be constant is shown in FIG. 32.

In the drawing, the axis of abscissa stands for the height H (mm) of the liquid refrigerant and axis of ordinate stands for the flow rate (kg/h) of the liquid refrigerant (including refrigerating machine oil) 154 which is introduced from the oil-recovery hole 153*a* into the discharge pipe 153. The rate of the flow from the oil-recovery hole 153*a* is a value obtained by adding a flow rate, which is substantially proportional to the square root of the height H (mm) of the liquid refrigerant, to a substantially constant flow rate. Note that the height H of the liquid refrigerant is a height from the oil-recovery hole 153*a* to the liquid refrigerant 154.

It is a known fact that the gas refrigerant discharged from the discharge pipe of the accumulator is, in the refrigerating and air-conditioning circuit, sucked by the compressor. Then, the gas refrigerant is compressed, and then discharged. The accumulator having the conventional structure encounters a phenomenon that the flow rate of the liquid refrigerant which is introduced into the discharge pipe 153 of the accumulator is enlarged excessively if the liquid refrigerant 154 in a large quantity is accumulated in the container 151. At this time, the compressor is brought to a state which sucks the liquid refrigerant in a large quantity. As a result, a state in which the liquid refrigerant is compressed is realized, causing an abnormally high pressure to be generated. Also the inside portion of the compressor encounters defective lubrication of the bearing portions because an oil-supply pump sucks the liquid refrigerant and thus supplies the liquid refrigerant to the bearing portions and sliding portions. As a result, mechanisms in the compressor will be broken, and abnormal abrasion and seizure of the sliding portions in the compressor take place.

The characteristic of a flow in an accumulator for a refrigerating and air-conditioning circuit in which refrigerating machine oil having no solubility with the refrigerant is employed and problems which arises in this case will now be described.

Another example of the conventional accumulator will now be described. FIG. 33 is a vertical cross sectional view showing the structure of an accumulator disclosed in Japanese Patent Publication No. 5-39409.

Referring to the drawing, reference numeral 201 represents a container, 202 represents a suction pipe, 203 represents a discharge pipe and 204 represents liquid refrigerant accumulated in the container 201. Reference numeral 205 represents refrigerating machine oil. Reference numeral 203*a* to 203*e* represent plural oil recovery holes opened in the vertical direction of the discharge pipe 203. In this example, five oil recovery holes are formed. Reference numeral 203*f* represents a gas inlet port formed at an end of the discharge pipe 203. Symbol U indicates the velocity of a gas in the discharge pipe 203.

In the refrigerating and air-conditioning circuit including the foregoing accumulator, a fluid containing a gas refrigerant, a liquid refrigerant and refrigerating machine oil is allowed to pass through the suction pipe 202, and then introduced into the container 201. The gas refrigerant and the liquid refrigerant are separated from each other in the internal space in the container 201. Then, the gas refrigerant is allowed to flow from the gas inlet opening 203*f* to pass through the discharge pipe 203, and then discharged to the outside of the container 201. On the other hand, the liquid refrigerant 204 and refrigerating machine oil 205 are accumulated in a lower portion of the container 201.

If refrigerating machine oil 205 has poor or no solubility with the liquid refrigerant 204 or if refrigerating machine oil 205 encounters phase separation from that of the liquid refrigerant 204 depending on the operating condition, refrigerating machine oil 205 and the liquid refrigerant 204 in the container 201 are separated from each other as shown in the drawing. As a result, refrigerating machine oil 205 having a thickness h floats on the liquid refrigerant 204 having the liquid level of H. The plural oil-recovery holes 203*a* to 203*e* are formed in the vertical direction so that refrigerating machine oil 205 and the liquid refrigerant 204 are sucked into the discharge pipe 203 through the oil-recovery holes 203*a* to 203*e*. Thus, they are mixed with the gas refrigerant and allowed to flow in the apparatus.

Another example of the conventional accumulator will now be described. FIG. 34 is a vertical cross sectional view showing the structure of an accumulator disclosed in Japanese Utility-Model Laid-Open No. 58-87079. The internal structure of the accumulator is different from that of the conventional apparatus shown in FIG. 33.

Referring to the drawing, reference numeral 206 represents a container, 207 represents a suction pipe and 208 represents a discharge pipe. Reference numeral 208*a* to 208*e* represent a plurality of oil-recovery holes vertically formed in the discharge pipe 208. Reference numeral 209 represents a liquid refrigerant and 210 represents refrigerating machine oil.

In the refrigerating and air-conditioning circuit including the above-mentioned accumulator, a fluid containing the gas refrigerant, the liquid refrigerant and refrigerating machine oil is allowed to pass through the suction pipe 207, and then introduced into the container 206. In the internal space in the container 206, the gas refrigerant and the liquid refrigerant are separated from each other. Moreover, refrigerating machine oil 210 and the liquid refrigerant 209 are separated from each other. Refrigerating machine oil 210 having a low specific gravity is brought to a state in which it floats on the liquid refrigerant 209. Since the plural oil-recovery holes 208*a* to 208*e* are formed vertically, refrigerating machine oil 210 and the liquid refrigerant 209 are sucked into the discharge pipe 208 through the oil-recovery holes 208*a* to 208*e*. Then, they are mixed with the gas refrigerant, and allowed to flow in the apparatus.

The two conventional structures are operated similarly and suffers from similar problems. The operation and problem of the conventional structure shown in FIG. 33 will now be described.

The flow rate of the liquid refrigerant which is introduced into the discharge pipe 203 through the oil-recovery holes 203*a* to 203*e* is enlarged as the velocity U of the gas which flows in the discharge pipe 203 is raised and the quantity of the liquid refrigerant which is accumulated in the container 201, that is, the height H of the liquid refrigerant, is enlarged. FIG. 35 shows a flow-rate characteristic realized on the assumption that the gas velocity U is a constant value and the thickness h of refrigerating machine oil 205 which floats on the liquid refrigerant 204 is constant.

Referring to FIG. 35, the axis of abscissa stands for the height H (mm) of the liquid refrigerant and axis of ordinate stands for the rate (kg/h) of flow which is introduced into the discharge pipe 203. Dashed lines indicate the flow rates of portions of the liquid refrigerant which are introduced through the oil-recovery holes 203*a* to 203*e*. An alternate long and short dash line rising to the right indicates the total flow rate of the liquid refrigerant introduced through the respective oil-recovery holes.

As the height H of the liquid refrigerant is enlarged, the number of the oil-recovery holes which exist in the liquid refrigerant 204 is enlarged. Since the rate of the flows which are introduced through the lower oil-recovery holes is enlarged by a quantity corresponding to the potential head of the liquid, the foregoing flow rate is enlarged as compared with a rate of the flows which are introduced through the upper oil-recovery holes. Therefore, the total flow rate of the liquid refrigerant is not enlarged in proportion to the height H of the liquid refrigerant. The total flow rate is enlarged with increasing speed. That is, as the level of the liquid refrigerant is raised, the quantity of the liquid refrigerant 204 which is sucked into the discharge pipe 203 and discharged from the accumulator is enlarged.

The flow rate of oil will now be described. A sawtooth solid line shown in FIG. 35 indicates a flow rate of refrigerating machine oil 205, which floats in the upper portion and which is introduced into the discharge pipe 203 through the oil-recovery hole. FIG. 36 is a diagram showing change in the flow rate of oil. The quantity of refrigerating machine oil is determined by the refrigerating and air-conditioning circuit which includes the accumulator. Since the diameter of each oil-recovery hole is usually determined to prevent excess accumulation of refrigerating machine oil in the accumulator, the quantity of refrigerating machine oil which is accumulated in the closed container 201 of the accumulator is not changed considerably. Therefore, one or two oil-recovery holes usually exist within the thickness h of refrigerating machine oil although the number varies depending on the intervals of the oil-recovery holes.

FIG. 36(*a*) shows a state in which refrigerating machine oil 205 is accumulated in a range including the two oil-recovery holes 203*c* and 203*d*. FIG. 36(*b*) shows a state in which refrigerating machine oil 205 is accumulated in a range including one oil-recovery hole 203*d* though the thickness h of refrigerating machine oil is the same as that in the case shown in (*a*). That is, the state shown in (*a*) or that shown in (*b*) can be realized depending upon the change in the height H of the liquid refrigerant. As a matter of course, the difference between the two states causes the flow rate of oil to be changed. Thus, the state shown in (*a*) is a state in which the flow rate of oil is larger than that in the state shown in (*b*). Therefore, even if the thickness h of refrigerating machine oil is constant, the flow rate of oil which is introduced into the discharge pipe 203 is somewhat changed when the height H of the liquid refrigerant is changed. In actual, the flow rate has the trend toward sawtooth change, as shown in FIG. 35.

An operation condition is considered in which the liquid refrigerant is mixed with the gas refrigerant which flows in the accumulator and the quantity of the liquid refrigerant in the liquid refrigerant is enlarged excessively. Moreover, refrigerating machine oil of the type which encounters the phase separation with the liquid refrigerant is used in the accumulator having the conventional structure (see FIGS. 33 and 34). In the foregoing state, the liquid refrigerant in a large quantity is introduced into the compressor because a large number of the oil-recovery holes exist. In the foregoing state, the compressor is brought to a state in which the liquid is compressed and thus abnormally high pressure is generated. Also the inside portion of the compressor encounters defective lubrication of the bearing portion because an oil-supply pump sucks the liquid refrigerant and thus supplies the liquid refrigerant to the bearing portions and sliding portions. As a result, the moving portions in the compressor encounter abnormal abrasion and seizure. Thus, the refrigerating and air-conditioning circuit encounters a defect in the cooling performance or in the operation. The foregoing state sometimes suffers from unsatisfactory reliability as compared with an arrangement in which refrigerating machine oil having solubility with the refrigerant is employed.

As can be understood from the description about the convention apparatus, the flow rate of the liquid refrigerant which is discharged from the accumulator included in the refrigerating and air-conditioning circuit is required to be not larger than a certain limit. On the other hand, a somewhat large flow rate of refrigerating machine oil is required to smoothly operate the compressor. The foregoing limits somewhat vary depending on the refrigerating and air-conditioning circuit which includes the accumulator.

To reduce the flow rate of the liquid refrigerant in the conventional structure shown in FIG. 33 or 34, the diameter of each oil-recovery hole is required to be reduced for example. However, the minimum diameter of the oil-recovery hole has a limit because a required flow rate of refrigerating machine oil which must be processed. Moreover, excessive reduction in the diameter is unfit for a mass production. What is worse, there is apprehension that clogging of foreign matter, such as dust, takes place if the diameter of the hole is too small. Therefore, the diameter must be larger than a certain value, for example, the diameter of the hole must be not smaller than about 1.5 mm. However, the foregoing diameter is too small to reduce the flow rate of the liquid refrigerant.

Moreover, another problem arises in the structures shown in FIG. 33 and 34 from a viewpoint of the flow rate characteristic of oil. That is, if the diameter of each oil-recovery hole is made to be a small diameter, the flow rate of the liquid refrigerant can be reduced. However, also the flow rate of oil is undesirably reduced. In this case, a required flow rate as refrigerating machine oil cannot be realized. In this case, oil in a large quantity is accumulated in the container of the accumulator, causing the quantity of oil in the compressor to be reduced.

As described above, the conventional accumulator is brought to a state in which the compressor sucks liquid refrigerant in a large quantity. Thus, the accumulator is brought to a state in which the liquid refrigerant is compressed, thus causing abnormally high pressure to be generated. Since the oil supply pump in the compressor sucks the liquid refrigerant and supplies the liquid refrigerant to the bearing portions and moving portions, the bearing portions suffer from insufficient lubrication. As a result, the mechanisms in the compressor can be broken, abnormal abrasion and seizure take place in the moving portion in the compressor.

As described above, the conventional accumulator has a problem in that the flow rate of each of the liquid refrigerant and refrigerating machine oil cannot appropriately be controlled if refrigerating machine oil having solubility with the refrigerant is employed or refrigerating machine oil having poor solubility with the refrigerant is employed. Thus, the reliability of the operation of the compressor has been unsatisfactory.

SUMMARY OF THE INVENTION

In view of the foregoing, an object of the present invention is to obtain an accumulator which is capable of preventing excessive discharge of liquid refrigerant from the accumulator, reducing the flow rate of the liquid refrigerant which is introduced into the compressor and reducing the quantity of refrigerating machine oil which is accumulated in the accumulator so that a required quantity of refrigerating machine oil in the compressor is maintained. As a result, the reliability of the compressor and that of a refrigerating and air-conditioning circuit are attempted to be improved.

An accumulator according to a first aspect of the present invention comprises a first space into which liquid and a gas which are fluids arranged to circulate in a refrigerating and air-conditioning circuit are introduced by introducing means; a second space for introducing the gas from the first space by gas passage means, discharging the gas to the refrigerating and air-conditioning circuit by discharging means and having a structure capable of accumulating the liquid; liquid-level maintaining means for preventing the level of the accumulated liquid introduced into the first space from becoming a level not lower than a predetermined height; liquid passage means for moving the liquid from the first space to the second space when the liquid level has been raised to a level not lower than the predetermined height; and returning means opened in the first space at a position lower than the predetermined height and arranged to discharge the liquid accumulated in the first space to the refrigerating and air-conditioning circuit.

An accumulator according to a second aspect of the present invention has a structure that the liquid passage means and the gas passage means according to the first aspect are formed into a gas passage pipe having ends opened in a gas portion of the first space and other ends opened in the second space and disposed in a vertical direction across the gas portion and a liquid accumulation portion in the first space, and the liquid-level maintaining means has a communication portion allowed to communicate with the gas passage pipe disposed in the vertical direction in the first space at the predetermined height, a first passage for establishing the communication between the communication portion and an upper portion in the first space and a second passage for establishing the communication between the communication portion and a space in the first space at a position lower than the predetermined height.

An accumulator according to a third aspect of the present invention has a structure according to the first or second aspect and arranged to further comprise moving means for moving the liquid accumulated in the second space to the first space.

An accumulator according to a fourth aspect of the present invention has a structure according to the third aspect and arranged in such a manner that the second space is formed above the first space, and the moving means is communication means for establishing the communication between the liquid accumulation portion in the second space and the first space.

An accumulator according to a fifth aspect of the present invention has a structure according to the third aspect and arranged in such a manner that the moving means establishes the communication between the introducing means and the liquid accumulation portion in the second space by dint of one or a plurality of connection means, and an end of the connection means adjacent to the introducing means is allowed to project over the inner surface of the introducing means toward the inside portion so that the liquid accumulated in the second space is caused to follow the fluid when the fluid is introduced into the first space by the introducing means.

An accumulator according to a sixth aspect of the present invention has a structure according to the third aspect and arranged in such a manner that the moving means is composed of liquid-recovery means vertically disposed in the liquid accumulation portion in the second space and arranged to be capable of recovering the liquid positioned at different positions in a vertical direction and a connection means for establishing the communication between the introducing means and the liquid-recovery means, and an end of the connection means adjacent to the introducing means is allowed to project over the inner surface of the introducing means toward the inside portion so that the liquid accumulated in the second space is caused to follow the fluid when the fluid is introduced into the first space by the introducing means.

An accumulator according to a seventh aspect of the present invention has a structure according to the third aspect and arranged in such a manner that the second space is disposed above the first space, and the moving means is composed of a third space formed at an intermediate position between the second space and the first space, a first opening/closing valve disposed between the first space and the third space and a second opening/closing valve disposed between the second space and the third space so that the first opening/closing valve is closed when the second opening/closing valve is opened and the first opening/closing valve is opened when the second opening/closing valve is closed in order to move the liquid accumulated in the second space to the first space through the third space.

An accumulator according to an eighth aspect of the present invention has a structure according to any one of the first to seventh aspects and arranged in such a manner that liquid-level stabilizing means for stabilizing the liquid level in the space is provided for either of the first space or the second space.

DETAILED DESCRIPTION OF THE PREFERRED EMBODIMENTS

First Embodiment

Figure 1A:
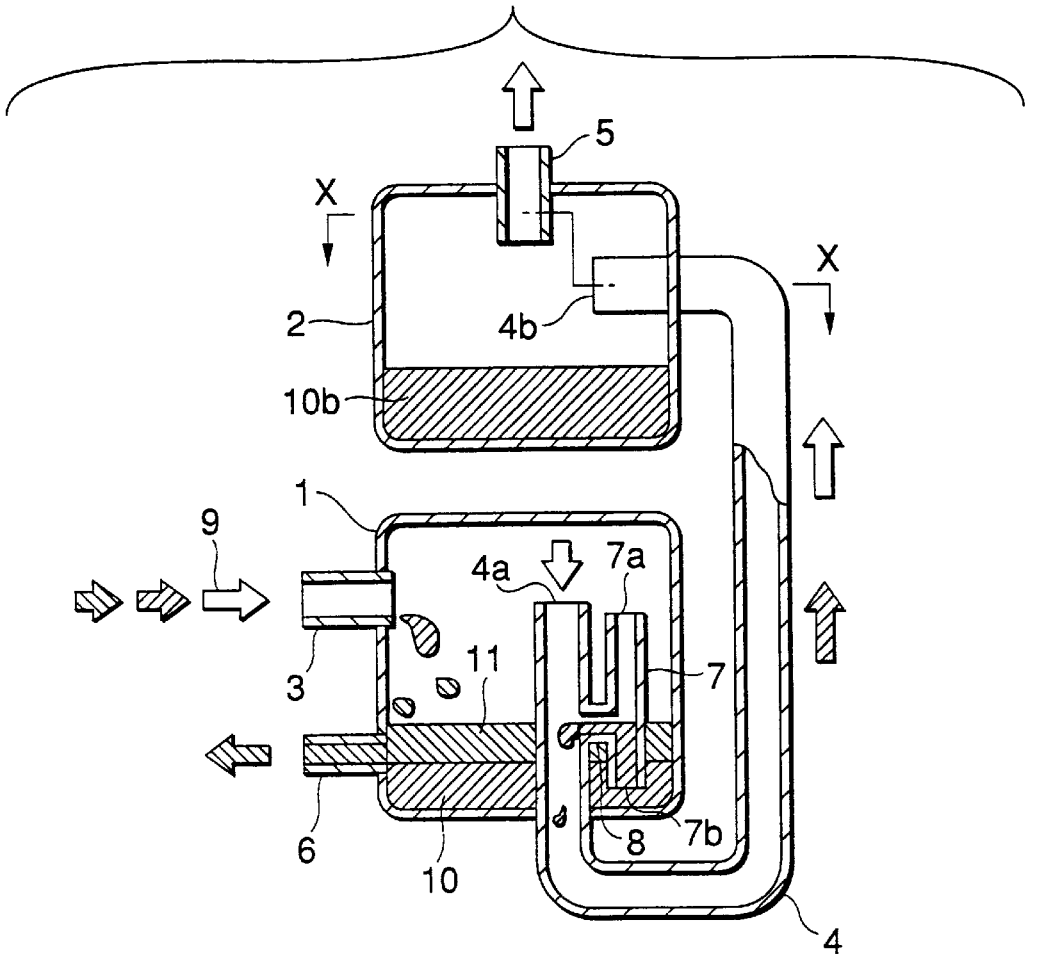
FIGS. 1(*a*) and 1(*b*) are respectively a vertical cross sectional view and a transverse cross sectional view showing an accumulator according to a first embodiment of the present invention.
Figure 1B:
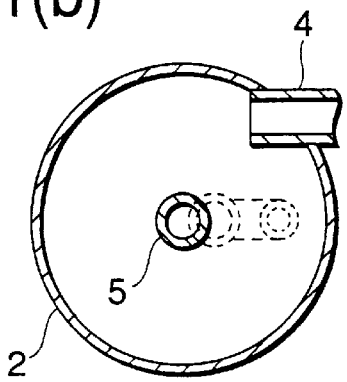

The structure of an accumulator for use in a refrigerating and air-conditioning circuit according to a first embodiment of the present invention will now be described. FIG. 1 is a diagram showing an accumulator having a structure that a first container is disposed below a second container. FIG. 1(*a*) is a vertical cross sectional view, and FIG. 1(*b*) is a cross sectional view taken along line X—X shown in FIG. 1(*a*). In this embodiment, an assumption is made that refrigerating machine oil having poor solubility with refrigerant is employed for use in the refrigerating and air-conditioning circuit.

Referring to the drawings, reference numeral 1 represents a first space which is a first container and 2 represents a second space which is a second container. Reference numeral 3 represents an introducing means which is, for example, a suction pipe, for introducing gas refrigerant, liquid refrigerant and refrigerating machine oil which circulate in the refrigerating and air-conditioning circuit. Reference numeral 4 represents a pipe, which is a gas passage pipe, which serves as both of a liquid passage means and a gas passage means. Although the gas passage pipe 4 has a main function of introducing the gas refrigerant in the first container 1 into the second container 2, this embodiment has a structure that also the liquid refrigerant and refrigerating machine oil are allowed to pass through the gas passage pipe 4 so as to be moved to the second container 2. Reference numeral 5 represents a discharge means for discharging the gas refrigerant to the refrigerating and air-conditioning circuit, the discharge pipe being a discharge pipe. Reference numeral 6 represents a return means for moving refrigerating machine oil accumulated in the first container 1 to the refrigerating and air-conditioning circuit, the return means being an oil return pipe. Reference numeral 7 represents an air-duct pipe, 8 represents a communication pipe and 9 represents gas refrigerant.

The gas passage pipe 4 has an end which is opened in a gas portion in the first container 1 and another end opened in the second container 2. The gas passage pipe 4 is, in the first container 1, vertically disposed across the gas portion and the liquid accumulation portion. The gas passage pipe 4 is allowed to communicate with the communication pipe 8 at a predetermined height from the bottom of the first container 1 at which the liquid level is required to be maintained. The communication pipe 8 is connected to the air-duct pipe 7. Thus, an upper end 7*a* of the air-duct pipe 7 from the position at which the communication pipe 8 is connected forms a first passage which establishes the communication between the communication pipe 8 and an upper portion in the first container 1. A lower end 7*b* of the air-duct pipe 7 from the position at which the communication pipe 8 is connected forms a second passage which establishes the communication between the communication pipe 8 and a space in the first container 1 which is lower than a predetermined height.

The operation of the accumulator having the above-mentioned structure will now be described.

The gas refrigerant 9 discharged from an evaporator in the refrigerating and air-conditioning circuit is introduced from the suction pipe 3 into the first container 1. Then, the gas refrigerant 9 is allowed to pass through the gas passage pipe 4, and then introduced into the second container 2, after which the gas refrigerant 9 is introduced into the compressor. At this time, the operation condition of the refrigerating and air-conditioning circuit results in the liquid refrigerant 10 and refrigerating machine oil 11 being mixed with the gas refrigerant 9. The gas refrigerant 9, the liquid refrigerant 10 and refrigerating machine oil 11 introduced into the first container 1 are subjected to gas-liquid separation. Thus, the liquid refrigerant 10 and refrigerating machine oil 11 separated from each other are accumulated in the bottom portion of the first container 1. Assuming that the liquid refrigerant 10 and refrigerating machine oil 11 have no mutual solubility and refrigerating machine oil 11 having the specific gravity lower than that of the liquid refrigerant 10 is employed, refrigerating machine oil 11 floats on the upper surface of the liquid refrigerant 10. The oil return pipe 6 is connected to a circuit for returning separated refrigerating machine oil 11 to the compressor. Arrows shown in the drawing indicate flows of the gas refrigerant 9 (hollow hair line arrows), the liquid refrigerant 10 (dotted arrows) and refrigerating machine oil 11 (diagonal-line arrows).

The operation of the air-duct pipe 7 will be described later with reference to FIG. 2. The main function of the air-duct pipe 7 is a function to maintain a predetermined height of the liquid level (the height of the liquid level) in the first container 1. When refrigerating machine oil having poor solubility with the refrigerant is employed, the air-duct pipe 7 has a function to selectively move the liquid refrigerant 10 to the second container 2. That is, the liquid refrigerant 10 is introduced from the communication pipe 8 into the gas passage pipe 4 so as to be brought to a state of a multi-phase flow with the gas refrigerant 9 and introduced from the first container 1 into the second container 2. Since the gas-liquid separation effect can be attained in the second container 2, refrigerating machine oil 11 is accumulated in the bottom portion of the second container 2. Only the gas refrigerant 9 is discharged from the discharge pipe 5 to the compressor. Since the height of the liquid in the first container 1 is substantially constant as described above, no influence of the height of the liquid is exerted on the discharge flow rate as has been experienced with the conventional accumulator. Thus, the flow rate can be stabilized. In addition, refrigerating machine oil 11 which flows above the liquid refrigerant 10 can selectively be discharged from the oil return pipe 6.

The operation of the air-duct pipe 7 will now be described. FIGS. 2(*a*), 2(*b*) and 2(*c*) are diagrams showing the operation in the first container 1. Referring to the drawings, hi indicates the height from the bottom surface of the first container 1 to the oil return pipe 6, and h2indicates the height from the bottom surface of the first container 1 to the communication pipe 8. The heights satisfy h1<h2. The lower end 7*b* of the air-duct pipe 7 is opened at a position lower than the height of the oil return pipe 6. Assuming that the height from the bottom surface of the first container 1 to the lower end 7*b* of the air-duct pipe 7 is h3, the relationship h3<h1 is satisfied. Note that the upper end 7*a* of the air-duct pipe 7 is opened at substantially the same position as that of the upper end of the gas passage pipe 4.

Figure 2A:
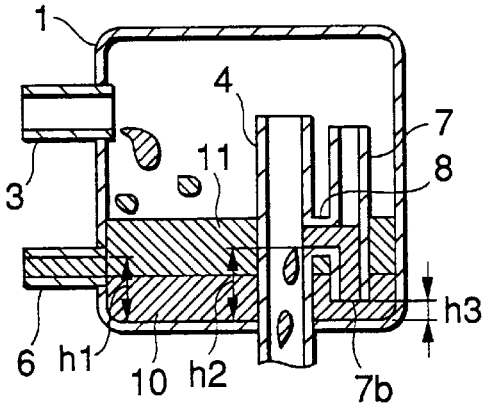
FIGS. 2(*a*) and 2(*b*) are vertical cross sectional views diagram showing the operation of the accumulator according to the first embodiment.
Figure 2B:
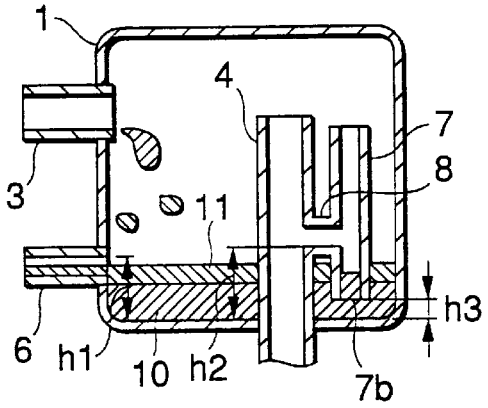
Figure 2C:
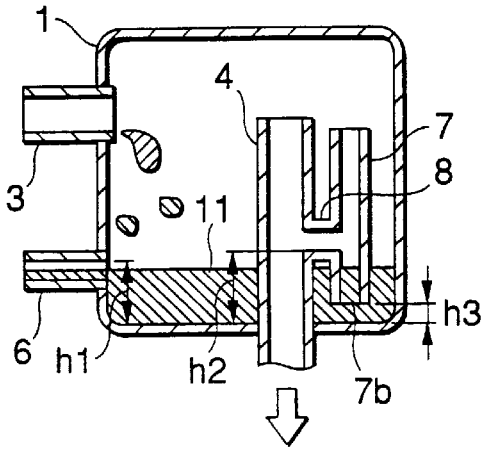

FIGS. 2(*a*) and 2(*b*) show a state in which the liquid refrigerant 10 is, together with the gas refrigerant 9, introduced from the evaporator into the accumulator. FIG. 2(*a*) shows a state in which the height of the liquid level (the oil level) is not smaller than h2. FIG. 2(*b*) shows a state in which the height of the liquid level (the oil level) is not larger than h2. FIG. 2(*c*) shows a state of the operation of the refrigerating and air-conditioning circuit in which the liquid refrigerant 10 is not introduced from the evaporator into the accumulator and only the gas refrigerant 9 and refrigerating machine oil 11 are introduced into the accumulator.

Referring to FIG. 2, the function of maintaining a substantially constant height of the liquid level (the oil level) in the first container 1 and a function of selectively introducing only the liquid refrigerant 10 from the gas passage pipe 4 into the second container 2 will now be described.

FIG. 2(*a*) shows a state in which the liquid refrigerant 10 and refrigerating machine oil 11 have been accumulated in the first container 1. Since refrigerating machine oil 11 has a smaller specific gravity, refrigerating machine oil 11 floats on the liquid refrigerant 10. The oil return pipe 6 has a diameter and a length which permit refrigerating machine oil which has been introduced into the first container 1 to be discharged. Moreover, the diameter and the length of each of the lower end 7*b* and the communication pipe 8 are determined to be capable of discharging the liquid refrigerant in a quantity which is introduced into the first container 1. If the height of the liquid level (the oil level) is not smaller than h2 as shown in FIG. 2(*a*), the height of the liquid in the first container 1 and that in the air-duct pipe 7 are made to be the same level. Therefore, the communication pipe 8 is filled with the liquid refrigerant 10. As a result, the liquid refrigerant 10 is allowed to flow from the lower end 7*b* of the air-duct pipe 7 through the communication pipe 8, and then introduced into the second container 2. Since the position of the lower end 7*b* of the air-duct pipe 7 is included in the layer of the liquid refrigerant 10, only the liquid refrigerant 10 is introduced from the lower end 7*b* of the air-duct pipe 7 to lower the height of the liquid level (the oil level).

When the quantity of the liquid refrigerant introduced from the suction pipe 3 has been reduced and the height of the liquid level (the oil level) in the first container 1 is not higher than h2, the state shown in FIG. 2(*b*) is realized. Thus, the gas refrigerant 9 flows from the upper end 7*a* of the air-duct pipe 7 to the communication pipe 8. Therefore, the liquid refrigerant 10 is not introduced from the lower end 7*b* of the air-duct pipe 7. Therefore, when the liquid refrigerant 10 has been introduced from the suction pipe 3 in the above-mentioned state, the height of the liquid level (the oil level) is raised. Thus, the state shown in FIG. 2(*a*) is realized. That is, the effect can be obtained in that the substantially constant height of the liquid level (the oil level) in the first container 1 can be maintained near the position (the height h2 from the bottom surface) at which the communication pipe 8 is disposed.

A state in which no liquid refrigerant is introduced into the accumulator is frequently realized as the operation state of the refrigerating and air-conditioning circuit. The state in which the liquid refrigerant 10 is not introduced from the suction pipe 3 and the gas refrigerant 9 and refrigerating machine oil 11 are introduced is shown in FIG. 2(*c*). The dimensions of the oil return pipe 6 are determined in such a manner that a maximum quantity of oil which has been introduced from the suction pipe 3 can be discharged. Moreover, the design is performed in such a manner that the level of refrigerating machine oil 11 does not exceed h1 when the liquid refrigerant 10 is not introduced. That is, the oil level in the first container 1 does not exceed h2 as shown in FIG. 2(*c*). Therefore, refrigerating machine oil 11 is not introduced from the lower end 7*b* into the second container 2 through the communication pipe 8. Therefore, discharge of refrigerating machine oil 11 to the second container 2 can be prevented.

As a result of the sequential operations, the substantially constant height of the liquid level (the oil level) in the first container 1 can be maintained. Although a mixed fluid of refrigerating machine oil 11 or the liquid refrigerant and refrigerating machine oil is discharged from the oil return pipe 6, the flow rate from the oil return pipe 6 to the compressor is made to be constant because the height of the liquid in the first container 1 is substantially constant. That is, the phenomenon that the height of the liquid level in the container is raised and thus the flow rate of the liquid refrigerant which is returned to the compressor is enlarged does not occur as has been experienced with the conventional apparatus. When the rate of the flow from the oil return pipe 6 to the compressor is made to be not larger than the limit of the introduction of the liquid refrigerant for the compressor, the flow rate of the liquid refrigerant which is introduced into the communication can be prevented. Thus, any defect of the compressor can be prevented.

As described above, the structure of the accumulator according to this embodiment is arranged as described above for use in the refrigerating and air-conditioning circuit in which refrigerating machine oil which is not dissolved in the liquid refrigerant is employed. Thus, refrigerating machine oil of the liquids which are accumulated in the first container 1 can be returned to the compressor and an excessive quantity of the liquid refrigerant exceeding a predetermined height can selectively be moved to the second container 2 so as to be accumulated. Therefore, refrigerating machine oil can efficiently be circulated and a required quantity of refrigerating machine oil in the compressor can be maintained. Since the second container 2 has the gas-liquid separation function, only a little quantity of the liquid refrigerant is discharged from the discharge pipe 5 to the refrigerating and air-conditioning circuit.

Second Embodiment

Figure 3A:
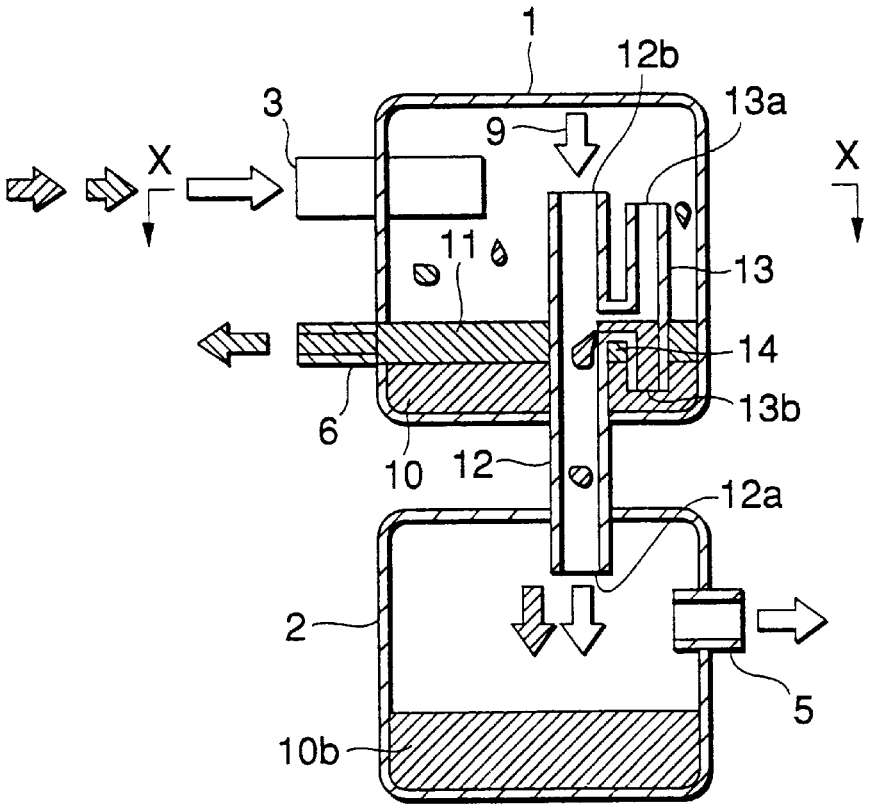
FIGS. 3(*a*) and 3(*b*) are respectively a vertical cross sectional view and a transverse cross sectional view showing an accumulator according to a second embodiment of the present invention.
Figure 3B:
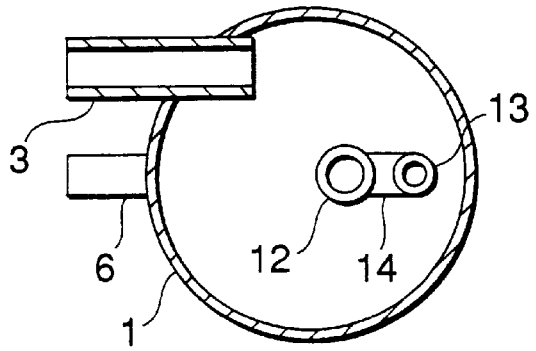

An accumulator according to a second embodiment of the present invention and adaptable to a refrigerating and air-conditioning circuit will now be described. The second embodiment has the same function as that of the first embodiment except for refrigerating machine oil having poor solubility with the refrigerant being employed in the refrigerating and air-conditioning circuit. In this embodiment, the first container is disposed above the second container to cause the liquid refrigerant in the first container to drop so that the liquid refrigerant is accumulated in the second container. FIG. 3 is a diagram showing the accumulator according to this embodiment having a structure that the first container 1 is disposed above the second container 2. FIG. 3(*a*) is a vertical cross sectional view, and FIG. 3(*b*) is a cross sectional view taken along line X—X shown in FIG. 3(*a*).

Referring to the drawings, reference numeral 12 represents a gas communication pipe arranged to establish the connection between the first container 1 and the second container 2 and structured to permit a flow of the gas refrigerant 9. Reference numeral 12*a* represents an outlet opening of the gas communication pipe, and 12*b* represents a inlet opening of the gas communication pipe. Reference numeral 13 represents an air-duct pipe disposed in parallel to the gas communication pipe 12 and formed into a pipe shape having two opened vertical ends. Reference numeral 13*a* represents an upper end 13*a* of the air-duct pipe 13. Reference numeral 13*b* represents a lower end 13*b* of the air-duct pipe 13. A position near an intermediate position of the air-duct pipe 13 is connected to the side surface of the gas communication pipe 12 through a communication pipe 14. The structure that the air-duct pipe 13 and the gas communication pipe 12 are connected to each other is the same as that according to the first embodiment. The height h1 from the bottom surface of the first container 1 to the oil return pipe 6, the height h2 from the bottom surface of the first container 1 to the communication pipe 14 and the height h3 from the bottom surface of the first container 1 to the lower end 13*b* of the air-duct pipe 13 satisfy h3<h1<h2. The upper end 13*a* of the air-duct pipe 13 is opened at substantially the same position as that of the upper end of the gas communication pipe 12.

As a result of the above-mentioned structure, the gas communication pipe 12, the air-duct pipe 13 and the communication pipe 14 have the function described with reference to FIG. 2. Thus, an effect can be obtained in that the substantially constant height of the liquid level (the oil level) can be maintained in the first container 1.

That is, when the height of the liquid level (the oil level) in the first container 1 is not larger than h2, the gas refrigerant 9 is introduced into the gas communication pipe 12, the air-duct pipe 13 and the communication pipe 14. When the height of the liquid level (the oil level) is made to be not smaller than hi, refrigerating machine oil which floats in the upper portion among the liquids accumulated in the first container 1 is discharged from the oil return pipe 6. When the height of the liquid level (the oil level) in the first container 1 is made to be not smaller than h2, the liquid refrigerant 10 is introduced from the lower end 13*b* of the air-duct pipe 13 into the gas communication pipe 12. The liquid refrigerant 10 is, attributable to gravity drop and the flow of the gas, moved to the second container 2 disposed at the lower position, and then accumulated in the bottom portion of the second container 2. Thus, similarly to the first embodiment, the accumulator for the refrigerating and air-conditioning circuit in which refrigerating machine oil having poor solubility with the liquid refrigerant is employed is able to selectively return refrigerating machine oil 11 from the oil return pipe 6 to the compressor. Moreover, the liquid refrigerant 10 can selectively be accumulated in the second container 2. Since the second container 2 has the gas-liquid separation function, discharge of the liquid refrigerant from the discharge pipe 5 is not enlarged considerably even if the liquid refrigerant is accumulated in the second container 2.

As described above, also this embodiment is able to make the height of the liquid level in the first container 1 to be substantially constant height of h2. Therefore, the rate of the flow from the oil return pipe 6 to the compressor can be made to be constant. Thus, the phenomenon experienced with the conventional apparatus that the flow rate of the liquid refrigerant which is returned to the compressor is enlarged as the height of the liquid level in the container is enlarged can be prevented. Although refrigerating machine oil or a mixed fluid of refrigerating machine oil and the refrigerant is discharged from the oil return pipe 6, adjustment of the inner diameter of the oil return pipe 6 or the like enables the rate of the flow from the oil return pipe 6 to the compressor to be not larger than the limited quantity of introduction of the liquid refrigerant for the compressor. As a result, a required quantity of refrigerating machine oil in the compressor can be maintained. Thus, occurrence of a defect of the compressor can be prevented.

Third Embodiment

In the first and second embodiments, accumulators have been described which are arranged to be adaptable to the refrigerating and air-conditioning circuit which employs refrigerating machine oil having poor solubility with the refrigerant. An accumulator according to this embodiment is applied to a refrigerating and air-conditioning circuit which employs refrigerating machine oil having solubility with the refrigerant. The first and second embodiments arranged on the assumption that refrigerating machine oil having poor solubility with the refrigerant have the structure that the inside portion of the first container 1 is provided with the means for separating the liquid refrigerant and refrigerating machine oil from each other and the means for making the height of the liquid refrigerant and refrigerating machine oil to be constant. On the other hand, the third embodiment is arranged on the assumption that refrigerating machine oil having solubility with the refrigerant is employed in the refrigerating and air-conditioning circuit. Thus, an object of this embodiment is to realize a function for making the height of the liquid refrigerant (including refrigerating machine oil) in the first container 1 to be constant. Moreover, limitation of the liquid refrigerant (including refrigerating machine oil) which is discharged from the accumulator to the compressor is attempted.

Figure 4A:
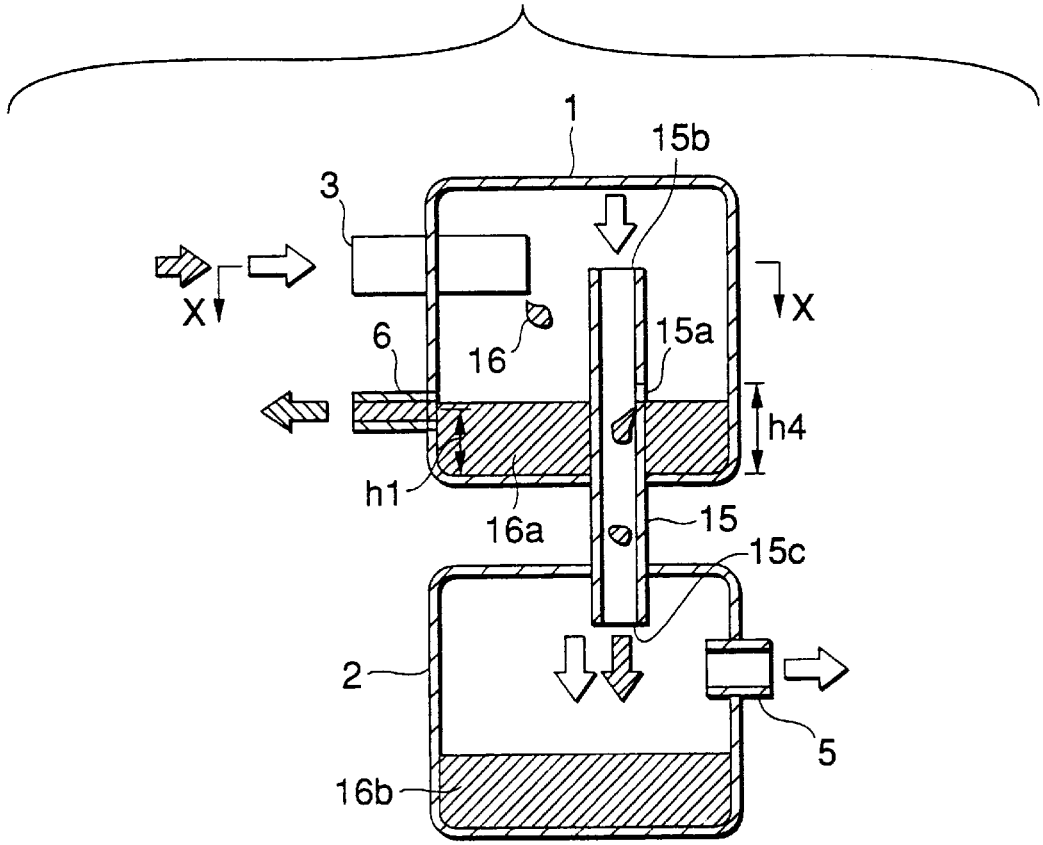
FIGS. 4(*a*) and 4(*b*) are respectively a vertical cross sectional view and a transverse cross sectional view showing an accumulator according to a third embodiment of the present invention.
Figure 4B:
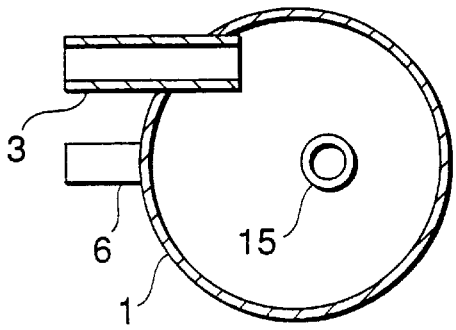

The accumulator for use in the refrigerating and air-conditioning circuit according to the third embodiment of the present invention will now be described. FIG. 4 is a diagram showing the structure of the accumulator according to this embodiment and having a structure that the first container 1 is disposed above the second container 2, similarly to the second embodiment. FIG. 4(*a*) is a vertical cross sectional view, and FIG. 4(*b*) is a cross sectional view taken along line X—X shown in FIG. 4(*a*).

Referring to the drawings, reference numeral 15 represents a gas communication pipe which establishes the communication between the first container 1 and the second container 2. Reference numeral 15*a* represents a communication hole and 15*b* represents an upper end of the gas communication pipe 15. Reference numeral 15*b* represents an upper end of the gas communication pipe 15. Reference numeral 15*c* represents a lower end of the gas communication pipe 15. Reference numeral 16*a* represents a liquid refrigerant in which refrigerating machine oil which is accumulated in the first container 1 is dissolved, and 16*b* represents a liquid refrigerant in which refrigerating machine oil which is accumulated in the second container 2 is dissolved.

The upper end 15*b* of the gas communication pipe is disposed above the first container 1, while the lower end 15*c* of the gas communication pipe is disposed above the second container 2. The height h4 of the communication hole 15*a* is a predetermined height at which the liquid level is required to be maintained, the height h4 being higher than position h1 of the oil return pipe 6. That is, h1<h4 is satisfied.

The operation will now be described. FIG. 4(*a*) shows an operation state in which liquid refrigerant (in which refrigerating machine oil is dissolved) 16 is introduced from the suction pipe 3. Since the liquid refrigerant (in which refrigerating machine oil is dissolved) 16 is subjected to gas-liquid separation in the first container 1, the liquid refrigerant 16 is accumulated in the first container 1. When liquid refrigerant (in which refrigerating machine oil is dissolved) 16*a* accumulated in the first container 1 exceeds the height of the communication hole 15*a*, it is allowed to pass through the communication hole 15*a* and moved to the second container 2. Therefore, the height of the liquid refrigerant (in which refrigerating machine oil is dissolved) 16*a* in the first container 1 does not exceed the height h4 of the communication hole 15*a*. As a result, the height of the liquid refrigerant in the first container 1 is limited and the flow rate of the liquid refrigerant (in which refrigerating machine oil is dissolved) which is discharged from the oil return pipe 6 to the compressor is made to be substantially constant.

A state in which the liquid refrigerant is not introduced from the suction pipe 3 and only refrigerating machine oil is introduced can be realized according to the state of the operation. Also in this case, the structure of the oil return pipe 6 is arranged in such a manner as to permit refrigerating machine oil in a quantity which is introduced from the suction pipe 3 to be discharged similarly to the first and second embodiments. Thus, the height does not exceed the height of the communication hole 15*a*. Therefore, discharge of refrigerating machine oil 11 to the second container 2 can be prevented. Thus, the state in which refrigerating machine oil 11 is accumulated is not realized.

Figure 31:
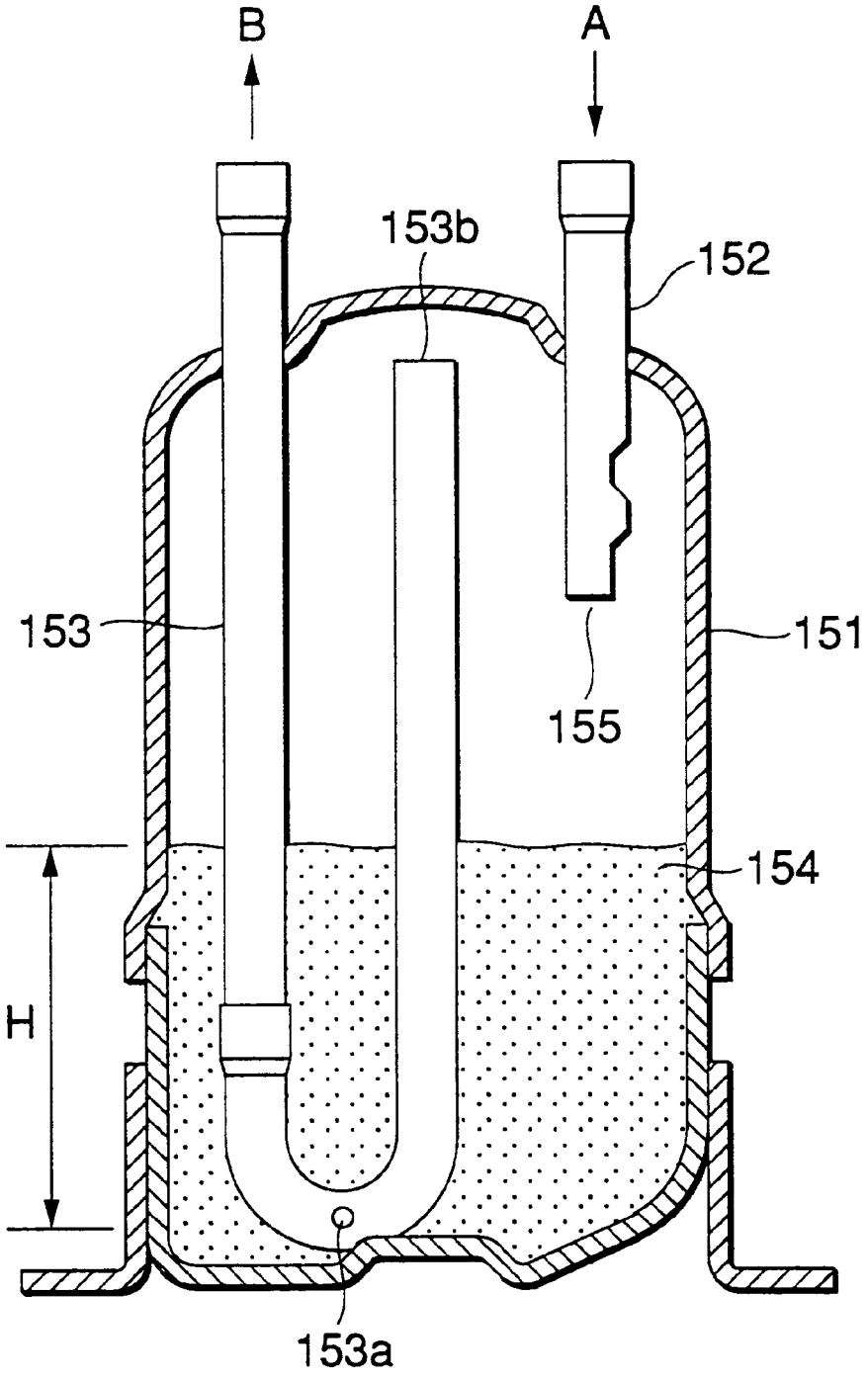
FIG. 31 is a vertical cross sectional view showing an example of a conventional accumulator.
Figure 32:
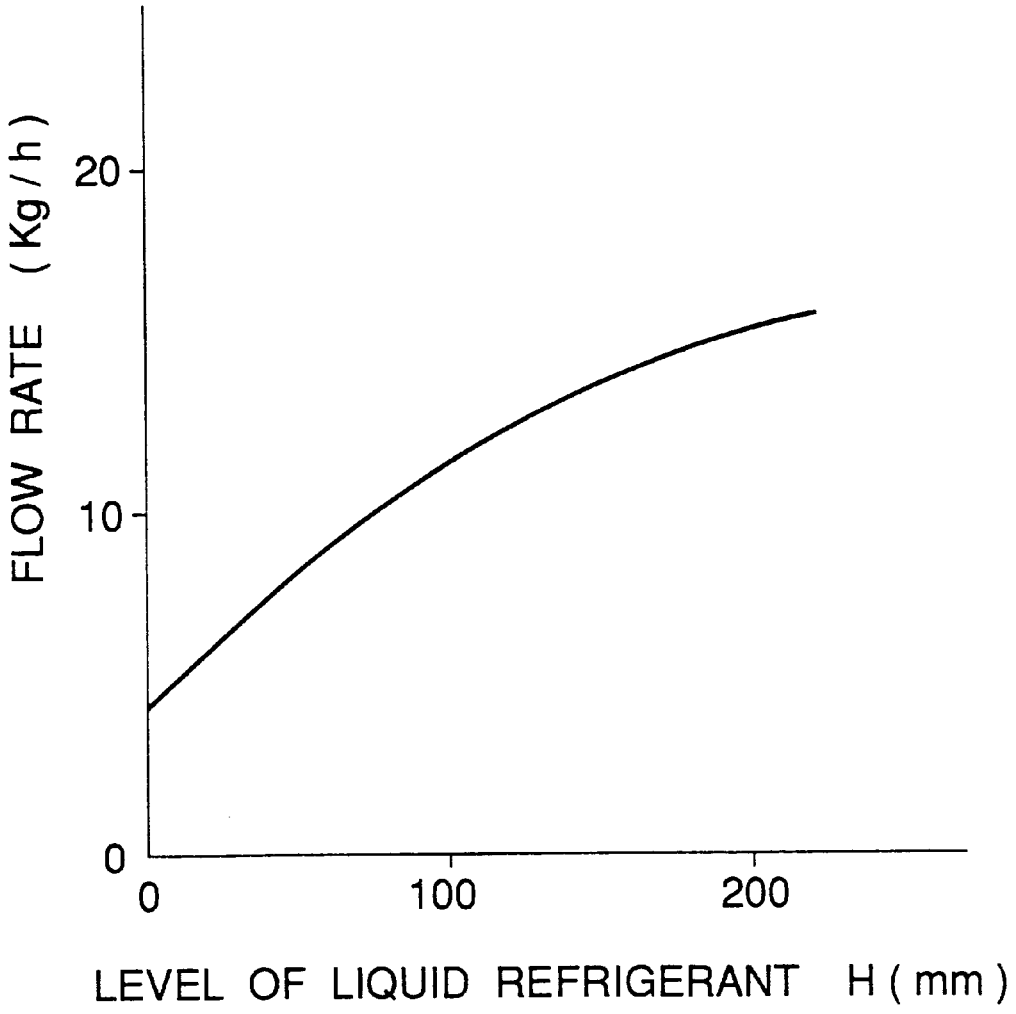
FIG. 32 is a graph showing flow rates (kg/h) of liquid refrigerant and refrigerating machine oil with respect to height (mm) of the liquid refrigerant level in a conventional accumulator.
Figure 33:
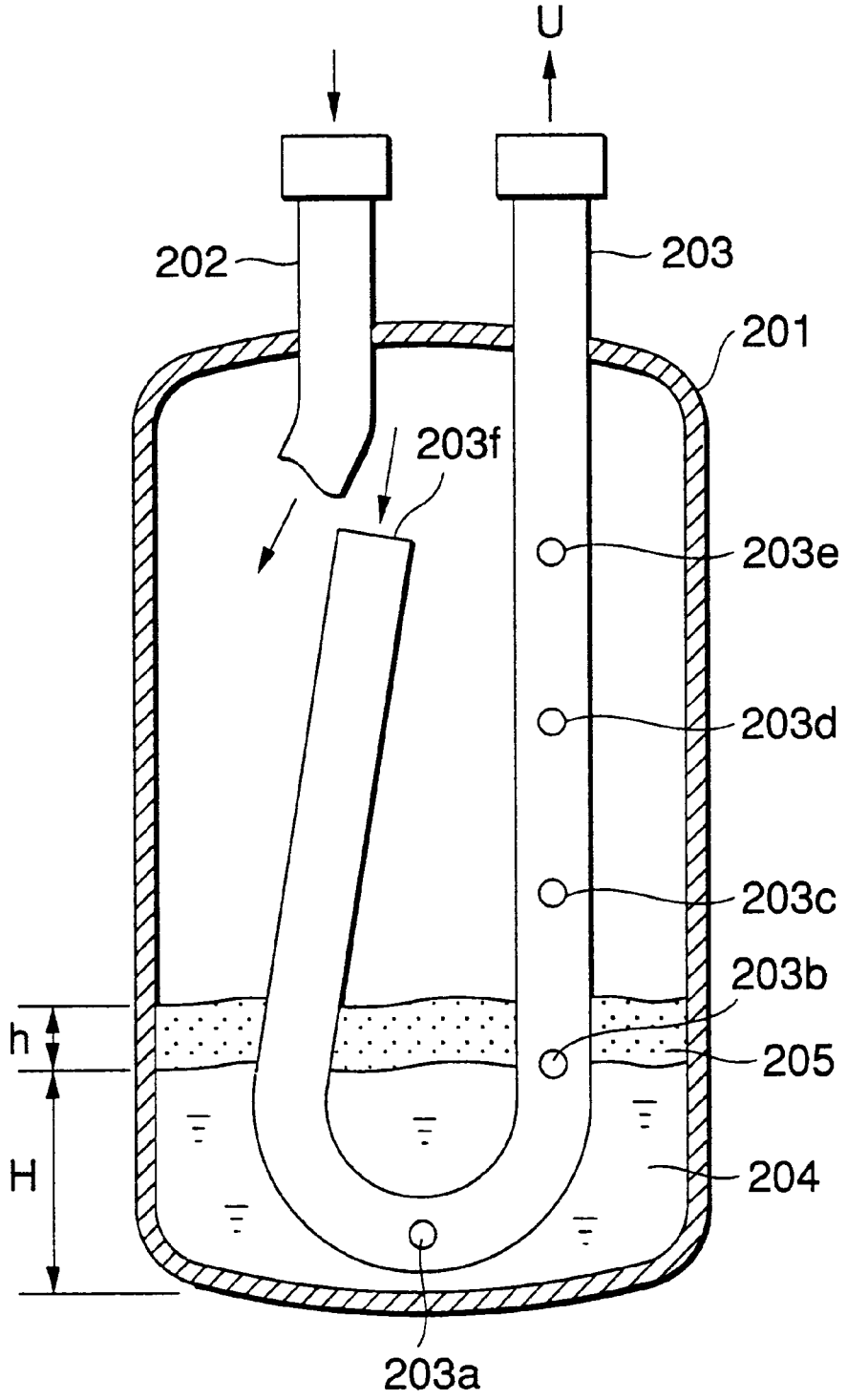
FIG. 33 is a vertical cross sectional view showing another example of conventional accumulator.
Figure 34:
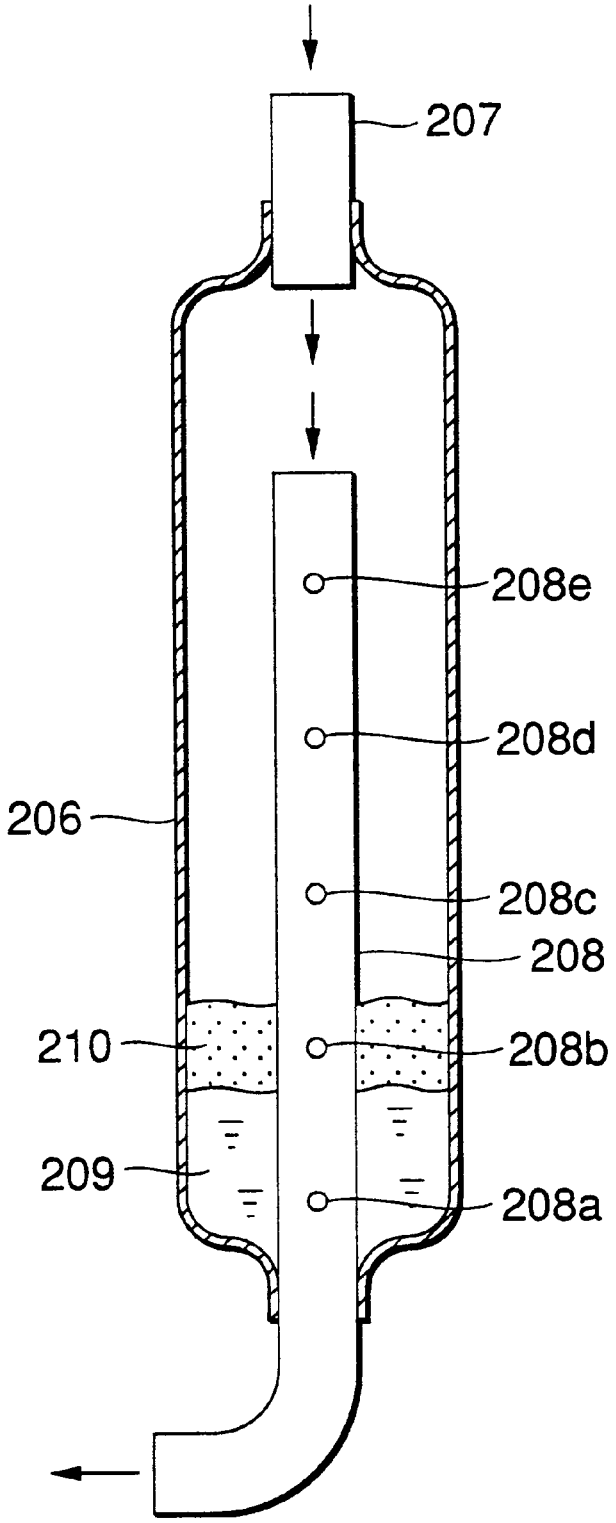
FIG. 34 is a vertical cross sectional view showing another example of conventional accumulator.
Figure 35:
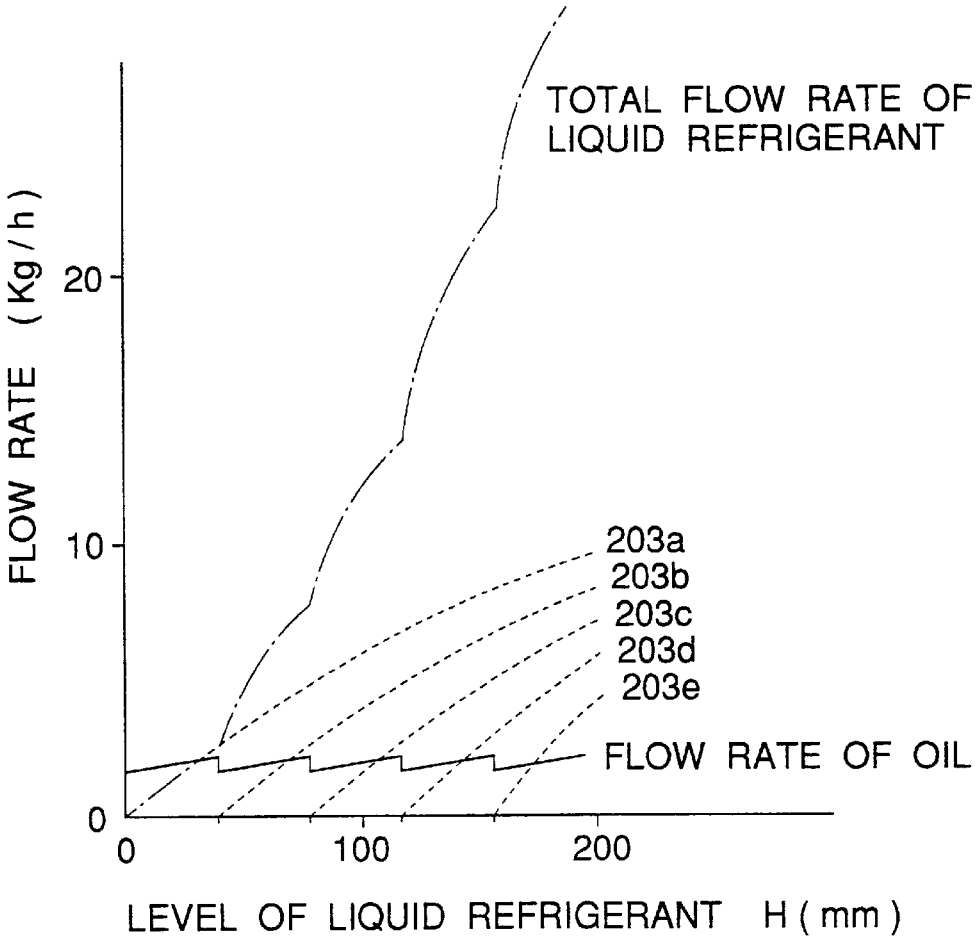
FIG. 35 is a graph showing flow rates (kg/h) of the liquid refrigerant and refrigerating machine oil with respect to height (mm) of the liquid refrigerant level in the conventional accumulator.
Figure 36A:
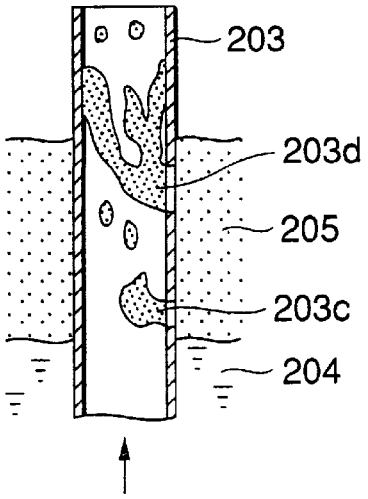
FIGS. 36(*a*) and 36(*b*) are schematic vertical cross sectional views showing the change in the flow rate into a discharge pipe in the conventional accumulator.
Figure 36B:
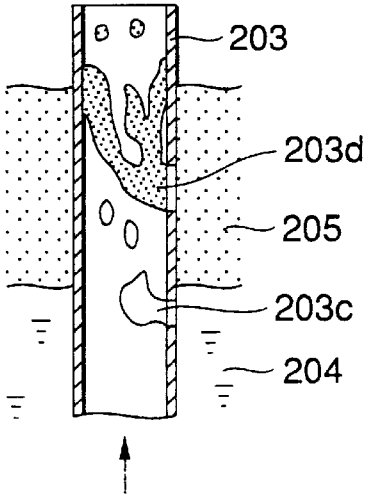

If the quantity of liquid refrigerant accumulated in the accumulator shown in FIG. 31 is enlarged in the conventional apparatus, the flow rate of the liquid refrigerant which is discharged to the compressor is enlarged. However, this embodiment is able to make the flow rate to be constant regardless of the quantity of the accumulated refrigerant. Even if no liquid refrigerant is introduced into the accumulator and refrigerating machine oil is introduced, refrigerating machine oil can reliably be recovered from the accumulator to the compressor, a defect of the operation of the compressor can be prevented.

Figure 5:
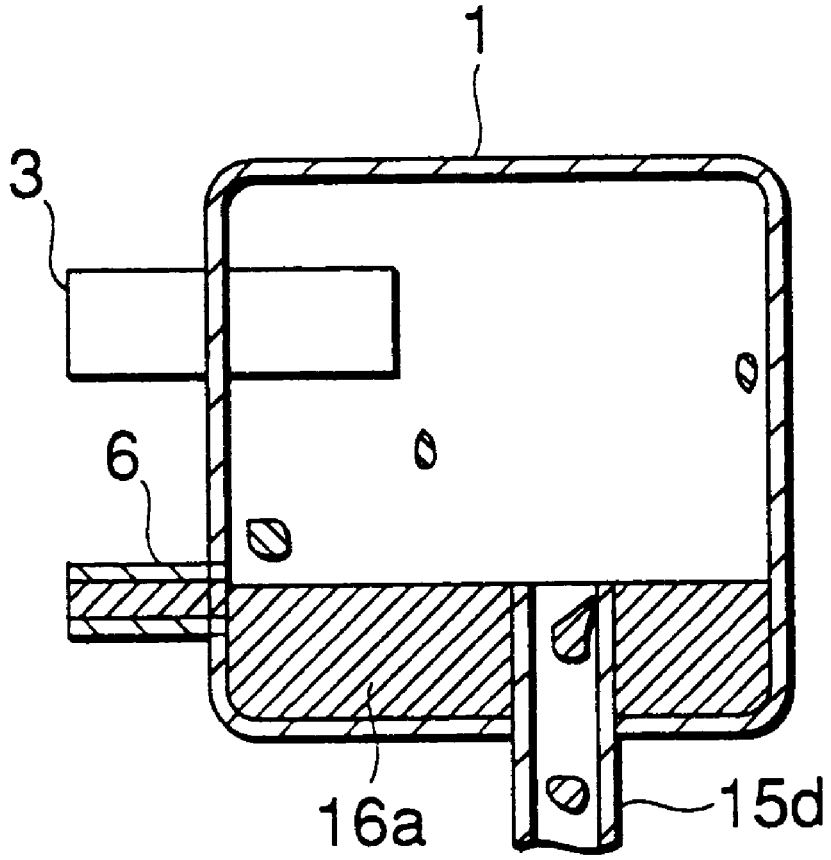
FIG. 5 is a vertical cross sectional view showing a first container according to a fourth embodiment.

FIG. 5 shows an example in which the shape and the position of the gas communication pipe 15 shown in FIG. 4(*a*) are changed. Also in this case, a similar effect can be obtained. Referring to FIG. 5, reference numeral 15*d* represents a gas communication pipe having no communication hole. The upper end of the gas communication pipe 15*d* corresponds to the height of the communication hole 15*a* shown in FIG. 4(*a*), the upper end being made to be a position at which a constant liquid level can be realized, that is, a position somewhat higher than the oil return pipe 6. As a result of an operation similar to that shown in FIG. 4(*a*), the height of the liquid level in the first container 1 can be limited. As a result, the flow rate of the liquid refrigerant (in which refrigerating machine oil is dissolved) which is discharged from the oil return pipe 6 to the compressor can be made to be substantially constant.

Although this embodiment has the structure in which the first container 1 is disposed above the second container 2, the first container 1 may be disposed below the second container 2 to obtain a similar effect as can easily be understood from the first embodiment.

Fourth Embodiment

An accumulator for use in a refrigerating and air-conditioning circuit according to a fourth embodiment of the present invention will now be described. Also the accumulator according to this embodiment has the means for separating the liquid refrigerant and refrigerating machine oil from each other and the means for making the heights of the liquid refrigerant and refrigerating machine oil to be constant.

In this embodiment, the structure for making the liquid level in the first container 1 to be constant is formed in such a manner that a communication hole is formed in the side surface of the gas communication pipe. Moreover, a pipe having a diameter larger than that of the gas communication pipe is disposed to include the gas communication pipe.

Figure 6A:
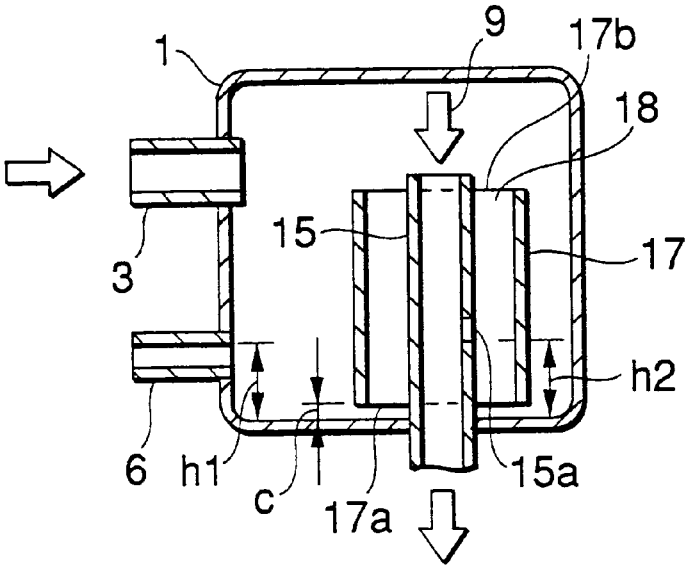
FIGS. 6(*a*) and 6(*b*) are respectively a vertical cross sectional view and a transverse cross sectional view showing an accumulator according to a fourth embodiment of the present invention.
Figure 6B:
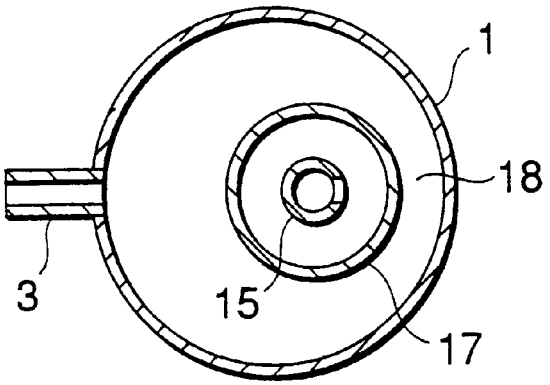

FIG. 6(*a*) is a vertical cross sectional view showing the accumulator according to this embodiment. FIG. 6(*b*) is a lateral cross sectional view of FIG. 6(*a*). Referring to the drawings, reference numeral 17 represents a cylinder disposed in such a manner that the cylinder 17 includes the gas communication pipe 15. Reference numeral 17*a* represents a lower end of the cylinder 17, the lower end 17*a* being a passage through which the liquid refrigerant flows. Reference numeral 17*b* represents an upper end of the cylinder 17, the upper end 17*b* being a passage through which the gas refrigerant 9 flows. Reference numeral 18 represents a gap between the gas communication pipe 15 and the cylinder 17. In order to maintain an appropriate gap c between the lower end 17*a* of the cylinder 17 and the bottom surface of the first container 1, the elements are secured to the first container 1. The gas communication pipe 15 has a communication hole 15*a* formed at a predetermined position at which the liquid level is required to be maintained.

The operation of the accumulator according to this embodiment will now be described in such a manner that a comparison with the embodiment shown in FIG. 1 is made. The gap 18 corresponds to the air-duct pipe 7, while the communication hole 15*a* corresponds to the communication pipe 8. Therefore, when the liquid level (the oil level) in the first container 1 is higher than h2, the liquid refrigerant is allowed to pass through the lower end 17*a* of the cylinder 17, and introduced into the liquid refrigerant 16 through the communication hole 15*a*, after which the liquid refrigerant is discharged to the second container 2. When the liquid level (the oil level) in the first container 1 is lower than h2, the gas refrigerant 9 is allowed to pass through the gap 18, and then introduced into the gas communication pipe 15 through the communication hole 15*a*. As a result, the liquid refrigerant is not introduced into the gas communication pipe 15. As described above, the liquid refrigerant 16 and the cylinder 17 form the means for making the heights of the liquid refrigerant and refrigerating machine oil to be constant. The means for separating the liquid refrigerant and refrigerating machine oil from each other may be arranged in such a manner that the first container 1 is kept calmly and the oil return pipe 6 is disposed at the position in the layer of refrigerating machine oil separated from the liquid refrigerant because of the characteristic of refrigerating machine oil.

As described above, the fourth embodiment is able to realize the same function which can be realized by the first and second embodiments.

The fourth embodiment is structured on the assumption that refrigerating machine oil having poor solubility with the refrigerant is used. The difference from the third embodiment lies in that whether the cylinder 17 is provided. Therefore, if the structure of this embodiment is applied to the refrigerating and air-conditioning circuit which uses refrigerating machine oil having solubility with the refrigerant, the liquid level in the first container 1 can be made to be constant similarly to the structure in which refrigerating machine oil having no solubility or poor solubility.

Fifth Embodiment

An accumulator for use in a refrigerating and air-conditioning circuit according to a fifth embodiment of the present invention will now be described. Also the accumulator according to this embodiment is structured to be adaptable to a case in which refrigerating machine oil having poor solubility with the refrigerant is used in the refrigerating and air-conditioning circuit. The first container 1 is provided with the means for separating the liquid refrigerant and refrigerating machine oil and the means for making the heights of the liquid refrigerant and refrigerating machine oil to be constant.

In this embodiment, the liquid level in the first container is made to be constant by diagonally cutting the lower end portion of the gas communication pipe and a pipe having a diameter larger than that of the gas communication pipe is disposed to include the gas communication pipe.

Figure 7A:
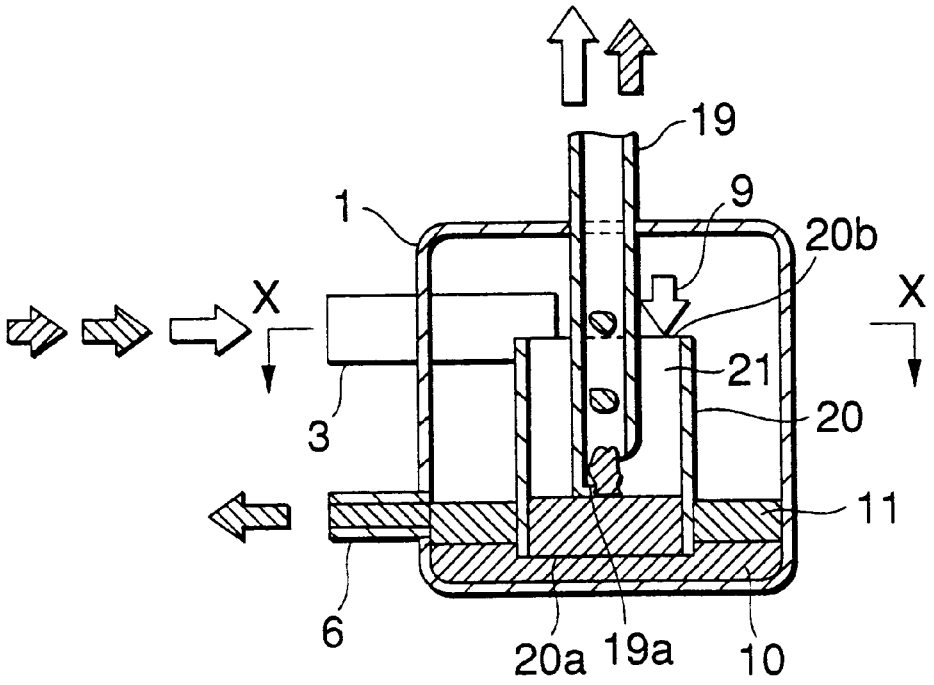
FIGS. 7(*a*) and 7(*b*) are respectively a vertical cross sectional view and a transverse cross sectional view showing an accumulator according to a fifth embodiment of the present invention.
Figure 7B:
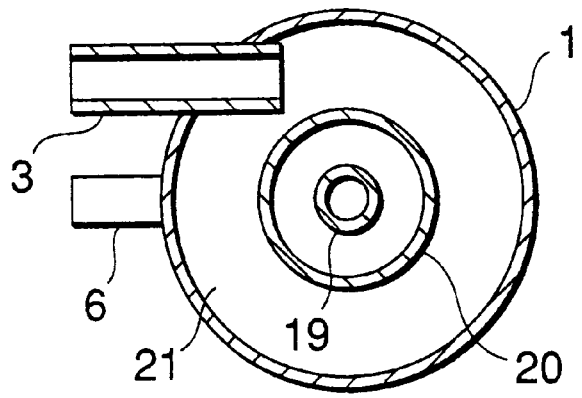

FIG. 7(*a*) is a vertical cross sectional view showing the accumulator according to this embodiment. FIG. 7(*b*) is a cross sectional view taken along line X—X shown in FIG. 7 (*a*). Reference numeral 19 represents the gas communication pipe having a lower end 19*a* cut diagonally. As shown in the drawings, the gas communication pipe 19 is secured in such a manner that a somewhat large gap is formed between the lower end 19*a* and the bottom surface of the first container 1. The position is a position at which the required liquid level is maintained. Reference numeral 20 represents a cylinder arranged to include the gas communication pipe 19. Reference numeral 20*a* represents a lower end of the cylinder 20, and 20*b* represents an upper end of the same. Reference numeral 21 represents a gap between the gas communication pipe 19 and the cylinder 20, the gap 21 having opened upper and lower ends. The height of the lower end 20*a* is lower than the lower end 19*a* of the gas communication pipe 19, while the height of the oil return pipe 6 is included in a range between the lower end 19*a* of the gas communication pipe 19 and the lower end 20*a* of the cylinder 20.

The operation will now be described. FIG. 7(*a*) shows a state in which refrigerating machine oil 11 and the liquid refrigerant 10 exist in the first container 1. The liquid refrigerant 10 is allowed to pass through the gap between the lower end 20*a* of the cylinder 20 and the bottom surface of the first container 1, and then introduced into the gap 21. Then, the liquid refrigerant 10 reaches the lower end 19*a* of the gas communication pipe 19. The lower end 19*a* cut diagonally has a lower end adjacent to the liquid refrigerant 10 as illustrated. Since the gas refrigerant 9 flows adjacent to the surface of the liquid refrigerant 10 when the gas refrigerant 9 is introduced into the lower end 19*a* of the gas communication pipe 19, a portion of the liquid refrigerant 10 is caused to move upward. Thus, the liquid refrigerant 10 is discharged from the first container 1, and then accumulated in the second container (not shown).

When the liquid level of the liquid refrigerant 10 has been furthermore be raised, the area of the lower end 19*a* of the gas communication pipe 19 through which the gas refrigerant 9 is allowed to pass is reduced. Thus, the flow velocity is raised, causing the liquid refrigerant 10 to be moved upwards in a larger quantity. If the liquid level of the liquid refrigerant 10 is low, the quantity of discharge from the first container 1 is reduced. As a result, the liquid level in the first container 1 can be made to be constant.

The fifth embodiment has the structure to be adaptable to use refrigerating machine oil having poor solubility with the refrigerant. Another structure from which the cylinder 20 is omitted may be employed to attain an effect similar to that obtainable from the fourth embodiment in a case of refrigerating machine oil having solubility with the refrigerant is used in the refrigerating and air-conditioning circuit.

Sixth Embodiment

An accumulator for use in a refrigerating and air-conditioning circuit according to a sixth embodiment of the present invention will now be described. Also the accumulator according to this embodiment is structured to be adaptable to the refrigerating and air-conditioning circuit using refrigerating machine oil having poor solubility with the refrigerant. The first container includes the means for separating liquid refrigerant and refrigerating machine oil from each other and the means for making the heights of the liquid refrigerant and refrigerating machine oil to be constant.

In this embodiment, the liquid level in the first container is made to be constant by a structure in which the first container is disposed above or below the second container. Moreover, the first container and the second container are connected to each other by a liquid return pipe, and a cylinder (a pipe) having a diameter larger than the liquid return pipe is disposed in such a manner as to include the portion near the upper portion of the liquid return pipe.

Figure 8A:
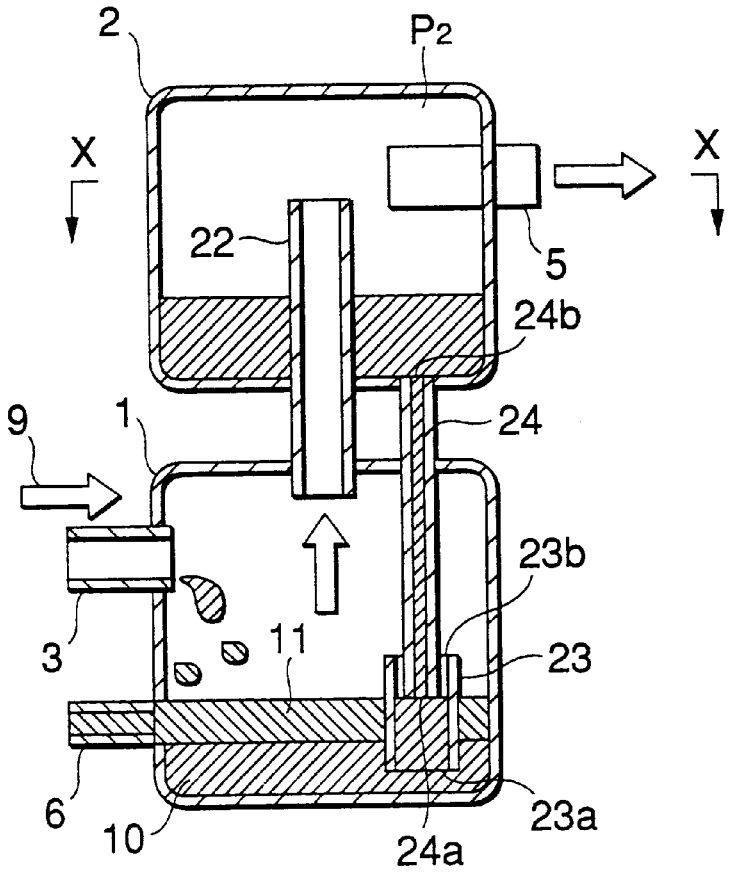
FIGS. 8(*a*) and 8(*b*) are respectively a vertical cross sectional view and a transverse cross sectional view showing an accumulator according to a sixth embodiment of the present invention.
Figure 8B:
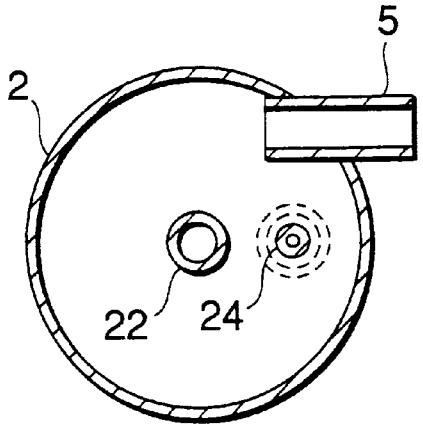

FIG. 8(*a*) is a vertical cross sectional view showing an accumulator according to this embodiment, and FIG. 8(*b*) is a cross sectional view taken along line X—X shown in FIG. 8(*a*). In this embodiment, the first container 1 is disposed below the second container 2.

Referring to the drawings, reference numeral 22 represents a gas communication pipe for establishing the communication between the first container 1 and the second container 2 so that the upper space in the first container 1 and the upper space in the second container 2 are allowed to communicate with each other. Reference numeral 23 represents a cylinder, 23*a* represents a lower end of the cylinder 23, and 23*b* represents an upper end 23*b* of the cylinder 23. The lower end 23*a* of the cylinder 23 is secured in such a manner that an appropriate gap is formed from the bottom portion of the first container 1. Reference numeral 24 represents a refrigerant suction pipe which establishes the communication between the bottom portion of the second container 2 and the first container 1. Reference numeral 24*a* represents a lower end of the refrigerant suction pipe 24. Reference numeral 24*b* represents an upper end of the refrigerant suction pipe 24. The upper end 24*b* of the refrigerant suction pipe 24 is disposed in the bottom portion of the second container 2, while the position of the lower end 24*a* of the refrigerant suction pipe 24 is upper than the oil return pipe 6. That is, the position of the lower end 24*a* of the refrigerant suction pipe 24 is made to be the height at which the liquid level is required to be maintained. Moreover, the upper end 23*b* of the cylinder 23 is made to be upper than the lower end 24*a* of the refrigerant suction pipe 24, while the lower end 23*a* of the cylinder 23 is made to be lower than the oil return pipe 6.

The operation will now be described. FIG. 8(*a*) shows a state in which refrigerating machine oil 11 and liquid refrigerant 10 exist in the first container 1. When the gas refrigerant 9 flows from the first container 1 into the second container 2 through the gas communication pipe 22, a pressure loss (pressure difference $\Delta P$) takes place. That is, the pressure in the first container 1 is made to be higher than the pressure in the second container 2 by $\Delta P$. Therefore, the liquid refrigerant 10 in the first container 1 is allowed to pass through the cylinder 23 and the refrigerant suction pipe 24, and then pushed upwards into the second container 2. The cylinder 23 has a function similar to that of the cylinder 17 according to the fourth embodiment. Therefore, only the liquid refrigerant 10 is selectively allowed to pass through the gap formed by the lower end 23*a* of the cylinder 23, and then introduced into the second container 2.

When the gas refrigerant 9 is not introduced from the suction pipe 3 in a case of interruption of the operation of the refrigerating and air-conditioning circuit, the pressure difference ΔP is not generated. Therefore, the liquid refrigerant 10 and refrigerating machine oil 11 accumulated in the second container 2 is allowed to pass through the refrigerant suction pipe 24, and then dropped into the first container 1.

Figure 9:
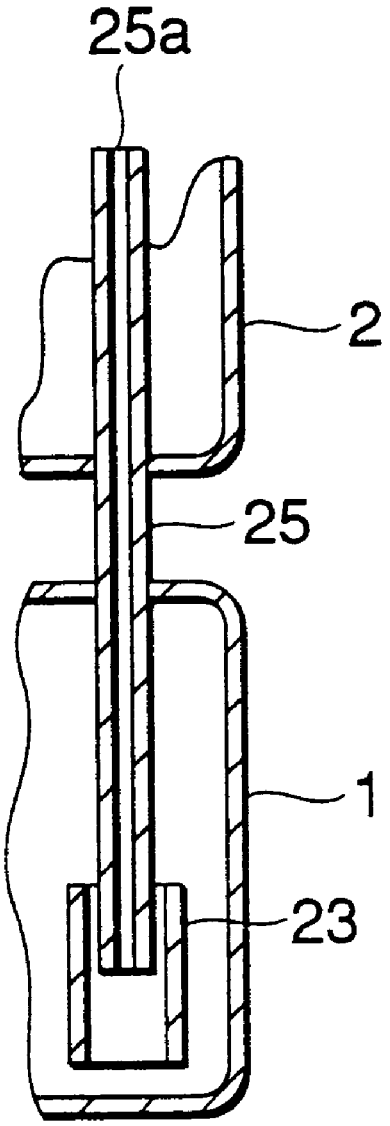
FIG. 9 is a vertical cross sectional view showing a refrigerant suction pipe according to the sixth embodiment.

FIG. 9 shows a state in which the position of the upper end of the refrigerant suction pipe is different from that in the case shown in FIG. 8(*a*). Referring to the drawing, reference numeral 25 represents a refrigerant suction pipe having an upper end 25*a* which is opened in the space in the second container 2. Since the pressure difference ΔP is generated also in the structure shown in FIG. 9 similarly to the structure shown in FIG. 8(*a*), only the liquid refrigerant 10 is selectively introduced into the second container 2 so that the liquid refrigerant 10 is moved to the second container 2 regardless of the position of the upper end 25*a* of the refrigerant suction pipe 25.

The difference in the structure from that shown in FIG. 8(*a*) lies in the height of the upper end 25*a* of the refrigerant suction pipe 25. Therefore, the difference in the function lies in that the liquid refrigerant 10 and refrigerating machine oil 11 accumulated in the second container 2 do not drop in the first container 1 even if the gas refrigerant 9 is not introduced from the suction pipe 3 (when the operation of the apparatus is interrupted).

As described above, this embodiment is able to make the liquid level in the first container 1 to be substantially constant. Therefore, refrigerating machine oil 11 can be made to exist adjacent to the height of the oil return pipe 6 and thus refrigerating machine oil 11 can selectively be returned to the compressor. Moreover, the liquid refrigerant 10 can be accumulated in the second container 2.

Figure 10A:
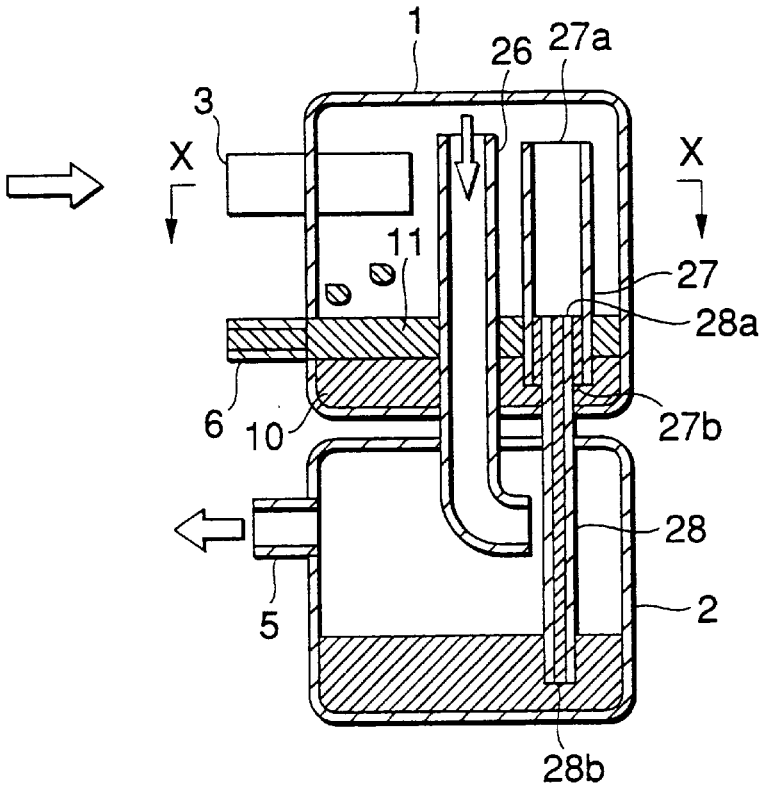
FIGS. 10(*a*) and 10(*b*) are respectively a vertical cross sectional view and a transverse cross sectional view showing the accumulator according to the sixth embodiment.
Figure 10B:
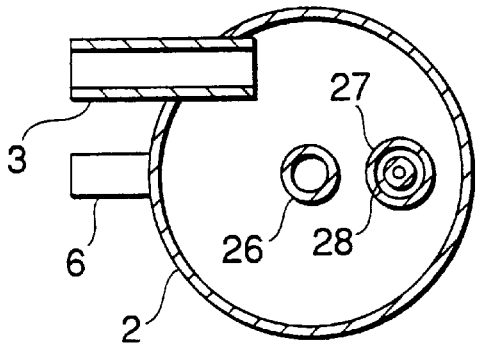

A modification of this embodiment will now be described. FIG. 10(*a*) is a vertical cross sectional view showing an accumulator according to this modification. FIG. 10(*b*) is a cross sectional view taken along line X—X shown in FIG. 10(*a*). As shown in FIG. 10, the modification is structured in such a manner that the first container 1 is disposed above the second container 2.

Referring to the drawings, reference numeral 26 represents a gas communication pipe for establishing the communication between the first container 1 and the second container 2. Thus, the upper space in the first container 1 and the upper space in the second container 2 are allowed to communicate with each other. Reference numeral 27 represents a cylinder and 27*b* represents a lower end of the cylinder 27. Reference numeral 27*a* represents an upper end of the cylinder 27. The lower end 27*b* of the cylinder 27 is secured in such a manner that an appropriate gap is formed from the bottom portion of the first container 1. Reference numeral 28 represents a refrigerant return pipe and 28*a* represents an upper end of the refrigerant return pipe 28. Reference numeral 28*b* represents a lower end of the refrigerant return pipe 28.

When the structure is arranged in such a manner that the position of the lower end 27*b* of the cylinder 27<the position of the oil return pipe 6<the position of the upper end 28*a* of the refrigerant return pipe 28, the liquid level can be made to be constant at a position near the upper end 28*a* of the refrigerant return pipe 28 similarly to the structure shown in FIG. 8. Even if the liquid refrigerant 10 and refrigerating machine oil 11 are accumulated in the first container 1, only the liquid refrigerant can selectively be discharged to the second container 2.

This embodiment has the structure that refrigerating machine oil having poor solubility with the refrigerant is used. If refrigerating machine oil having solubility with the refrigerant is used in the refrigerating and air-conditioning circuit, a structure from which the cylinder 23 (shown in FIGS. 8 and 9) and the cylinder 27 (shown in FIG. 10) are omitted attains a similar effect.

Seventh Embodiment

An accumulator according to a seventh embodiment and adaptable to a refrigerating and air-conditioning circuit will now be described. This embodiment has a structure that the liquid level (the oil level) in the first container 1 is made to be constant.

In this embodiment, the liquid level in the first container is made to be constant by a floating structure which comprises a liquid return hole formed in the side surface of a gas communication pipe and the liquid return hole is opened or closed in synchronization with the liquid level in the first container.

Figure 11A:
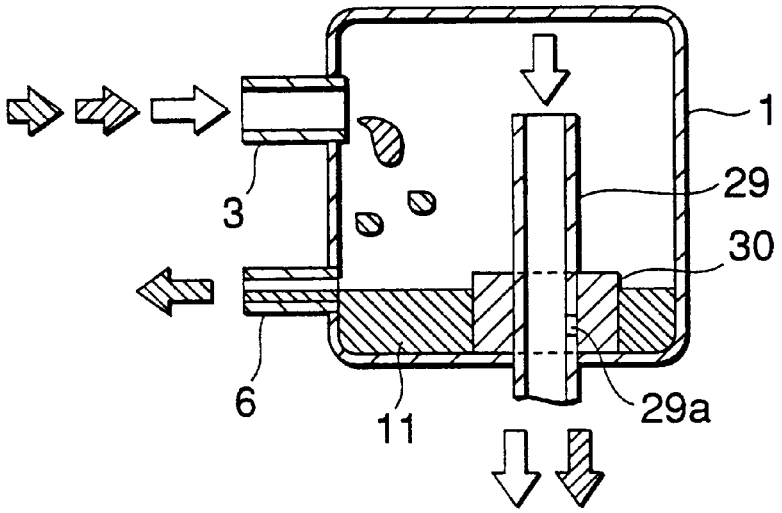
FIGS. 11(*a*) and 11(*b*) are cross sectional views cross sectional view showing an accumulator according to a seventh embodiment of the present invention.
Figure 11B:
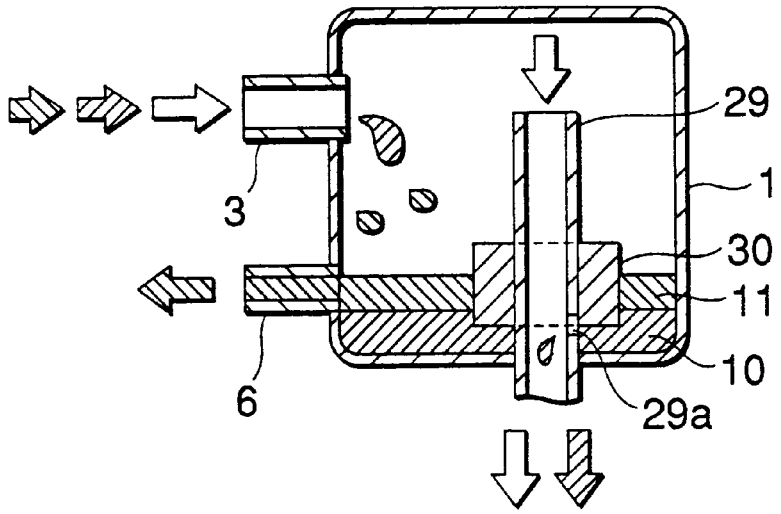

FIG. 11 is a vertical cross sectional view showing the accumulator according to this embodiment. Referring to the drawing, reference numeral 29 represents a gas communication pipe for establishing the communication between the upper space in the first container 1 and the upper space in the second container (not shown). Reference numeral 29*a* represents a refrigerant return hole formed in the side surface of the gas communication pipe 29. The refrigerant return hole 29*a* is formed at a position lower than the position of the oil return pipe 6. Reference numeral 30 represents a float manufactured by molding resin or metal having spaces so as to float on the liquid refrigerant 10 and refrigerating machine oil 11. That is, the float 30 may be made of a material having a specific gravity which is smaller than the specific gravity of refrigerating machine oil 11 because the specific gravity of refrigerating machine oil 11 is about 0.9.

The float 30 floats on the liquid refrigerant 10 and refrigerating machine oil 11 in the first container 1 and moves in accordance with the liquid level. When, for example, only refrigerating machine oil 11 mixed with the gas refrigerant 9 is introduced into the first container 1, the liquid level is low as shown in FIG. 11(*a*). Thus, the refrigerant return hole 29*a* is closed. Therefore, even if refrigerating machine oil 11 is accumulated over the refrigerant return hole 29*a*, refrigerating machine oil 11 is not introduced into the gas communication pipe 29.

When refrigerating machine oil 11 and the liquid refrigerant 10 mixed with the gas refrigerant 9 are introduced into the first container 1 as shown in FIG. 11(*b*), existing refrigerating machine oil 11 and the liquid refrigerant 10 are separated from each other in the first container 1. In this case, the liquid level in the first container 1 is made to be higher than that realized in the structure shown in FIG. 11(*a*). As a result, the refrigerant return hole 29*a* is opened. Therefore, the liquid refrigerant 10 accumulated over the refrigerant return hole 29*a* is introduced into the gas communication pipe 29. As a result of the above-mentioned operation, the liquid refrigerant 10 is selectively moved to the second container so that liquid refrigerant 10 is returned from the oil return pipe 6 to the compressor.

The seventh embodiment is arranged to make the liquid level in the first container 1 to be constant and only the liquid refrigerant is selectively moved to the second container. The liquid refrigerant and refrigerating machine oil are naturally separated from each other if the first container 1 is kept calmly.

However, an actual operation state sometimes encounters a state in which the liquid refrigerant and refrigerating machine oil are not satisfactorily separated from each other. In this case, refrigerating machine oil is sometimes introduced into the second container though the flow rate is small. In an example case in which the refrigerating and air-conditioning circuit is operated for a long time, coexisting refrigerating machine oil and liquid refrigerant are sometimes accumulated. If refrigerating machine oil is accumulated in the second container, there is apprehension that the quantity of oil in the compressor is insufficient. Therefore, the above-mentioned state must be prevented in order to reliably operate the refrigerating and air-conditioning circuit.

The eighth and ninth embodiments have the structure comprising a moving means for returning liquids, such as refrigerating machine oil and the liquid refrigerant accumulated in the second container to the first container 1 when the operation of the refrigerating and air-conditioning circuit is interrupted or when the gas refrigerant 9 is not introduced. The foregoing structure will now be described.

Eighth Embodiment

Figure 12A:
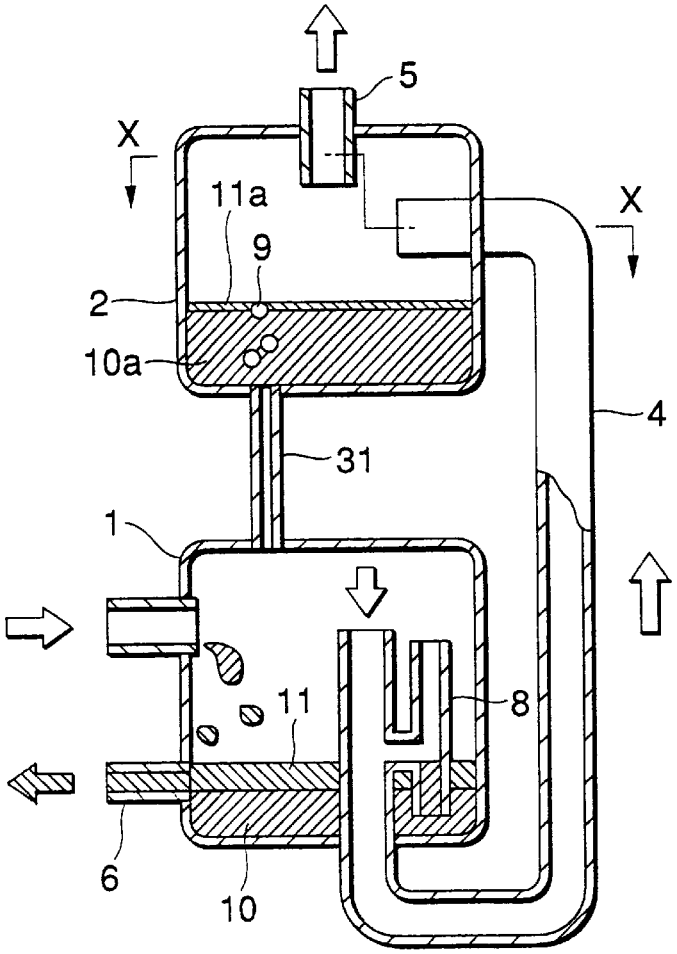
FIGS. 12(*a*) and 12(*b*) are respectively a vertical cross sectional view and a transverse cross sectional view showing an accumulator according to an eighth embodiment of the present invention.
Figure 12B:
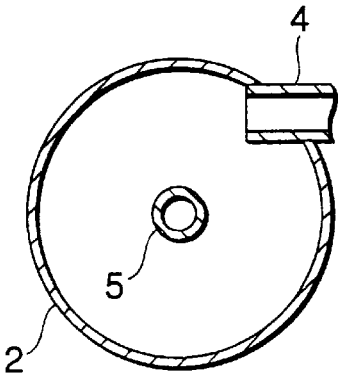

An accumulator according to the eighth embodiment of the present invention and adapted to a refrigerating and air-conditioning circuit will now be described. FIG. 12(*a*) is a vertical cross sectional view showing the accumulator according to this embodiment. FIG. 12(*b*) is a lateral cross sectional view.

In this embodiment, a state is assumed in which opacified refrigerating machine oil and liquid refrigerant are introduced into the second container 2. Thus, refrigerating machine oil mixed and introduced into the second container is returned to the first container. Therefore, the first container is disposed at a lower position and a communication pipe for establishing the communication between the upper portion in the first container and the lower portion in the second container is provided.

Referring to the drawings, reference numeral 31 represents a moving means for moving liquid accumulated in the second space, which is the second container 2 in this embodiment, to the first space which is the first container 1 in this embodiment. The moving means is, for example, a communication pipe which is composed of a communication means for establishing the connection between a position adjacent to the bottom portion of the second container 2, which is a liquid accumulation portion, and the upper portion of the first container 1. Reference numeral 10*a* represents liquid refrigerant and 11*a* represents refrigerating machine oil accumulated in the second container 2. In this embodiment, the second container 2 is disposed above the first container 1.

FIG. 12 shows a state realized during the operation. In this case, a pressure loss takes place in the gas passage pipe 4, causing the pressure in the second container 2 to be lower than that in the first container 1. The foregoing difference in the pressure prevents downward movement of the liquid refrigerant 10*a* and refrigerating machine oil 11*a* in the second container 2 to the first container 1 through the moving means 31. Thus, the gas refrigerant 9 flows upwards into the second container 2. As a result, the liquid refrigerant 10*a* and refrigerating machine oil 11*a* are accumulated in the second container 2.

When the operation of the refrigerating and air-conditioning circuit has been interrupted, the pressures in the first container 1 and the second container 2 are made to be the same. Thus, the liquid refrigerant 10*a* and refrigerating machine oil 11*a* accumulated in the second container 2 are dropped into the first container 1 by dint of gravity. When the refrigerating and air-conditioning circuit has been operated, the liquid refrigerant 10 moved to the first container 1 is allowed to pass through the communication pipe 8, and then introduced into the gas passage pipe 4. Then, the liquid refrigerant 10 is moved to the second container 2. On the other hand, refrigerating machine oil 11 returned to the first container 1 flows from the oil return pipe 6 to the compressor.

When the operation and interruption of the refrigerating and air-conditioning circuit are repeated, refrigerating machine oil 11*a* accumulated in the second container 2 by dint of the sequential operation can be recovered into the compressor through the first container 1.

Figure 13:
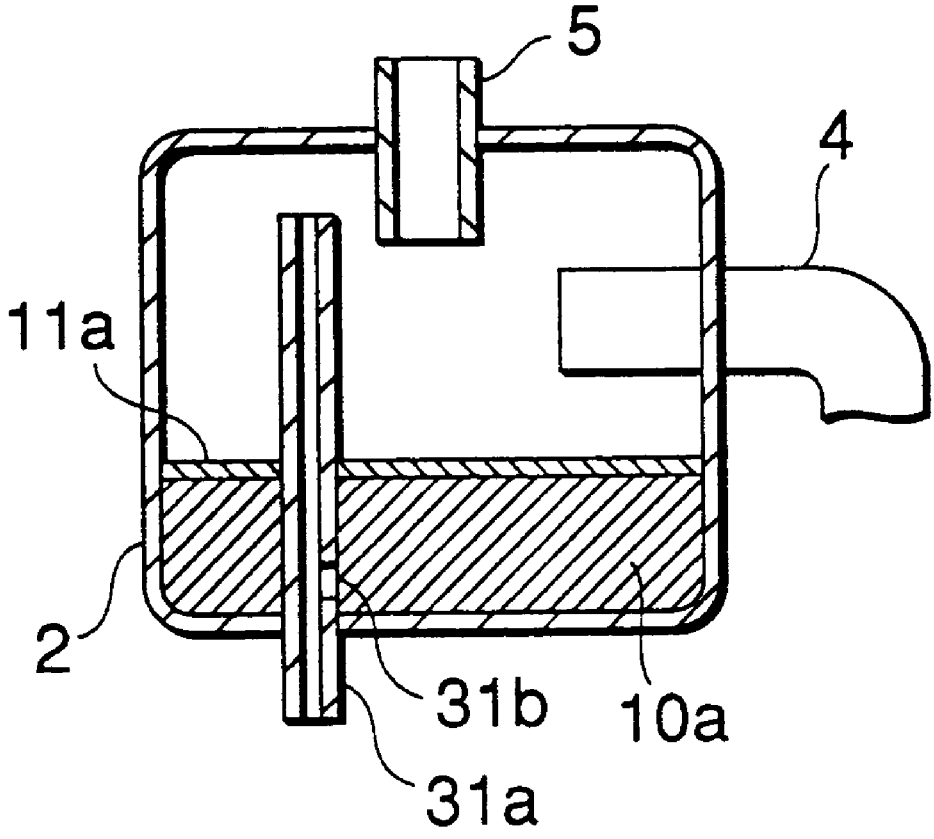
FIG. 13 is a vertical cross sectional view showing a second container according to the eighth embodiment.

FIG. 13 shows a state in which the position of the upper end of the communication pipe which establishes the communication between the bottom portion in the second container 2 and the upper portion in the first container 1 is different from that in the structure shown in FIG. 12(*a*). Referring to the drawing, reference numeral 31*a* represents a communication pipe having an upper end opened in the gas space in the second container 2. Moreover, a communication hole 32*b* is formed in the liquid accumulation portion in the lower portion in the second container 2.

In the above-mentioned structure, the difference in the pressure takes place in a state shown in FIG. 13 similarly to the state shown in FIG. 12(*a*) during the operation of the apparatus. Therefore, the gas refrigerant 9 is introduced into the upper portion in the second container 2. On the other hand, refrigerating machine oil 11*a* is not moved downwards into the first container 1. After the refrigerating and air-conditioning circuit has been interrupted, the liquid refrigerant 10*a* and refrigerating machine oil 11*a* allowed to pass through the communication hole 31*b* and accumulated in the second container 2 are moved downwards into the first container 1.

That is, the gas refrigerant 9 can be moved to the gas space in the second container 2 during the operation. After the operation of the apparatus has been interrupted, the liquid refrigerant 10*a* and refrigerating machine oil 11*a* accumulated in the second container 2 can be returned to the first container 1 through the communication hole 31*b*.

Ninth Embodiment

Figure 14:
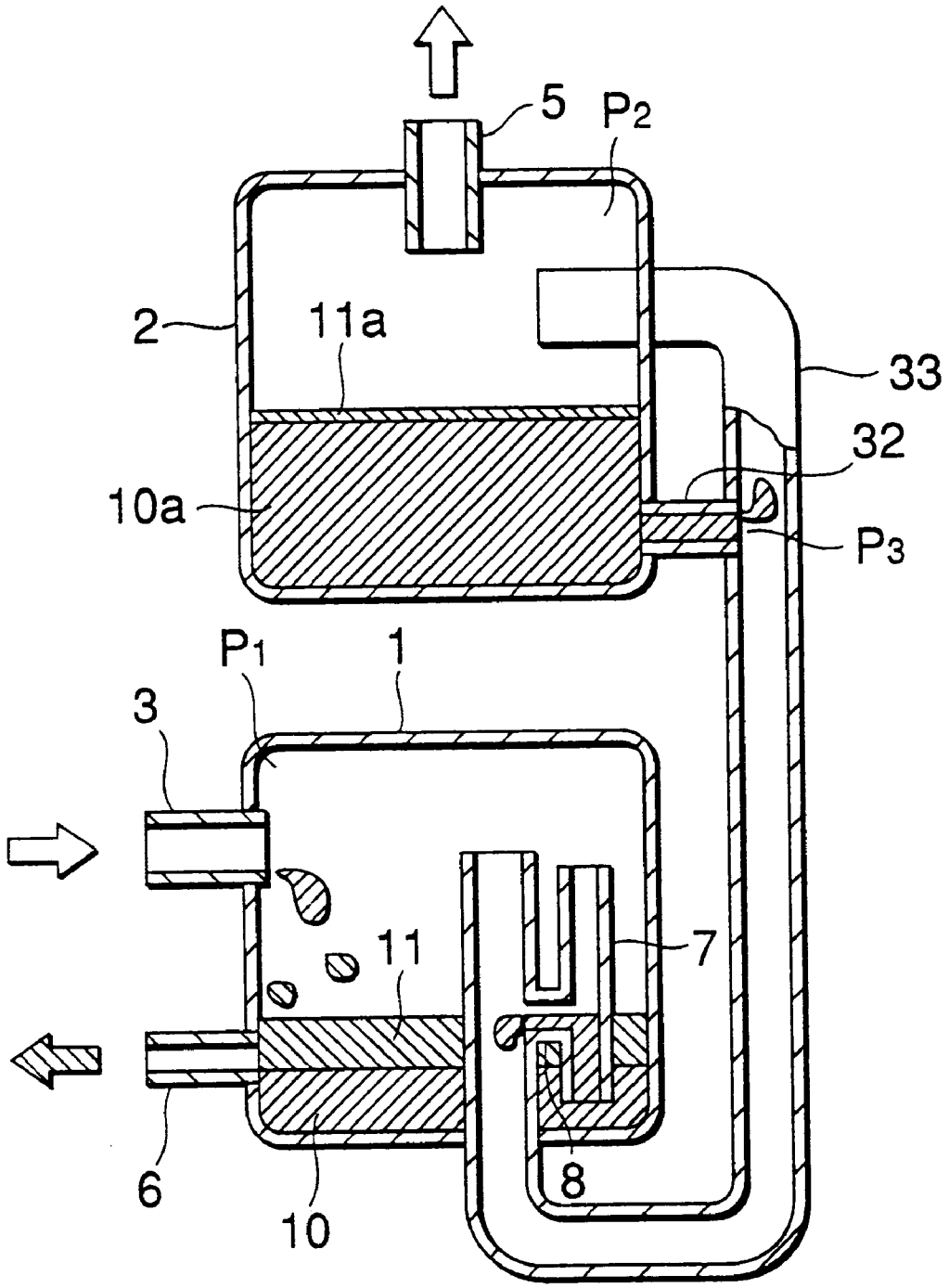
FIG. 14 is a vertical cross sectional view showing an accumulator according to a ninth embodiment of the present invention.

The structure of an accumulator according to a ninth embodiment of the present invention and adaptable to a refrigerating and air-conditioning circuit will now be described. FIG. 14 is a vertical cross sectional view showing the accumulator according to this embodiment. FIG. 14 shows a state in which the refrigerating and air-conditioning circuit is operated.

Referring to the drawing, reference numeral 32 represents a communication pipe serving as both of a liquid communication means and a gas communication means, the communication pipe 32 being a gas communication pipe in this embodiment. Reference numeral 33 represents a communication means for establishing the communication between the liquid accumulation portion in the second container 2 and an intermediate position of the communication pipe 32, the communication means 33 being a communication pipe. Also this embodiment has the structure that the second container 2 is disposed above the first container 1. Moreover, the communication pipe 33 and the gas communication pipe 32 establish the communication between the liquid accumulation portion in the second container 2 and the first container 1.

In this embodiment, an assumption is made that refrigerating machine oil and the liquid refrigerant are opacified and introduced into the second container. Thus, refrigerating machine oil mixed and introduced into the second container is returned to the first container. A liquid return hole is formed in the side surface of the gas communication pipe connected to the second container. Moreover, the liquid return hole and the lower portion of the second container are allowed to communicate with each other.

The operation will now be described. The pressure in the accumulator which is realized during the operation will now be described. An assumption is made that the pressure in the first container 1 is P1, the pressure in the second container 2 is P2 and the pressure in the gas communication pipe 32 is P3. Since a pressure loss takes place because a gas flows, the pressures have the relationships satisfying P1>P3>P2. Therefore, liquid refrigerant 10 and refrigerating machine oil 11 are mixed with the gas refrigerant and allowed to flow from the first container 1 to the gas communication pipe 32 during the operation to follow the flow of the gas refrigerant. Then, they are allowed to pass through an opened end of the gas communication pipe 32 or the communication pipe 33, and then introduced into the second container 2. Thus, the liquid refrigerant 10*a* and refrigerating machine oil 11*a* are, together with the gas refrigerant, accumulated in the second container 2.

In a state of interruption of the operation, gravity causes the liquid refrigerant 10*a* and refrigerating machine oil 11*a* accumulated in the second container 2 to flow through the communication pipe 33 and the gas communication pipe 32, and then moved to the first container 1. Since the first container 1 remains at rest, the liquid refrigerant 10 and refrigerating machine oil 11 are naturally separated from each other in the lower portion of the first container 1.

When the operation has been restarted, refrigerating machine oil 11 in the first container 1 is returned to the compressor through the oil return pipe. Thus, the liquid refrigerant 10 is, together with the gas refrigerant 9, moved to the second container 2.

As a result of the above-mentioned operation, refrigerating machine oil accumulated in the second container 2 can be recovered into the compressor.

The eighth and ninth embodiments are structured on the assumption that refrigerating machine oil 11*a* in a small quantity is introduced into the second container 2 during the operation of the refrigerating and air-conditioning circuit.

Thus, the moving means is provided which returns refrigerating machine oil 11*a* accumulated in the second container 2 to the first container 1 when the operation of the refrigerating and air-conditioning circuit is interrupted.

Each of tenth, eleventh and twelfth embodiments has a moving means which is capable of returning refrigerating machine oil 11*a* accumulated in the second container 2 to the first container 1 without a necessity of interrupting the refrigerating and air-conditioning circuit, that is, even during the operation of the refrigerating and air-conditioning circuit.

Tenth Embodiment

Figure 15:
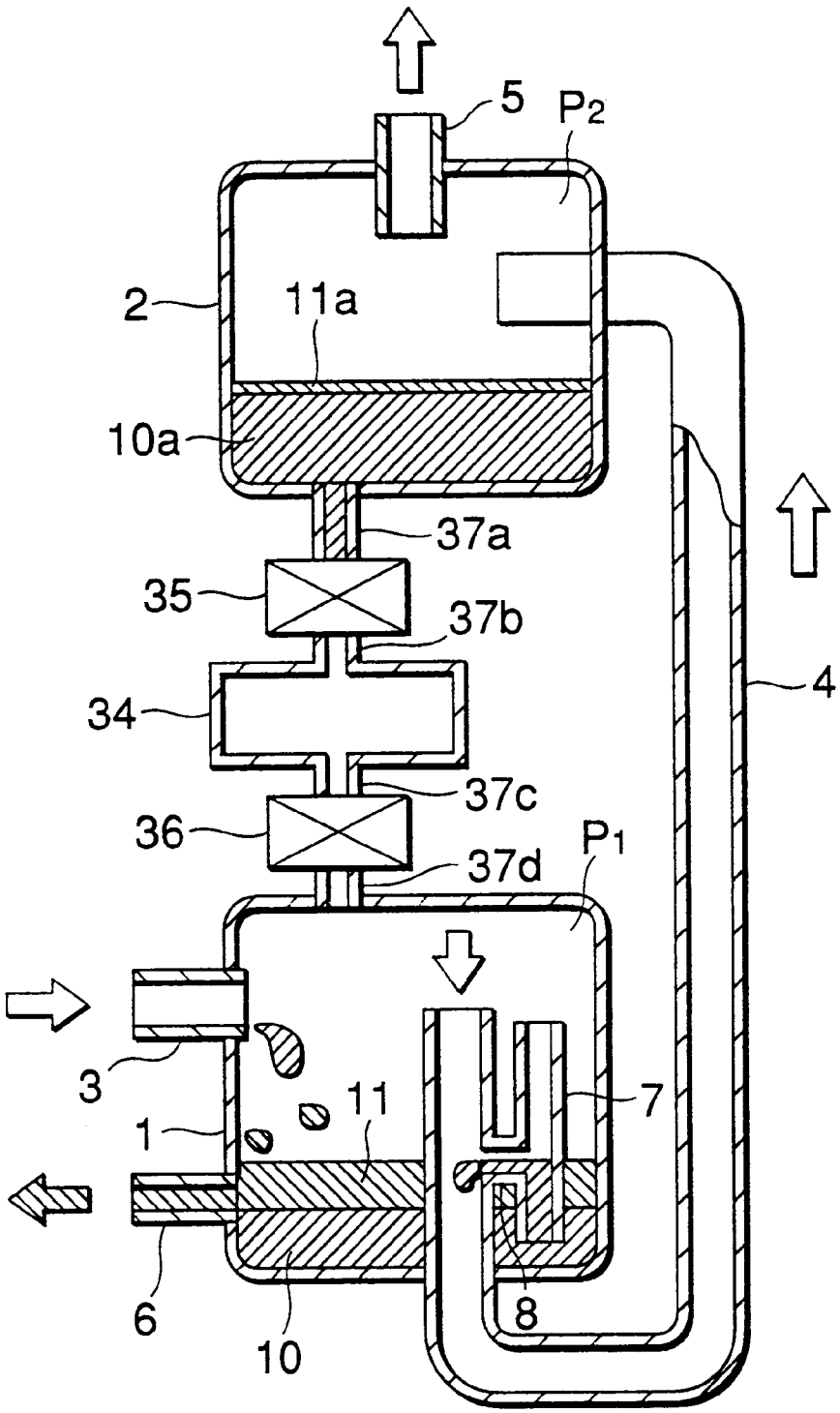
FIG. 15 is a vertical cross sectional view showing an accumulator according to a tenth embodiment of the present invention.

An accumulator according to a tenth embodiment of the present invention will now be described. Also this embodiment is structured on the assumption that refrigerating machine oil and the liquid refrigerant are opacified and introduced into the second container. Thus, refrigerating machine oil mixed and introduced into the second container is returned to the first container. The first container is disposed below the second container. Moreover, an intermediate container is disposed between the first container and the second container. The first container and the intermediate container are connected to each other by an opening/closing valve in such a manner that opening and closing are permitted. Furthermore, the second container and the intermediate container are connected to each other by an opening/closing valve in such a manner that opening and closing are permitted. FIG. 15 is a vertical cross sectional view showing the accumulator according to this embodiment. The foregoing drawing shows a state which is realized during the operation of the refrigerating and air-conditioning circuit.

Referring to the drawing, reference numeral 34 represents a third space which is an intermediate container formed in an intermediate portion between the first container 1 which is the first space and the second container 2 which is the second space. Reference numerals 35 and 36 represent first and second opening/closing valves. Reference numerals 37*a*, 37*b*, 37*c* and 37*d* represent communication pipes which establish the connection between the upper portion in the first container 1 and the bottom portion in the second container 2 through the intermediate container 34. The communication pipes 37*a* and 37*b* between the intermediate container 34 and the second container 2 are opened/closed by the first opening/closing valve 35. The communication pipes 37*c* and 37*d* between the intermediate container 34 and the first container 1 are opened/closed by the second opening/closing valve 36.

The operation will now be described. This embodiment has a structure that the first and second opening/closing valves 35 and 36 are alternately opened/closed during the operation of the refrigerating and air-conditioning circuit so that the liquid refrigerant 10*a* and refrigerating machine oil 11*a* accumulated in the second container 2 are returned to the inside portion of the first container 1.

Figure 16A:
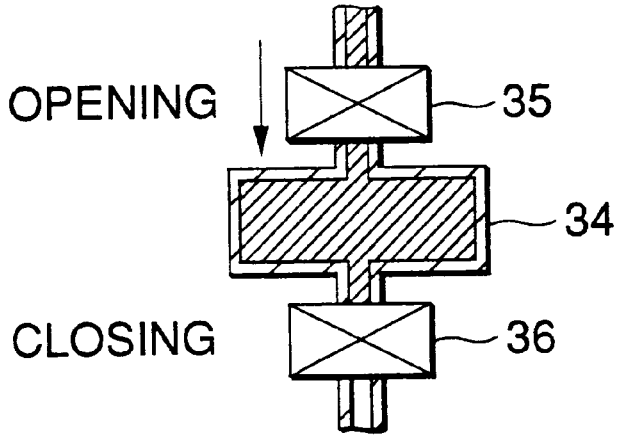
FIGS. 16(*a*) and 16(*b*) are digrams diagram showing the operation of a moving means according to the tenth embodiment of the present invention.
Figure 16B:
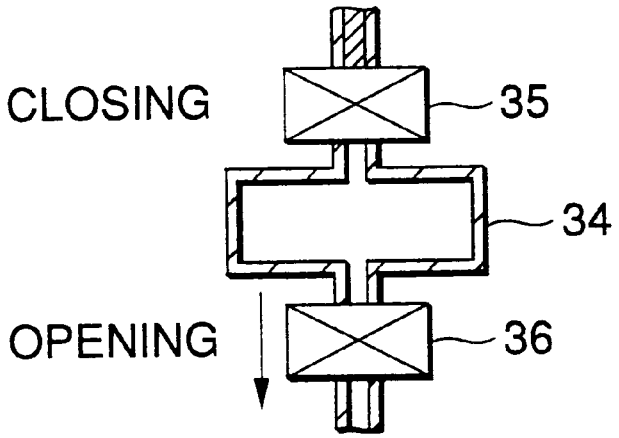

During the operation of the refrigerating and air-conditioning circuit, the relationship P1>P2 is satisfied when both of the first and second opening/closing valves 35 and 36 are opened. Therefore, liquid refrigerant 10*a* and refrigerating machine oil 11*b* accumulated in the second container 2 cannot be returned to the inside portion of the first container 1. When the first opening/closing valve 35 has been opened to close the second opening/closing valve 36 as shown in FIG. 16(*a*), the pressure in the intermediate container 34 and that in the second container 2 are made to be the same. As a result, the liquid refrigerant 10*a* and refrigerating machine oil 11*a* are moved from the second container 2 to the intermediate container 34 by dint of gravity.

Then, the first opening/closing valve 35 is closed and the second opening/closing valve 36 is opened as shown in FIG. 16(*b*) so that the pressure in the intermediate container 34 and that in the first container 1 are made to be the same. Thus, the liquid refrigerant 10*a* and refrigerating machine oil 11*a* accumulated in the cylinder 134 are moved from the intermediate container 34 to the first container 1 by dint of gravity.

The above-mentioned operation is repeated so that the liquid refrigerant 10*a* and refrigerating machine oil l1*a* accumulated in the second container 2 are returned to the inside portion of the first container 1 even during the operation of the refrigerating and air-conditioning circuit.

In some cases an appropriate means for controlling opening/closing may be employed to detect the liquid level in the second container 2 so as to control opening/closing of the first and second opening/closing valves 35 and 36 in accordance with the disposed liquid level. As an alternative to this, opening and closing of the first and second opening/closing valves 35 and 36 are controlled. Thus, opening/closing of the first and second opening/closing valves 35 and 36 are controlled.

Eleventh Embodiment

Figure 17:
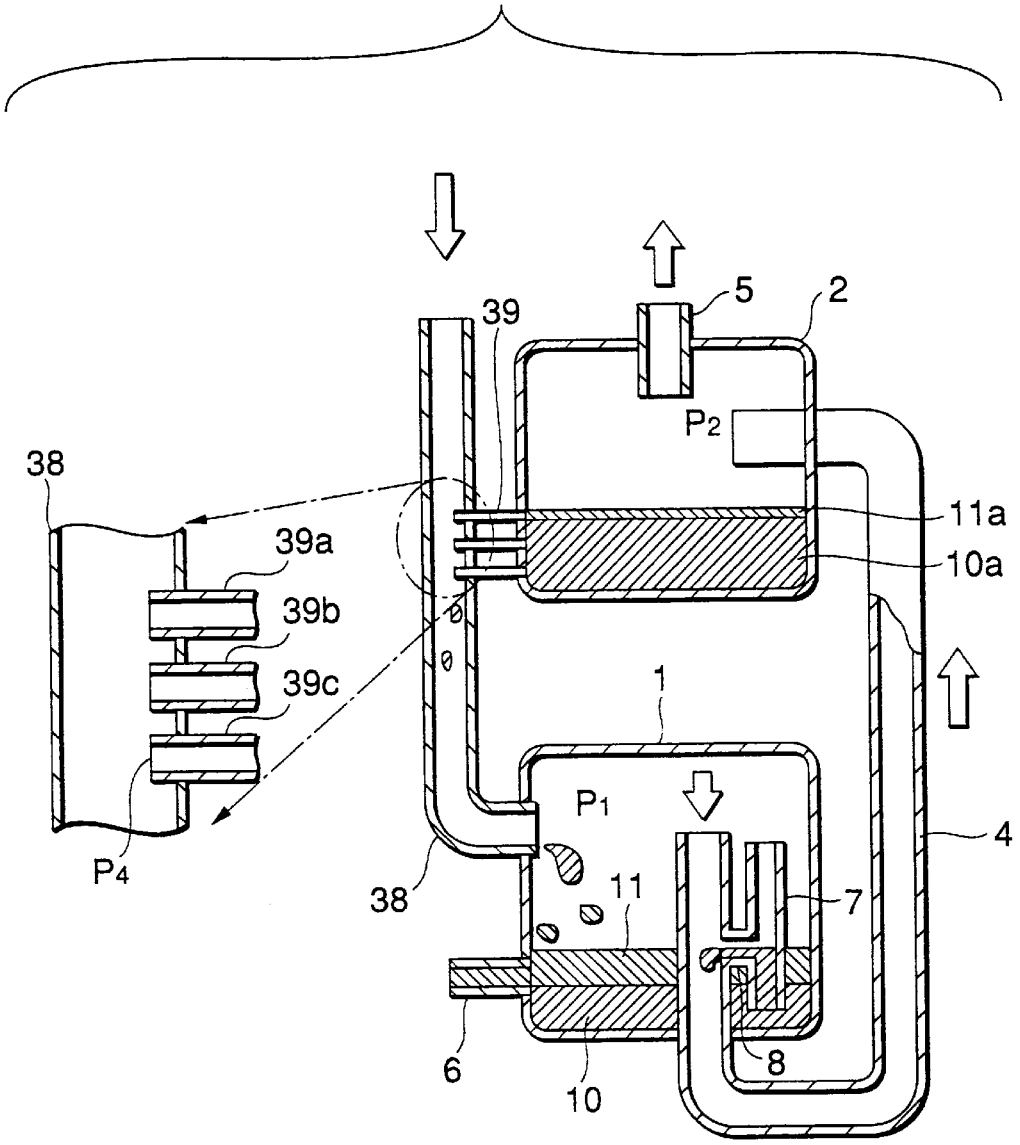
FIG. 17 is a vertical cross sectional view showing an accumulator according to an eleventh embodiment of the present invention.

The structure of an accumulator according to an eleventh embodiment of the present invention and adaptable to the refrigerating and air-conditioning circuit will now be described. In this embodiment, an assumption is made that refrigerating machine oil and the liquid refrigerant are opacified and introduced into the second container. Thus, refrigerating machine oil mixed in the second container is returned to the first container. The structure according to this embodiment is formed in such a manner that a plurality of communication pipes each projecting over the inner wall of the suction pipe connected to the first container are allowed to communicate with the second container. FIG. 17 is a vertical cross sectional view showing the accumulator according to this embodiment in such a manner that a portion is enlarged so as to be illustrated simultaneously.

Referring to the drawing, reference numeral 38 represents an introducing means for introducing the gas refrigerant, refrigerating machine oil and the liquid refrigerant which circulate in the refrigerating and air-conditioning circuit into the first container 1, the introducing means being, for example, a suction pipe. Reference numeral 39 represents a connection means for establishing the communication between the introducing means 38 and the liquid accumulation portion in the second container 2, the connection means being, for example, an oil recovery pipe. Plural (for example, three) oil recovery pipes are provided. A highest oil recovery pipe 39*a* among the plural oil recovery pipes 39 is disposed adjacent to the highest level of liquid which is accumulated in the second container 2. In order to recover refrigerating machine oil 11*a* into the first container 1 even if the liquid level exists at any position in the second container 2, plural, which is two in this embodiment, oil recovery pipes 39*b* and 39*c* are disposed away from each other in the vertical direction. An end of the oil recovery pipes 39 adjacent to the introducing means 38 is, as illustrated in an enlarged manner, allowed to inwards project over the inner surface of the introducing means 38 by about several millimeters. On the other hand, another end of the oil recovery pipes 39 is connected to the lower portion of the second container 2.

The operation will now be described. The pressure at the leading end of the oil recovery pipes 39 projecting toward the inner portion of the oil recovery pipes 39 is made to be lower than the static pressure in the oil recovery pipes 39 because of an influence of the flow of the fluid which is introduced from the refrigerating and air-conditioning circuit into the first container 1. As a result, the pressure at the leading end of the oil recovery pipes 39 is made to be P4. Assuming that the pressure in the first container 1 is P1 and that in the second container 2 is P2, the relationship P1>P2 is satisfied during the operation. Therefore, the relationship P4<P2 must be satisfied to cause refrigerating machine oil 11*a* and the liquid refrigerant 10*a* accumulated in the second container 2 to flow into the introducing means 38. Therefore, the oil recovery pipes 39 is caused to project into the introducing means 38 by an appropriate length. Thus, a so-called ejector effect is used so that a state P4<P2 is realized.

Since the relationship P4<P2 is realized in the refrigerating and air-conditioning circuit, refrigerating machine oil 11*a* introduced into the second container 2 is, together with the liquid refrigerant 10*a*, introduced into the introducing means 38, and then moved to the first container 1. Since the second container 2 is disposed above the first container 1, the liquid refrigerant 10*a* and refrigerating machine oil 11*a* in the second container 2 are allowed to pass through the oil recovery pipes 39 attributable to gravity when the operation of the refrigerating and air-conditioning circuit is interrupted. Then, the liquid refrigerant 10*a* and refrigerating machine oil 11*a* are moved to the first container 1.

As described above, the structures of the gas passage pipe 4, the air-duct pipe 7 and the communication pipe 8 mainly cause the liquid refrigerant 10 to selectively be moved to the second container 2. Even if unsatisfactory movement results in refrigerating machine oil being mixed with the liquid refrigerant and refrigerating machine oil is introduced into the second container 2, this embodiment enables refrigerating machine oil 11*a* introduced into the second container 2 to be recovered in the first container 1. Then, refrigerating machine oil 11*a* is recovered into the compressor through the oil return pipe 6. Therefore, a required quantity can be maintained without reduction in the flow rate of liquid refrigerant 10 to the compressor. As a result, reliability of the refrigerator and that of the refrigerating and air-conditioning circuit can be improved.

Twelfth Embodiment

Figure 18:
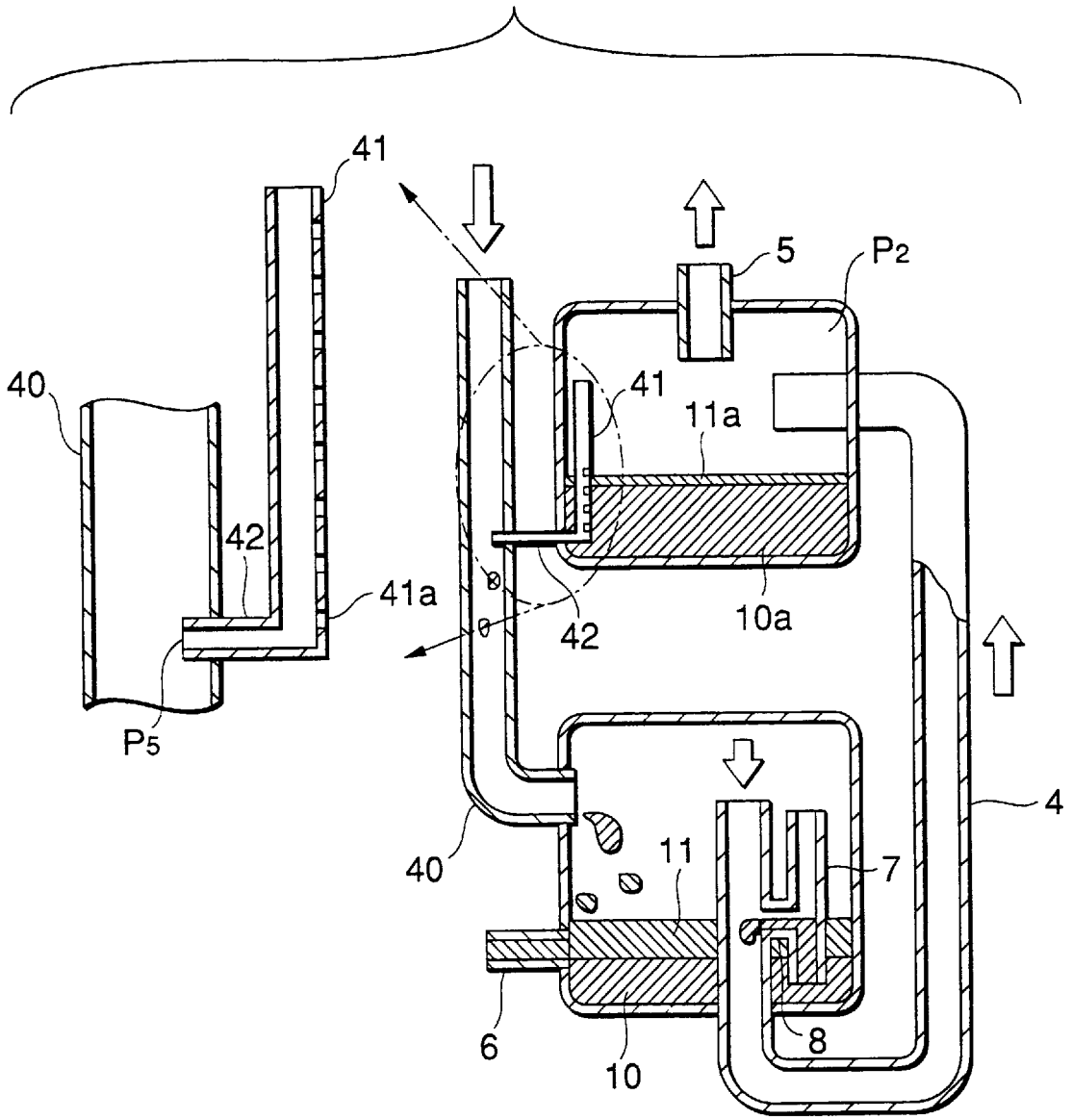
FIG. 18 is a vertical cross sectional view showing an accumulator according to a twelfth embodiment of the present invention.

The structure of an accumulator according to a twelfth embodiment of the present invention and adaptable to a refrigerating and air-conditioning circuit will now be described. In this embodiment, an assumption is made that refrigerating machine oil and the liquid refrigerant are opacified and introduced into the second container. Thus, refrigerating machine oil mixed and introduced into the second container is recovered into the first container. A pipe having a plurality of holes is disposed in the second container. Moreover, the lower end portion of the pipe is allowed to project over the inner wall of the suction pipe which is connected to the first container. FIG. 18 is a vertical cross sectional view showing the accumulator according to this embodiment in such a manner that a portion is enlarged.

Referring to the drawing, reference numeral 40 represents an introducing means which is, for example, a suction pipe. Reference numeral 41 represents a liquid recovery means which is, for example, an oil recover pipe in the form of a hollow cylinder arranged in such a manner as to be immersed in the liquid accumulation portion in the second container 2. A plurality of oil recovery holes 41*a* are vertically formed in the side surface of the oil recovery pipe 41. The highest position of the oil recovery hole 41*a* is made to be adjacent to a highest position of the level of the liquid which is accumulated in the second container 2. To recover refrigerating machine oil 11*a* into the first container 1 even if the liquid level exists at an arbitrary position, plural oil recovery holes 41*a* are formed in the vertical direction. Reference numeral 42 represents a connection means for establishing the communication between the lower end portion of the oil recovery pipe 41 and the suction pipe 40, the connection means being, for example, an oil recovery pipe. An end of the oil recovery pipe 42 adjacent to the suction pipe 40 is allowed to inwards project over the inner wall of the suction pipe 40 by, for example, about several millimeter.

The operation will now be described. Even if the level of refrigerating machine oil 11*a* accumulated in the second container 2 is at an arbitrary position, refrigerating machine oil 11*a* is introduced into the oil recovery pipe 41 through the oil recovery hole 41*a* formed at the oil level. On the other hand, refrigerating machine oil 11*a* is introduced into the oil recovery pipe 41 through the oil recovery hole 41*a* facing the liquid refrigerant 10*a*. The ejector effect is exerted on the end of the oil recovery pipe 42 adjacent to the suction pipe 40 because of the gas refrigerant 9 which flows in the suction pipe 40. Thus, the pressure is made to be lower than the surrounding static pressure. Assuming that the pressure at the leading end of the oil recovery pipe 42 in the suction pipe 40 is P5, a state satisfying P5<P2 is realized. As a result, refrigerating machine oil 11*a* and the liquid refrigerant 10*a* introduced into the oil recovery pipe 41 are sucked into the suction pipe 40, and then recovered into the first container 1 together with the gas refrigerant. As described above, refrigerating machine oil 11*a* introduced into the second container 2 during the operation can be recovered into the first container 1.

During the interruption of the refrigerating and air-conditioning circuit, the liquid refrigerant 10*a* and refrigerating machine oil 11*a* in the second container 2 are, by gravity, allowed to pass through the oil recovery pipe 41 and moved to the first container 1.

As a result of the above-mentioned operation performed by the structure according to this embodiment, refrigerating machine oil 11*a* introduced into the second container 2 can be recovered into the first container 1 even if an insufficient operation for selectively moving the liquid refrigerant 10 to the second container 2 causes refrigerating machine oil 11 to be mixed with the liquid refrigerant 10*a* and thus refrigerating machine oil 11*a* is introduced into the second container 2. Recovered liquid refrigerant 10 is allowed to pass through the oil return pipe 6 so as to be recovered into the compressor. Therefore, a required quantity can be maintained without reduction in the flow rate of refrigerating machine oil to the compressor. As a result, the reliability of the compressor and that of the refrigerating and air-conditioning circuit can be improved.

Thirteenth Embodiment

Figure 19:
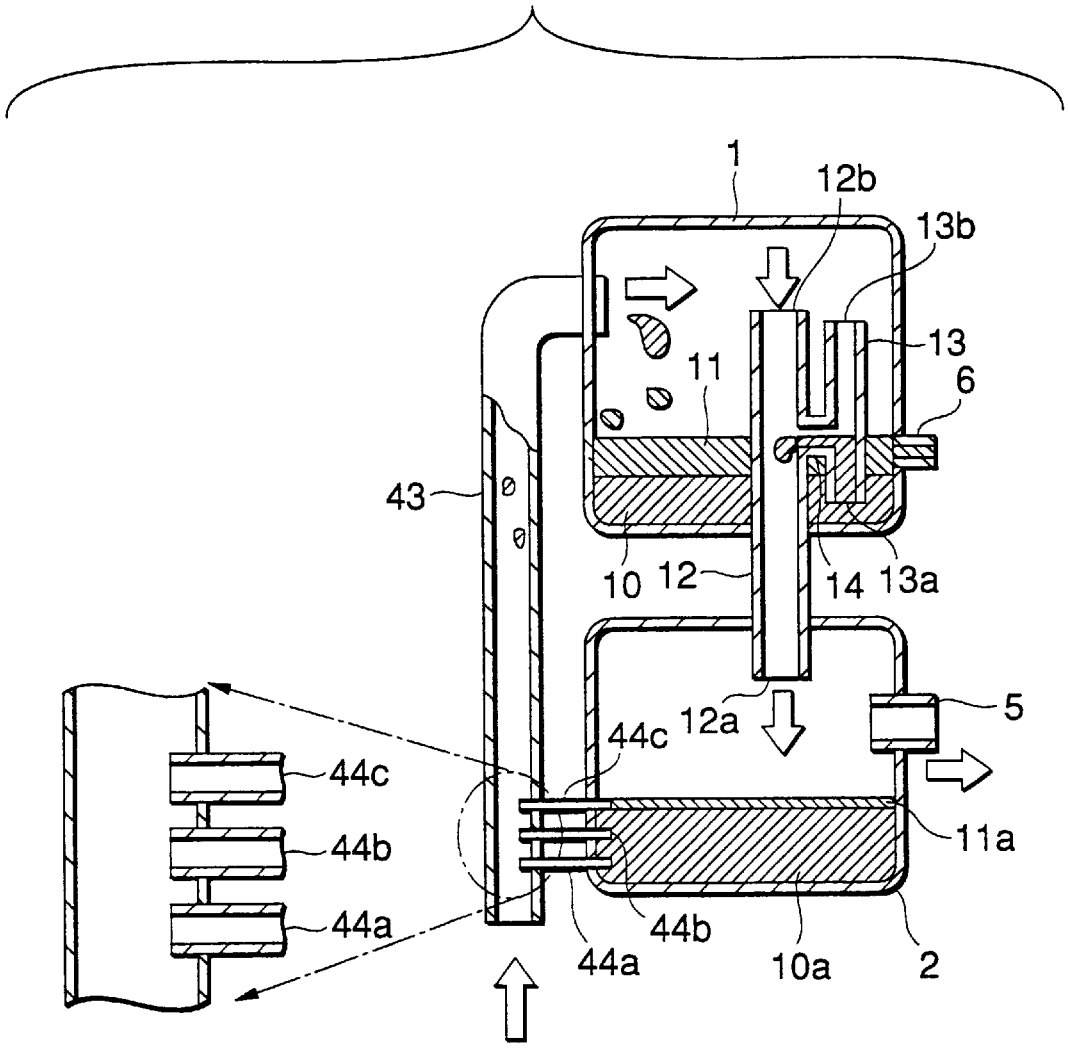
FIG. 19 is a vertical cross sectional view showing an accumulator according to a thirteenth embodiment of the present invention.

The structure of an accumulator according to a thirteenth embodiment and adaptable to the refrigerating and air-conditioning circuit will now be described. Also this embodiment is structured on the assumption that refrigerating machine oil and liquid refrigerant are opacified and introduced into the second container. Thus, refrigerating machine oil mixed and introduced into the second container is returned to the first container. A plurality of communication pipes arranged to project over the inner wall of the suction pipe connected to the first container are allowed to communicate with the second container. FIG. 19 is a vertical cross sectional view showing the accumulator according to this embodiment in such a manner that a portion is enlarged. This embodiment is a modification of the structure of the eleventh embodiment. That is, the structure according to the eleventh embodiment is applied to the structure according to the second embodiment. The first container 1 is disposed above the second container 2.

Referring to the drawing, reference numeral 43 represents a suction pipe, and reference numerals 44*a*, 44*b* and 44*c* represent oil recovery pipes. The highest position (the position of the oil recovery pipe 44*c*) is made to be adjacent to the highest level of liquid which is accumulated in the second container 2. To enable refrigerating machine oil 11*a* to be recovered into the second container 2 even if the liquid level is at any position, plural (which is two in this embodiment) oil recovery pipes 44*b* and 44*c* are disposed in the vertical direction. Ends of the oil recovery pipes 44*a*, 44*b* and 44*c* project over the inner surface of the suction pipe 43 as illustrated in an enlarged manner, while other ends are connected to the lower portion of the second container 2. Since the operation of this embodiment is the same as that according to the eleventh embodiment, the operation is omitted from description.

Also the above-mentioned structure is able to recover refrigerating machine oil 11*a* introduced into the second container 2 into the first container 1 even if the incomplete operation for selectively moving the liquid refrigerant 10 to the second container 2 causes refrigerating machine oil 11 to be mixed with the liquid refrigerant 10*a* and causes refrigerating machine oil 11*a* to be introduced into the second container 2. Moreover, recovered liquid refrigerant 10 is recovered into the compressor through the oil return pipe 6. Therefore, a reliable refrigerating and air-conditioning circuit can be obtained without reduction in the low rate of refrigerating machine oil to the compressor.

An object of each of the fourteenth and fifteenth embodiments is to prevent disorder of the liquid refrigerant and refrigerating machine oil in the first container 1 and the second container 2 by the flow of the gas refrigerant 9 in the container so as to efficiently perform the gas-liquid separation and separation of refrigerating machine oil and the liquid refrigerant from each other.

Fourteenth Embodiment

Figure 20:
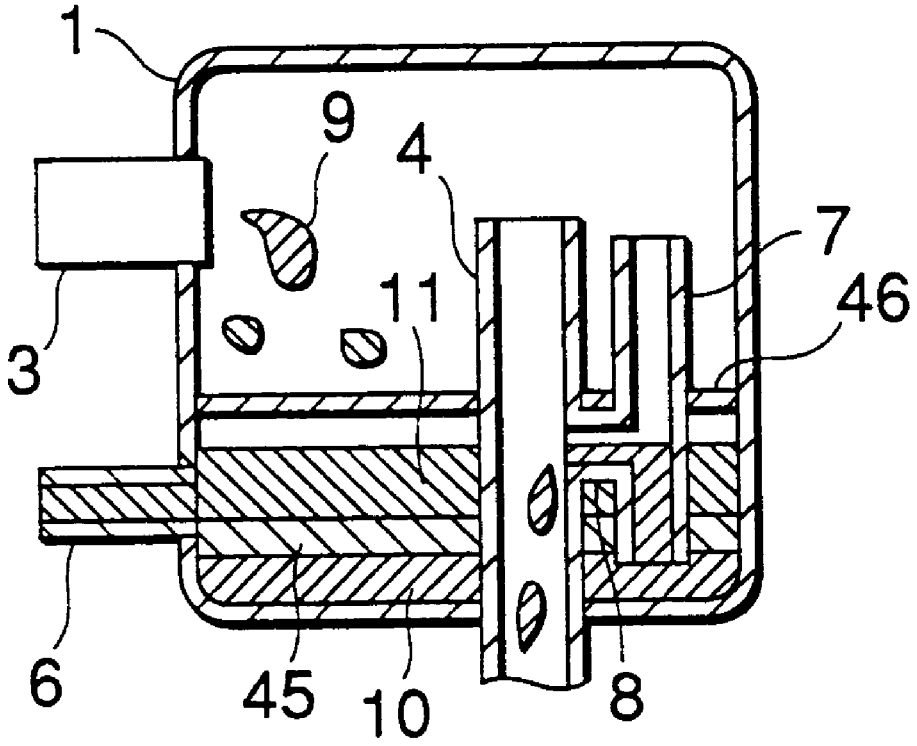
FIG. 20 is a vertical cross sectional view showing an accumulator according to a fourteenth embodiment of the present invention.

The structure of an accumulator according to a fourteenth embodiment of the present invention and adaptable to the refrigerating and air-conditioning circuit will now be described. FIG. 20 is a vertical cross sectional view showing the accumulator according to this embodiment. The structure is arranged in order to stabilize the liquid level (the oil level) in the first container 1 and to stabilize the boundary surface between refrigerating machine oil 11 and the liquid refrigerant 10.

Referring to the drawing, reference numeral 45 represents a liquid-level stabilizing plate disposed adjacent to the boundary surface between refrigerating machine oil 11 and the liquid refrigerant 10 in a state in which the liquid refrigerant 10 is accumulated in the first container 1. Reference numeral 46 represents a rectifying plate secured above the oil level (the liquid level). The liquid-level stabilizing plate 45 and the rectifying plate 46 form a liquid-level stabilizing means for stabilizing the liquid level in the first container 1. For example, a wire netting (a mesh), foam metal or sintered metal having satisfactory liquid and gas permeability must be selected.

The gas refrigerant 9, the liquid refrigerant 10 and refrigerating machine oil 11 are introduced into the first container 1 through the suction pipe 3. When the liquid refrigerant 10 and refrigerating machine oil 11 are allowed to pass through the rectifying plate 46, energy of the liquid refrigerant 10 and refrigerating machine oil 11 is reduced. Thus, the liquid refrigerant 10 and refrigerating machine oil 11 calmly drop to the liquid level accumulated in the first container 1. On the other hand, the direction of the flow of the gas refrigerant 9 is changed by the rectifying plate 46. Therefore, the gas refrigerant 9 cannot easily flow to the lower portion in the first container 1. Thus, the gas refrigerant 9 easily flows to the gas passage pipe 4 and the air-duct pipe 7.

To improve the performance of the accumulator, the gas-liquid separation efficiency must be improved to stably maintain liquid refrigerant 10 in the first container 1 and to efficiently separate the liquid refrigerant 10 and refrigerating machine oil 11 into two layers. To improve the gas-liquid separation efficiency, a state in which the liquid level (the oil level) in the first container 1 is not disordered must be realized. To efficiently separate the liquid refrigerant 10 and refrigerating machine oil 11 into two layers by dint of the difference in the specific gravity, the portion adjacent to the boundary surface between refrigerating machine oil 11 and the liquid refrigerant 10 must calmly kept as much as possible. Therefore, direct impingement of the gas refrigerant with the oil level is prevented and penetration of the gas refrigerant is permitted by employing the rectifying plate 46 for changing the direction of the flow and the liquid-level stabilizing plate 45 having the wire netting structure or the foam metal structure.

Dropped liquid is quickly separated into refrigerating machine oil 11 having low specific gravity and the liquid refrigerant 10 having a high specific gravity because of the existence of the liquid-level stabilizing plate 45. Thus, the boundary surface can be stabilized. Even if the liquid level has disturbance, the liquid-level stabilizing plate 45 is able to somewhat absorb the disturbance. As a result, the boundary surface and the liquid level can be stabilized.

This embodiment has a structure that the first container 1 has a cylindrical shape and the suction pipe 3 introduces the fluid along the inner surface of the cylinder. Therefore, the fluid is dropped while the energy of the fluid is reduced during the flow along the inner surface of the cylinder. As a result, the rectifying plate 46 and the liquid-level stabilizing plate 45 effectively form a smooth flow.

Although this embodiment has the structure that both of the liquid-level stabilizing plate 45 and the rectifying plate 46 are provided for the first container 1, the effect of improving the gas-liquid separation efficiency can be obtained from a structure in which either of the elements is provided.

Fifteenth Embodiment

Figure 21:
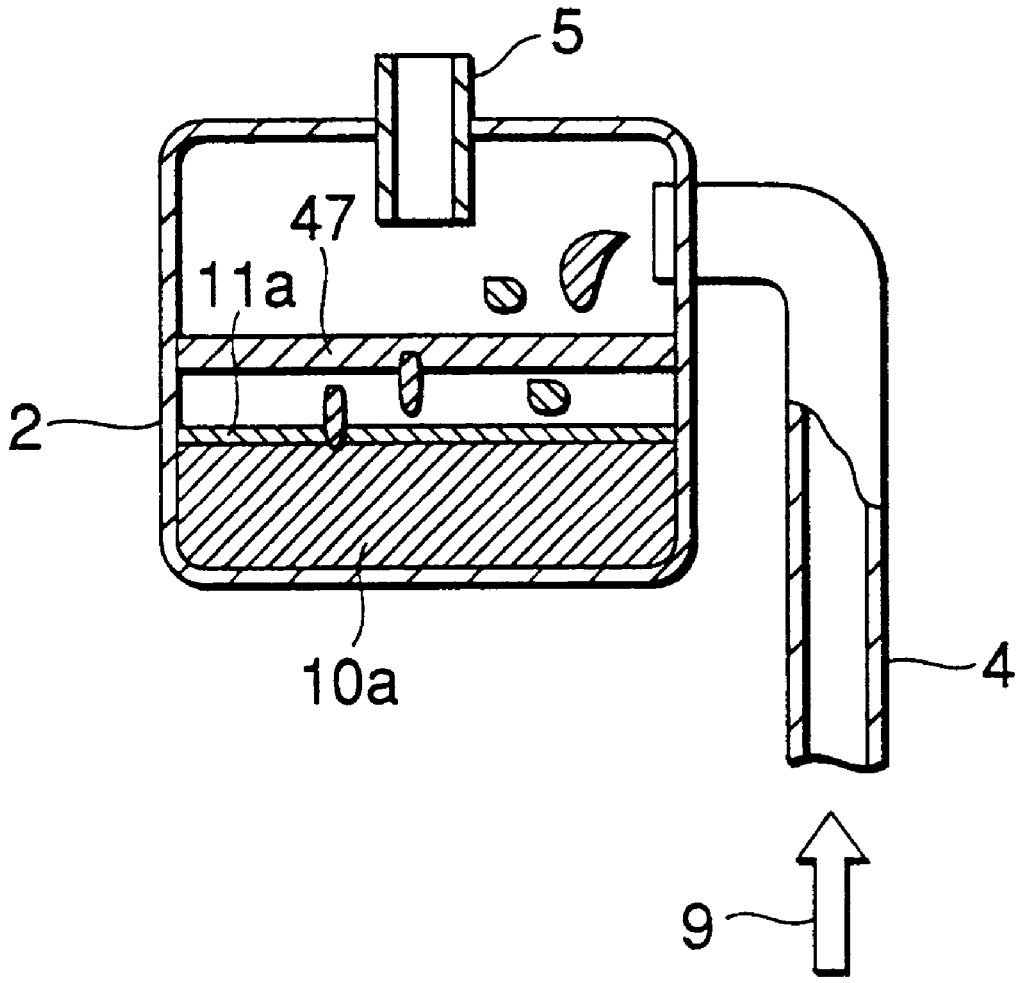
FIG. 21 is a vertical cross sectional view showing an accumulator according to a fifteenth embodiment of the present invention.

The structure of an accumulator according to a fifteenth embodiment of the present invention and adaptable to the refrigerating and air-conditioning circuit will now be described. FIG. 21 is a vertical cross sectional view showing the accumulator according to this embodiment in such a manner that a structure for stabilizing the oil level (the liquid level) in the second container 2 is illustrated.

Referring to the drawing, reference numeral 47 represents a rectifying plate disposed above the oil level (the liquid level) in the second container 2 and lower than the position of the opening of the gas passage pipe 4. Thus, direct collision of the gas refrigerant 9 introduced through the gas passage pipe 4 with the surface of refrigerating machine oil 11*a* and the liquid refrigerant 10*a* can be prevented. The rectifying plate 47 is made of a material having satisfactory liquid and gas permeability, for example, a wire netting (mesh) structure, foam metal or sintered metal.

The gas refrigerant 9, the liquid refrigerant 10*a* and refrigerating machine oil 11*a* are introduced into the second container 2 through the gas passage pipe 4. At this time, the liquid refrigerant 10*a* and refrigerating machine oil 11 are accumulated in the second container 2, while the gas refrigerant is discharged from the discharge pipe 5 to the refrigerating and air-conditioning circuit. When the rectifying plate 47 having the structure illustrated above is provided in the second container 2, direct collision of the gas refrigerant with the surface of the accumulated liquid can be prevented. Thus, the gas refrigerant smoothly flows to the discharge pipe 5.

The first to thirteenth embodiments have the structure formed by two containers which are the first container 1 and the second container 2 to attain an effect of separating refrigerating machine oil and the liquid refrigerant from each other so as to efficiently return refrigerating machine oil to the compressor. Sixteenth to twenty-third embodiments have a structure that a partition plate is provided in one container to form two spaces (first and second spaces). In this case, a similar effect can be obtained because of a similar operation to that of the first and second containers according to the first to thirteenth embodiments. Moreover, the structure can be simplified and the size of the apparatus can be reduced.

Sixteenth Embodiment

Figure 22A:
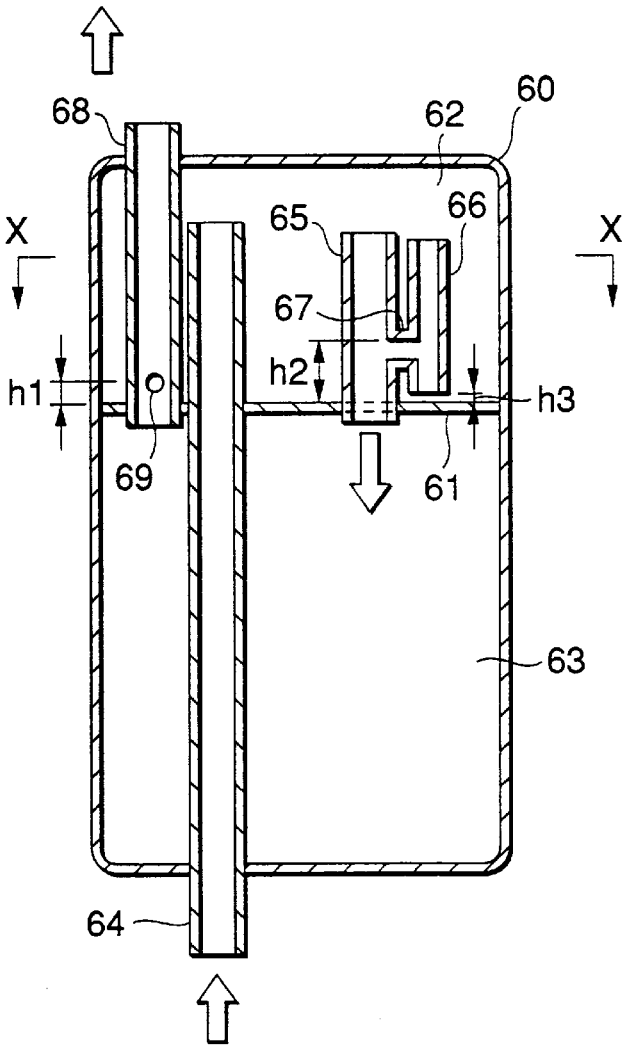
FIGS. 22(*a*) and 22(*b*) are respectively a vertical cross sectional view and a transverse cross sectional view showing an accumulator according to a sixteenth embodiment of the present invention.
Figure 22B:
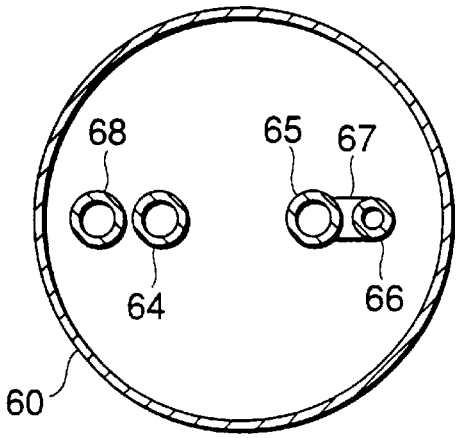

The sixteenth embodiment has a structure that the accumulator having the structure according to the second embodiment is formed by one container. The accumulator according to this embodiment will now be described. FIG. 22(*a*) is a vertical cross sectional view showing the accumulator according to this embodiment. FIG. 22(*b*) is a cross sectional view taken along line X—X shown in FIG. 22(*a*).

Referring to the drawings, reference numeral 60 represents an accumulator container and 61 represents a partition plate for vertically partitioning the inside portion of the accumulator container 60. Reference numeral 62 represents a first space, 63 represents a second space, 64 represents a suction pipe, 65 represents a gas communication pipe, 66 represents a air-duct pipe, 67 represents a communication pipe, 68 represents a discharge pipe and 69 represents an oil return pipe corresponding to the oil return pipe.

In this embodiment, the first container 1 according to the second embodiment corresponds to the first space 62 and the second container 2 corresponds to the second space 63. The same or corresponding elements are given the same names and have similar functions. Although the structure is omitted in the second embodiment, the discharge pipe 5 is usually connected from the second container 2 to the compressor and also the oil return pipe 6 is connected to the compressor from the second container 2. In this embodiment, the oil return pipe 69 and the discharge pipe 68 are allowed to communicate with each other in the accumulator container 60. Moreover, the discharge pipe 68 for discharging the gas refrigerant and refrigerating machine oil is connected to the compressor.

The height h1 from the bottom surface in the first space 62 to the oil return pipe 69, the height h2 from the bottom surface in the first space 62 to the communication pipe 67 and the height h3 from the bottom surface in the first space 62 to the lower end of the air-duct pipe 66 satisfy the relationship $h3<h1<h2$. The upper end of the air-duct pipe 66 is opened at substantially the same position of the upper end of the gas communication pipe 65.

When the liquid level (the oil level) in the first space 62 is in a range from h3 to h2, the gas refrigerant is introduced into the gas communication pipe 65 from the air-duct pipe 66 through the communication pipe 67. At this time, the liquid refrigerant is introduced into the lower end portion of the air-duct pipe 66 by a quantity corresponding to the liquid level. When the liquid level (the oil level) is raised to be not lower than h2, the liquid refrigerant is introduced from the air-duct pipe 66 into the gas communication pipe 65 through the communication pipe 67. The liquid refrigerant is moved to the second space 63 formed in the lower position because of gravity drop and flow of the internal gas so as to be accumulated in the bottom portion in the second space 63.

Thus, the liquid level in the first space 62 is lowered. As described above, the substantially constant liquid level (the oil level) h2 is maintained in the first space 62. An excessive portion of the liquid refrigerant is accumulated in the second space 63. Thus, in a case where refrigerating machine oil having poor solubility with the liquid refrigerant is employed in the refrigerating and air-conditioning circuit, the flow rate of refrigerating machine oil which flows from the oil return pipe 69 into the compressor through the discharge pipe 68 can be made to be constant, as shown in FIG. 2. As a result, a required quantity can be maintained without reduction in the flow rate of refrigerating machine oil to the compressor. Thus, the reliability of the compressor and that of the refrigerating and air-conditioning circuit can be improved.

Since the suction pipe 64 and the discharge pipe 64 are connected to the accumulator container 60, an accumulator having a simple appearance can be obtained.

Seventeenth Embodiment

A seventeenth embodiment is a modification of the sixteenth embodiment in such a manner that the first space and the second space are formed horizontally. An accumulator according to this embodiment will now be described.

Figure 23A:
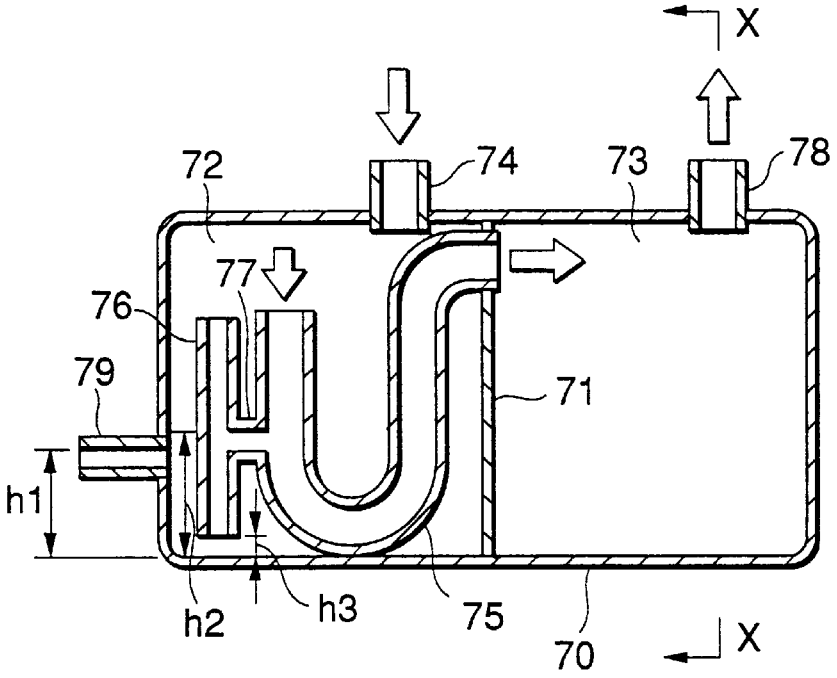
FIGS. 23(*a*) and 23(*b*) are respectively a vertical cross sectional view and a transverse cross sectional view showing an accumulator according to a seventeenth embodiment of the present invention.
Figure 23B:
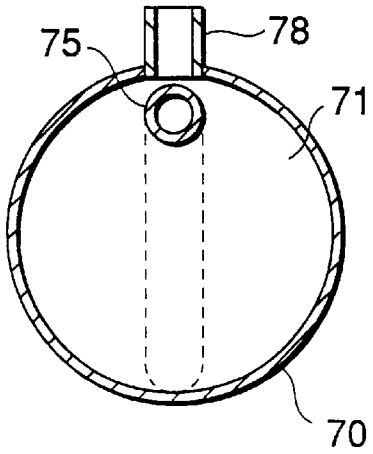

FIG. 23(*a*) is a vertical cross sectional view showing an accumulator according to this embodiment. FIG. 23(*b*) is a cross sectional view taken along line X—X shown in FIG. 23(*a*). Referring to the drawing, reference numeral 70 represents an accumulator container and 71 represents a partition plate for partitioning the inside portion of the accumulator container 70. Reference numeral 72 represents a first space, 73 represents a second space, 74 represents a suction pipe, 75 represents a gas communication pipe, 76 represents an air-duct pipe, 77 represents a communication pipe, 78 represents a discharge pipe and 79 represents an oil return pipe.

The height h1 from the bottom surface in the first space 72 to the oil return pipe 79, the height h2 from the bottom surface in the first space 72 to the communication pipe 77 and the height h3 from the bottom surface in the first space 72 to the lower end of the air-duct pipe 76 satisfy the relationship h3<h1<h2. The upper end of the air-duct pipe 76 is opened at substantially the same position as the upper end position of the gas communication pipe 75.

When the liquid level (the oil level) in the first space 72 is in a range from h3 to h2, the gas refrigerant is introduced from the air-duct pipe 76 into the gas communication pipe 75 through the communication pipe 77. At this time, the liquid refrigerant has been introduced into the lower end portion of the air-duct pipe 76 by a quantity corresponding to the liquid level. When the liquid level (the oil level) is made to be not smaller than h2, the liquid refrigerant is introduced from the air-duct pipe 78 into the gas communication pipe 75 through the communication pipe 77. The liquid refrigerant is moved to the second space 73 as the internal gas is moved so that the liquid refrigerant is accumulated in the bottom portion in the second space 73. As a result, the liquid level in the first space 72 is lowered. As a result, the substantially constant liquid level (the oil level) of h2 can be maintained in the first space 72. Thus, an excessive portion of the liquid refrigerant is accumulated in the second space 73. When refrigerating machine oil having poor solubility with the liquid refrigerant is used in the refrigerating and air-conditioning circuit as shown in FIG. 2, the flow rate of refrigerating machine oil which flows from the oil return pipe 79 to the compressor can be made to be constant. Thus, a required quantity can be maintained without reduction in the flow rate of refrigerating machine oil to the compressor. As a result, the reliability of the compressor and that of the refrigerating and air-conditioning circuit can be improved.

Since the suction pipe 74, the discharge pipe 78 and the oil return pipe 79 are connected to the accumulator container 70, an accumulator having a simple appearance can be obtained.

Eighteenth Embodiment

An eighteenth embodiment has a structure that the structure according to the sixth embodiment is realized by one container and the first space is formed at the side of the second space. The accumulator according to this embodiment will now be described.

Figure 24A:
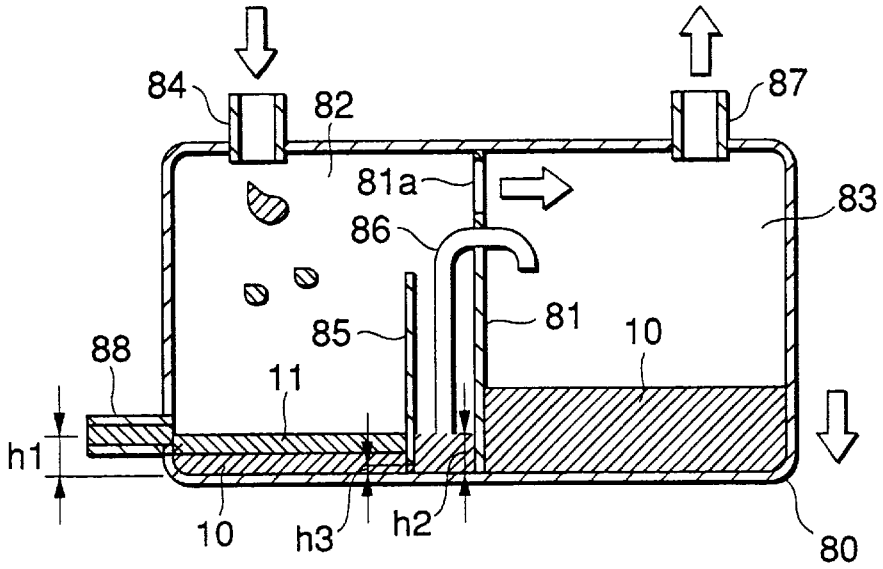
FIG. 24(*a*) is a cross sectional view showing an accumulator according to an eighteenth embodiment of the present invention and FIG. 24(*b*) is an enlargement of a region of FIG. 24(*a*).
Figure 24B:
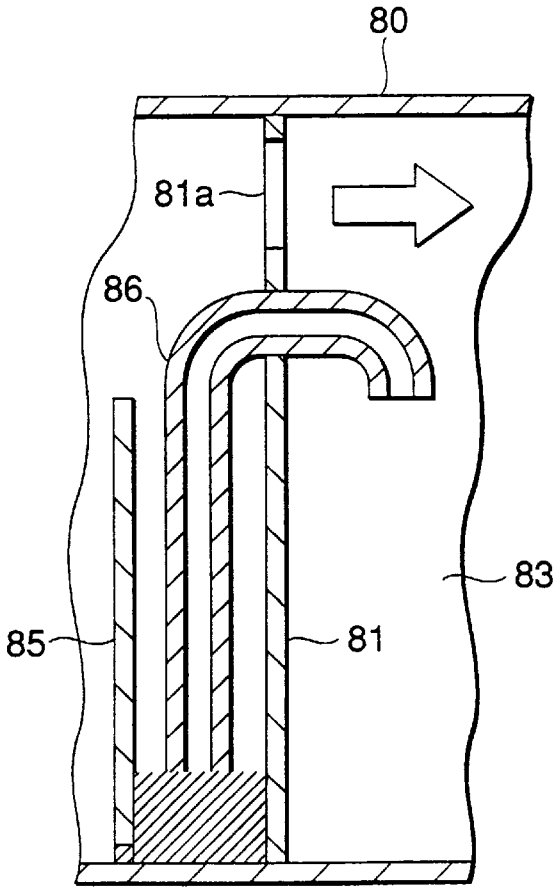

FIG. 24 is a vertical cross sectional view showing the accumulator according to this embodiment. FIG. 24(*a*) shows the overall body of the accumulator, and FIG. 24(*b*) is an partially enlarged view. Referring to the drawings, reference numeral 80 represents an accumulator container and 81 represents a partition plate for partitioning the inside portion of the accumulator container 80. Reference numeral 81*a* represents a gas communication hole formed in the partition plate, 82 represents a first space, 83 represents a second space, 84 represents a suction pipe, 85 represents a separation plate, 86 represents a refrigerant suction pipe, 87 represents a discharge pipe and 88 represents an oil return pipe. Moreover, a gap is formed between each of the lower ends of the separation plate 85 and the refrigerant suction pipe 86 and the bottom surface in the first space 82. The first container 1 according to the sixth embodiment corresponds to the first space 82, the second container 2 corresponds to the second space 83, the gas communication pipe 22 corresponds to the gas communication hole 81*a*, the cylinder 23 corresponds to the separation plate 85 and the refrigerant suction pipe 24 corresponds to the refrigerant suction pipe 86.

The height hi from the bottom surface in the first space 82 to the oil return pipe 88, the height h2 from the bottom surface in the first space 82 to the refrigerant suction pipe 86 and the height h3 from the bottom surface in the first space 82 to the lower end of the separation plate 85 satisfy the relationship h3<h1<h2.

During the operation of the refrigerating and air-conditioning circuit, the gas refrigerant flows from the first space 82 to the second space 83 through the gas communication hole 81*a*. Therefore, a pressure loss takes place. That is, the pressure in the first space 82 is higher than that in the second space 83. When the liquid level (the oil level) in the first space 82 is in a range from h3 to h2, the gas refrigerant is introduced into the refrigerant suction pipe 86. Thus, the pressure difference causes the gas refrigerant to be pushed upwards in the refrigerant suction pipe 86. At this time, the liquid refrigerant has been introduced from the lower end of the separation plate 85 to the portion in which the refrigerant suction pipe 86 is disposed by a quantity corresponding to the liquid level. When the liquid level (the oil level) has been made to be not lower than h2, the liquid refrigerant is introduced into the refrigerant suction pipe 86 so as to be pushed upwards in the refrigerant suction pipe 86 because of the difference in the pressure. Therefore, the liquid refrigerant 10 in the first space 82 is moved to the second space 83, and accumulated in the bottom portion in the second space 83. As a result, the liquid level in the first space 82 is lowered.

As described above, the substantially constant liquid level (the oil level) of h2 can be maintained in the first space 82. Thus, an excessive portion of the liquid refrigerant is accumulated in the second space 83. When refrigerating machine oil having poor solubility with the liquid refrigerant is used in the refrigerating and air-conditioning circuit as described with reference to FIG. 2, the flow rate of refrigerating machine oil which flows from the oil return pipe 88 to the compressor can be made to be constant. As a result, a required quantity can be maintained without reduction in the flow rate of refrigerating machine oil to the compressor. Thus, the reliability of the compressor and that of the refrigerating and air-conditioning circuit can be improved.

Since only the suction pipe 84, the discharge pipe 87 and the oil return pipe 88 are connected to the accumulator container 80, an accumulator having a simple appearance can be obtained.

Nineteenth Embodiment

A nineteenth embodiment has a structure that the structure according to the eighth embodiment is realized by one container. An accumulator according to this embodiment will now be described.

Figure 25A:
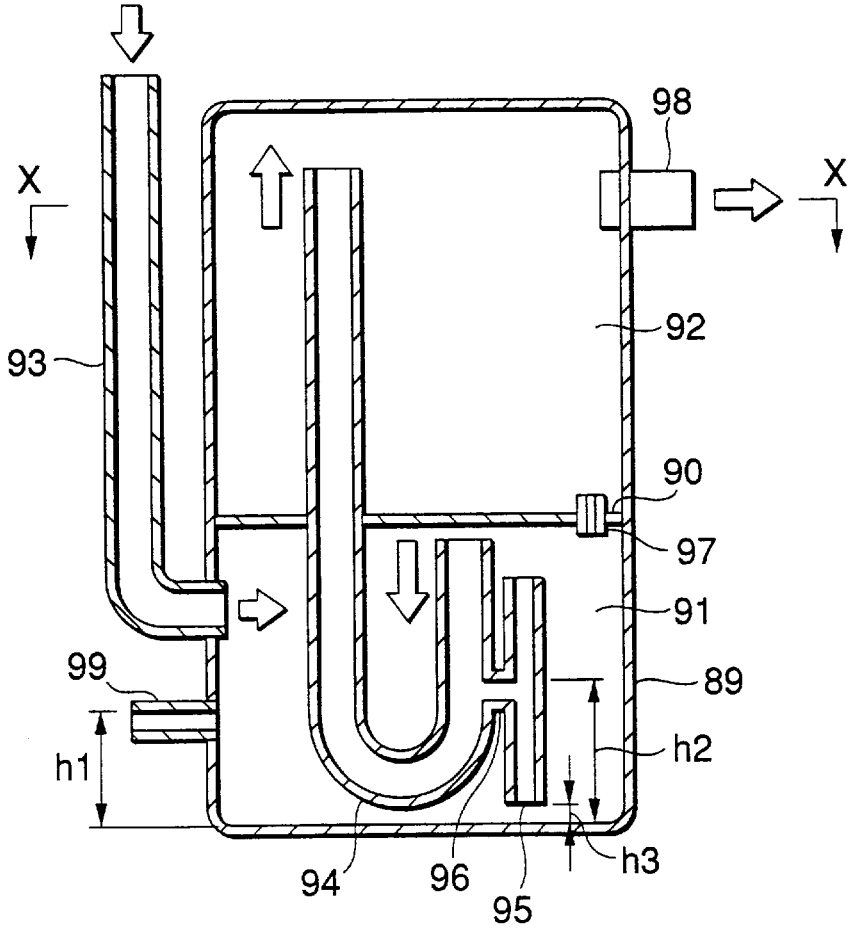
FIGS. 25(*a*) and 25(*b*) are respectively a vertical cross sectional view and a transverse cross sectional view showing an accumulator according to a nineteenth embodiment of the present invention.
Figure 25B:
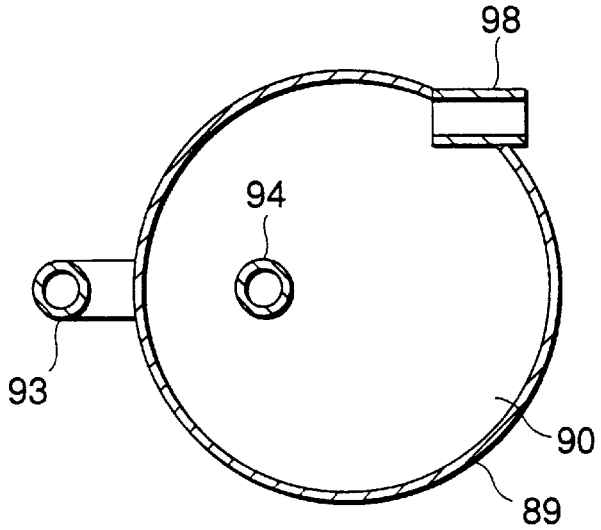

FIG. 25(*a*) is a vertical cross sectional view showing the accumulator according to this embodiment. FIG. 25(*b*) is a cross sectional view taken along line X—X shown in FIG. 25(*a*). Referring to the drawings, reference numeral 89 represents an accumulator container and 90 represents a partition plate for vertically partitioning the inside portion of the accumulator container 89. Reference numeral 91 represents a first space, 92 represents a second space, 93 represents a suction pipe, 94 represents a gas communication pipe, 95 represents an air-duct pipe, 96 represents a communication pipe, 97 represents a communication pipe, 98 represents a discharge pipe and 99 represents an oil return pipe. The first container 1 according to the eighth embodiment corresponds to the first space 91, while the second container 2 corresponds to the second space 92.

The height h1 from the bottom surface in the first space 91 to the oil return pipe 99, the height h2 from the bottom surface in the first space 91 to the communication pipe 96 and the height h3 from the bottom surface in the first space 91 to the lower end of the air-duct pipe 95 satisfy the relationship h3<h1<h2. The upper end of the air-duct pipe 95 is opened at the same position as that of the upper end of the gas communication pipe 94.

When the liquid level (the oil level) in the first space 91 is in a range from h3 to h2, the gas refrigerant is introduced from the air-duct pipe 95 to the gas communication pipe 94 through the communication pipe 96. At this time, the liquid refrigerant has been introduced from the lower end of the air-duct pipe 95 by a quantity corresponding to the liquid level. When the liquid level (the oil level) has been made to be not smaller than h2, the liquid refrigerant is introduced from the air-duct pipe 95 into the gas communication pipe 94 through the communication pipe 96. Then, the liquid refrigerant is moved to the second space 92 as the internal gas is moved, and then accumulated in the bottom portion in the second space 92. Thus, the liquid level in the first space 91 is lowered. During the operation of the refrigerating and air-conditioning circuit, the introduced gas refrigerant from the first space 91 to the second space 92 through the gas communication pipe 94 results in a pressure loss. That is, the pressure in the first space 91 is higher than the pressure in the second space 92. Therefore, the liquid refrigerant moved to the second space 92 is not returned to the first space 91 from the communication pipe 97. However, the difference in the pressure between the inside portion of the first space 91 and the inside portion of the second space 92 is eliminated. Thus, the liquid refrigerant accumulated in the second space 92 is returned from the communication pipe 97 to the first space 91 by dint of gravity.

As described above, the substantially constant liquid level (the oil level) of h2 can be maintained in the first space 91. Moreover, an excessive portion of the liquid refrigerant is accumulated in the first space 91. When refrigerating machine oil having poor solubility with the liquid refrigerant is employed in the refrigerating and air-conditioning circuit as shown in FIG. 2, the flow rate of refrigerating machine oil which flows from the oil return pipe 99 to the compressor can be made to be constant. Thus, a required quantity can be maintained without reduction in the flow rate of refrigerating machine oil to the compressor. Thus, the reliability of the compressor and that of the refrigerating and air-conditioning circuit can be improved.

Since only the suction pipe 93, the discharge pipe 98 and the oil return pipe 99 are connected to the accumulator container 89, an accumulator having a simple appearance can be obtained.

Twentieth Embodiment

Figure 26A:
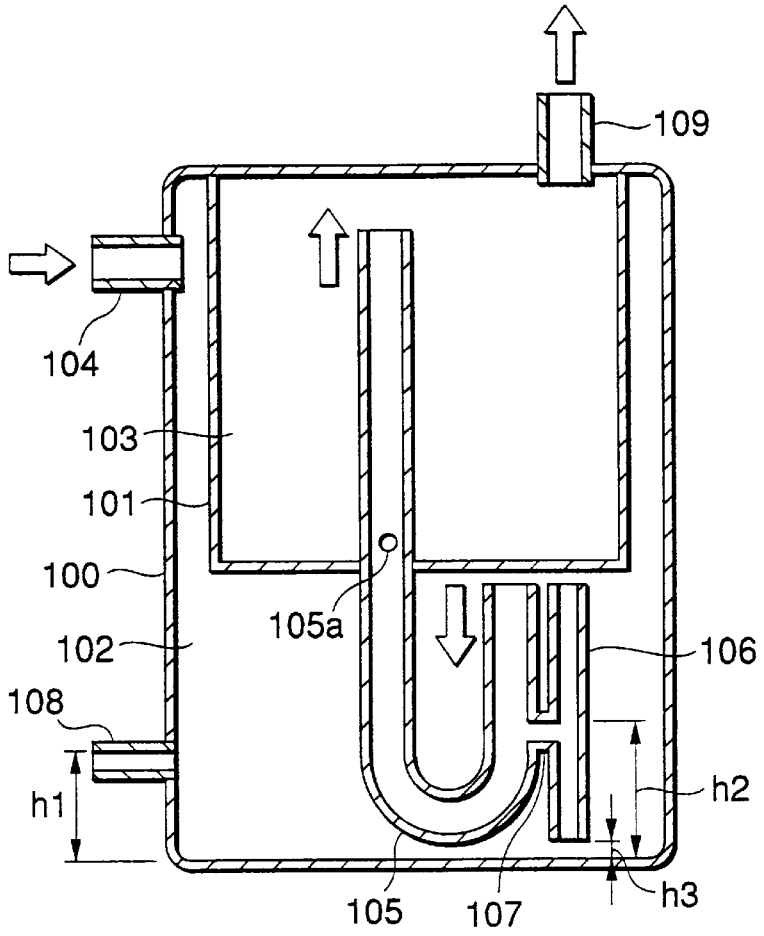
FIGS. 26(*a*) and 26(*b*) are respectively a cross sectional view and a top view cross sectional view showing an accumulator according to a twentieth embodiment of the present invention.
Figure 26B:
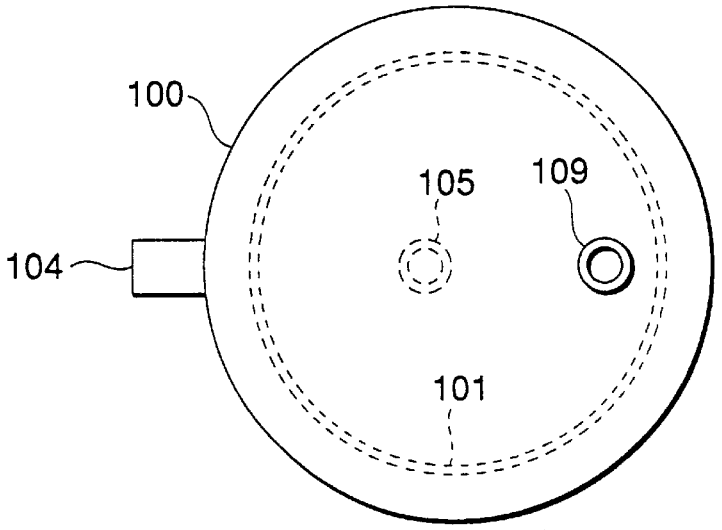

A twentieth embodiment has a structure that the accumulator having the structure according to the ninth embodiment is realized by one container. Moreover, the second container is disposed in the first container. The accumulator according to this embodiment will now be described. FIG. 26(*a*) is a vertical cross sectional view showing the accumulator according to this embodiment. FIG. 26(*b*) is a top view.

Referring to the drawings, reference numeral 100 represents an accumulator container and 101 represents an inner container for separating the inside portion of the accumulator container 100. Reference numeral 102 represents a first space separated by the inner container 101. Reference numeral 103 represents a second space, 104 represents a suction pipe, 105 represents a gas communication pipe, 105*a* represents a communication hole, 106 represents an air-duct pipe, 107 represents a communication pipe, 108 represents an oil return pip and 109 represents a discharge pipe.

In this embodiment, the first container 1 according to the ninth embodiment corresponds to the first space 102, the second container 2 corresponds to the second space 103 and the communication pipe 33 corresponds to the communication hole 105*a*. The same or corresponding elements to those according to the ninth embodiment are given the same names and have the same functions.

The height h1 from the bottom surface in the accumulator container 100 to the oil return pipe 108, the height h2 from the bottom surface in the accumulator container 100 to the communication pipe 107 and the height h3 from the bottom surface in the accumulator container 100 to the air-duct pipe 106 satisfy the relationship h3<h1<h2. The upper end of the air-duct pipe 106 is opened at substantially the same position as that of one of the opened end of the gas communication pipe 105.

When the liquid level (the oil level) in the accumulator container 100 is in a range from h3 to h2, the gas refrigerant is introduced from the air-duct pipe 106 to the gas communication pipe 105 through the communication pipe 107. At this time, the liquid refrigerant has been introduced from the lower end of the air-duct pipe 106 in a quantity corresponding to the liquid level. When the liquid level (the oil level) has been raised to a level not lower than h2, the liquid refrigerant is introduced from the air-duct pipe 106 to the gas communication pipe 105 through the communication pipe 107. The liquid refrigerant is moved to the second space 103 as the internal gas is moved, and then accumulated in the bottom portion in the second space 103. As a result, the liquid level in the accumulator container 100 is lowered. During the operation of the refrigerating and air-conditioning circuit, the gas refrigerant flows from the accumulator container 100 to the first space 102 through the gas communication pipe 105. Thus, a pressure loss takes place. That is, the pressure in the accumulator container 100 is higher than the pressure in the first space 102. Therefore, the liquid refrigerant moved to the second space 103 is not returned from the communication pipe to the accumulator container 100. When the operation of the refrigerating and air-conditioning circuit has been interrupted, the difference in the pressure between the inside portion of the accumulator container 100 and that in the second space 103 is eliminated. As a result, the liquid refrigerant accumulated in the second space 103 is returned from the gas communication pipe 105 to the accumulator container 100.

As described above, the substantially constant liquid level (the oil level) of h2 can be maintained in the accumulator container 100. Moreover, an excessive portion of the liquid refrigerant is accumulated in the second space 103. Therefore, when refrigerating machine oil having poor solubility with the liquid refrigerant is used in the refrigerating and air-conditioning circuit, the flow rate of refrigerating machine oil which flows from the oil return pipe 108 to the compressor can be made to be constant, as shown in FIG. 2. As a result, generation of a defect in the compressor can be prevented.

Since only the suction pipe 104, the oil return pipe 108 and the discharge pipe 109 are connected to the accumulator container 100, an accumulator having a simple appearance can be obtained.

Figure 27:
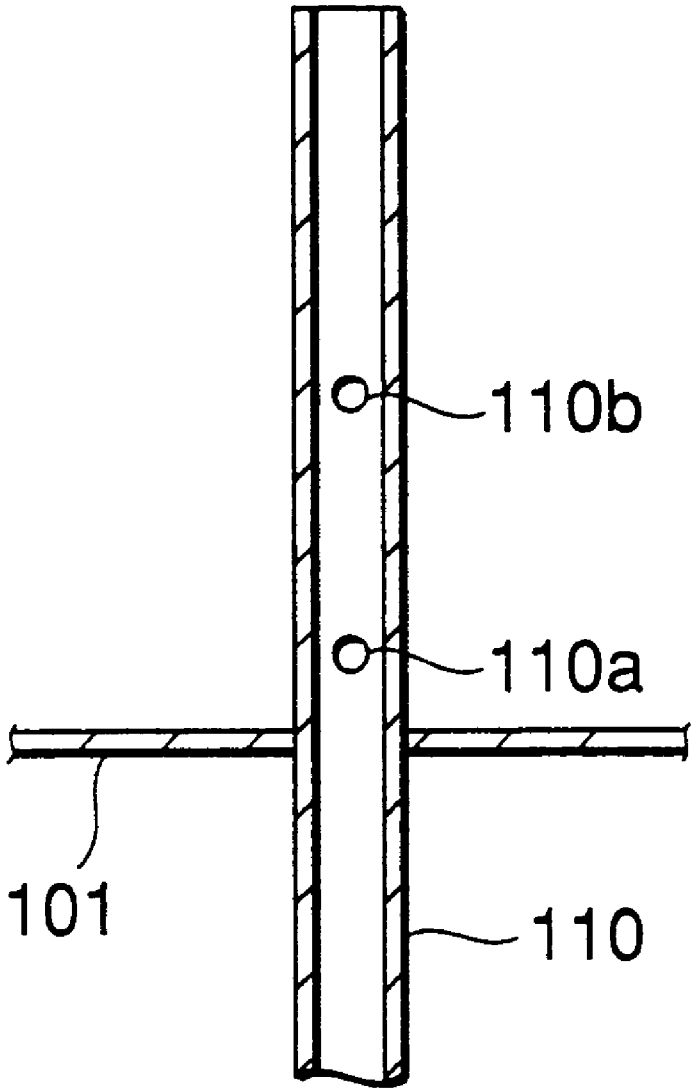
FIG. 27 is a vertical cross sectional view showing a gas communication pipe according to the twentieth embodiment.

FIG. 27 shows a modification of the gas communication pipe. In this modification, a plurality of communication holes, for example, two communication holes 110*a* and 110*b* are vertically formed at different positions of the gas communication pipe 110 disposed in the second space.

Since the communication holes 110*a* and 110*b* are formed at different positions, the level of the liquid accumulated in the second space is not changed. When the operation of the refrigerating and air-conditioning circuit has been interrupted, the liquid can efficiently be returned to the first space. If refrigerating machine oil is introduced and allowed to exist above the liquid accumulation portion, refrigerating machine oil can smoothly be returned to the first space.

Twenty-First Embodiment

Figure 28A:
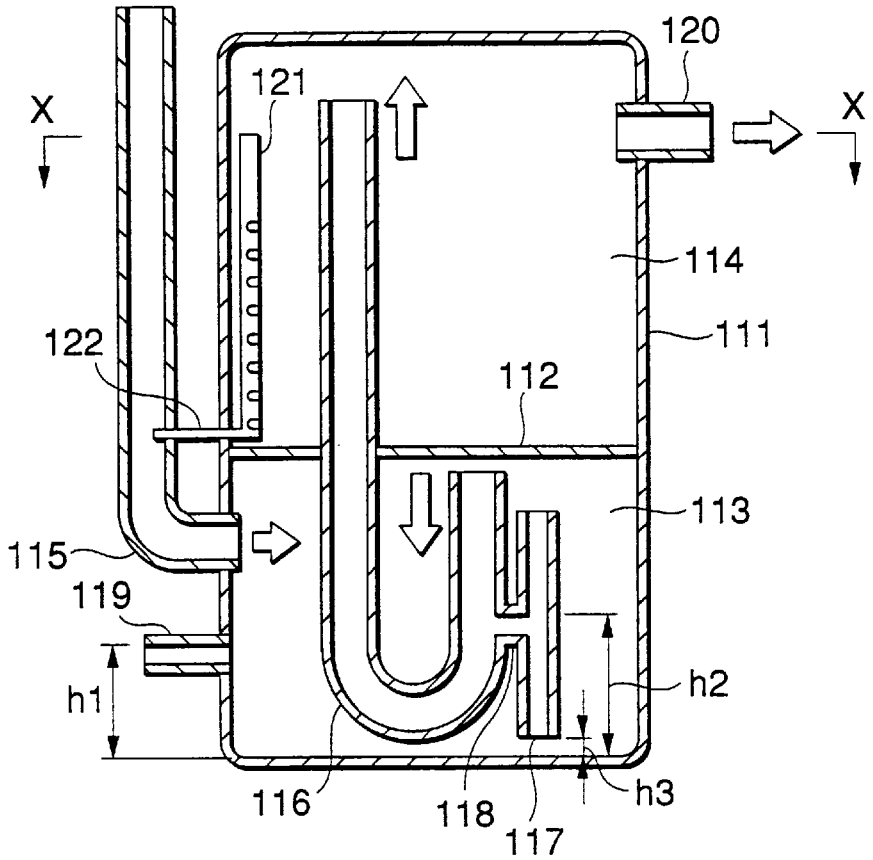
FIGS. 28(*a*) and 28(*b*) are respectively a vertical cross sectional view and a transverse cross sectional view showing an accumulator according to a twenty-first embodiment of the present invention.
Figure 28B:
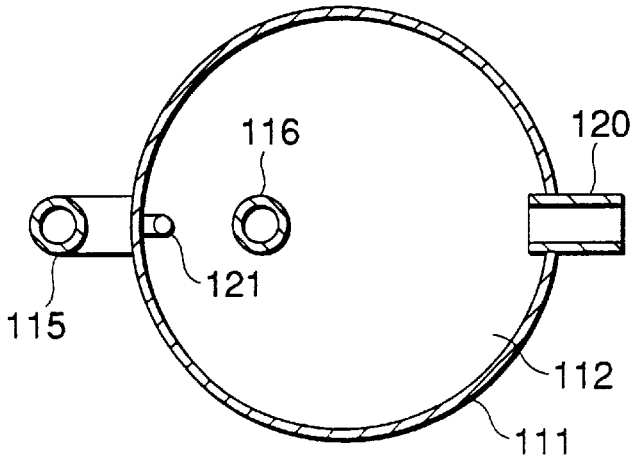

A twenty-first embodiment has a structure that the accumulator according to the twelfth embodiment is realized by one container and the first container and the second container are partitioned by a partition plate. The accumulator according to this embodiment will now be described. FIG. 28(*a*) is a vertical cross sectional view showing the accumulator according to this embodiment. FIG. 28(*b*) is a cross sectional view taken along line X—X shown in FIG. 28(*a*).

Referring to the drawings, reference numeral 111 represents an accumulator container and 112 represents a partition plate for vertically partitioning the inside portion of the accumulator container 111. Reference numeral 113 represents a first space, 114 represents a second space, 115 represents a suction pipe, 116 represents a gas communication pipe, 117 represents an air-duct pipe, 118 represents a communication pipe, 119 represents an oil return pipe, 120 represents a discharge pipe and 121 and 122 represent oil recovery pipes.

In this embodiment, the first container 1 according to the twelfth embodiment corresponds to the first space 113 and the second container 2 corresponds to the second space 114. The same or corresponding elements to those according to the twelfth embodiment are given the same names and have the same functions.

The height h1 from the bottom surface in the first space 113 to refrigerating machine oil 11, the height h2 from the bottom surface in the first space 113 to the communication pipe 118 and the height h3 from the bottom surface in the first space 113 to the lower end of the air-duct pipe 117 satisfy the relationship h3<h1<h2. Moreover, the upper end of the air-duct pipe 117 is opened at substantially the same position as that of one of the opened ends of the gas communication pipe 116.

When the liquid level (the oil level) in the first space 113 is in a range from h3 to h2, the gas refrigerant is introduced from the air-duct pipe 117 to the gas communication pipe 116 through the communication pipe 118. At this time, the liquid refrigerant has been introduced from the lower end of the air-duct pipe 117 in a quantity corresponding to the liquid level. When the liquid level (the oil level) has been made to be not lower than h2, the liquid refrigerant is introduced from the air-duct pipe 117 to the gas communication pipe 116 through the communication pipe 118. The liquid refrigerant is moved to the second space 114 as the internal gas is moved, and then accumulated in the bottom portion in the second space 114. As a result, the liquid level in the first space 113 is lowered.

As described above, the substantially constant liquid level (the oil level) of h2 can be maintained in the first space 113. Moreover, an excessive portion of the liquid refrigerant is accumulated in the second space 114. Therefore, when refrigerating machine oil having poor solubility with the liquid refrigerant is used in the refrigerating and air-conditioning circuit as shown in FIG. 2, the flow rate of refrigerating machine oil which flows from the oil return pipe 119 to the compressor can be made to be constant. As a result, generation of a defect in the compressor can be prevented.

The oil recovery pipe 121 has a plurality of oil recovery holes at different positions in the vertical direction thereof. The oil recovery pipe 121 is disposed to be immersed in the liquid accumulation portion in the second space 114. The highest position of the oil recovery hole is made to be a position adjacent to the highest liquid level in the second space 114. Even if the liquid level of the liquid accumulated in the second space 114 is at any height, refrigerating machine oil separated above the liquid can be recovered into the first space 113. To achieve this, a plurality of the oil recovery holes are formed vertically. The oil recovery pipe 122 for establishing the communication between the lower end portion of the oil recovery pipe 121 and the suction pipe 115 has an end which projects over the inner surface of the suction pipe 115 by, for example, about several millimeters.

The operations of the oil recovery pipes 121 and 122 will now be described. Even if refrigerating machine oil accumulated in the second space 114 is positioned at any position, refrigerating machine oil is introduced into the oil recovery pipe 121 from the oil recovery hole corresponding to the oil level. Thus, the liquid refrigerant is introduced into the oil recovery pipe 121 through the oil-recovery hole facing the liquid refrigerant. As a result of the ejector effect obtained by the internal flow in the suction pipe 115 and exerted on the leading end of the oil recovery pipe 122, the pressure at the leading end is made to be a negative pressure as compared with the surrounding static pressure. As a result, refrigerating machine oil and the liquid refrigerant introduced into the oil recovery pipe 122 are sucked into the suction pipe 115, and then recovered into the first space 113. As described above, refrigerating machine oil introduced into the second space 114 can be recovered into the first space 113 even during the operation of the refrigerating and air-conditioning circuit.

During the interruption of the operation of the refrigerating and air-conditioning circuit, liquid in the second space 114 is moved to the first space 113 through the oil recovery pipes 121 and 122 because of gravity.

As a result of the above-mentioned operation, this embodiment is able to recover refrigerating machine oil introduced into the second space 114 into the first space 113 even if the operation for selectively moving the liquid refrigerant to the second space 114 is unsatisfactory and thus refrigerating machine oil is mixed with the liquid refrigerant and thus refrigerating machine oil is mixed and introduced into the second space 114. Moreover, recovered refrigerating machine oil is recovered into the compressor through the oil return pipe 119. Therefore, a reliable refrigerating and air-conditioning circuit can be obtained without reduction in the flow rate of refrigerating machine oil to the compressor.

Since only the suction pipe 115, the oil return pipe 119 and the discharge pipe 120 are connected to the accumulator container 111, an accumulator having a simple appearance can be obtained.

Twenty-Second Embodiment

Figure 29A:
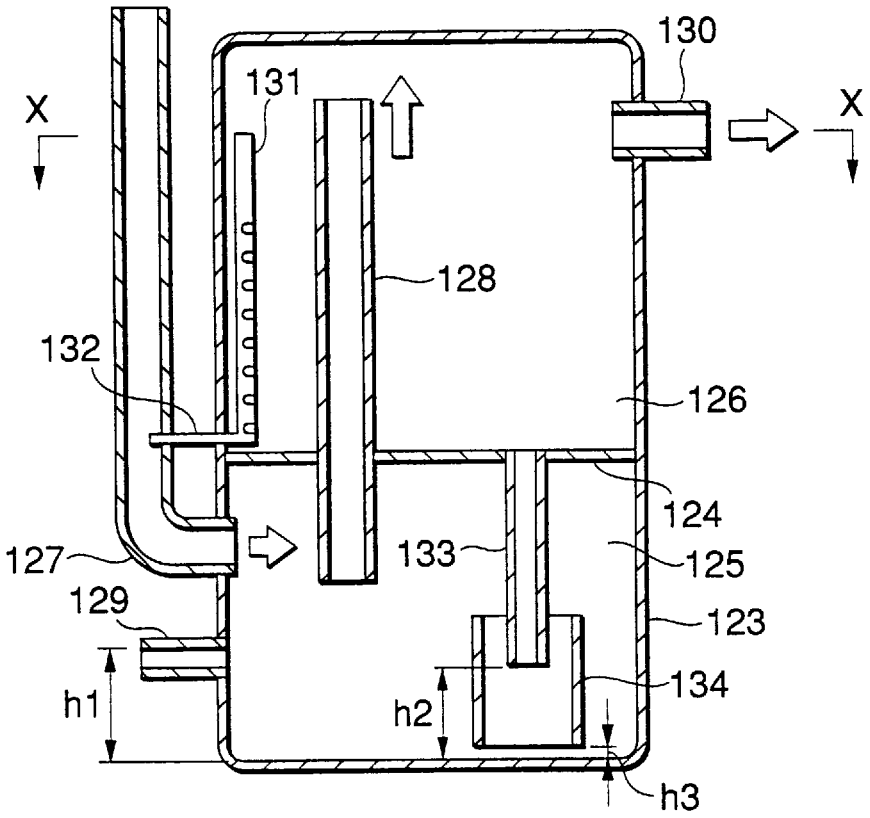
FIGS. 29(*a*) and 29(*b*) are respectively a vertical cross sectional view and a transverse cross sectional view showing an accumulator according to a twenty-second embodiment of the present invention.
Figure 29B:
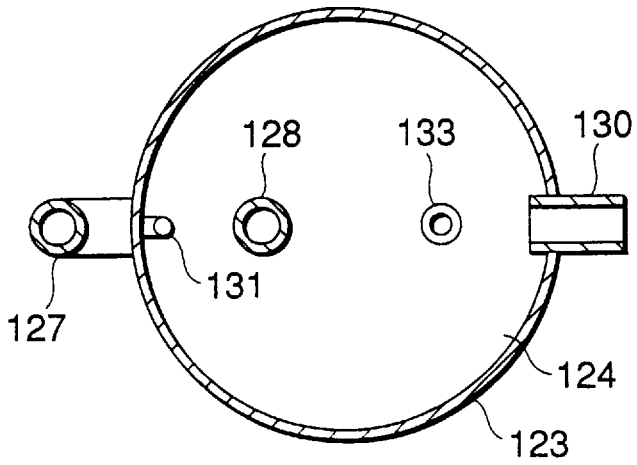

A twenty-second embodiment has a structure that the means for maintaining the liquid level in the first space comprises the cylinder and the refrigerant-sucking pipe according to the sixth embodiment. Moreover, the first and second spaces are realized by one container, and the moving means for moving liquid accumulated in the second space to the first space according to the twenty-first embodiment is employed. An accumulator according to this embodiment will now be described. FIG. 29(*a*) is a vertical cross sectional view showing the accumulator according to the twenty-second embodiment, and FIG. 29(*b*) is a cross sectional view taken along line X—X shown in FIG. 29(*a*).

Referring to the drawings, reference numeral 123 represents an accumulator container and 124 represents a partition plate for vertically partitioning the inside portion of the accumulator container 123. Reference numeral 125 represents a first space, 126 represents a second space, 127 represents a suction pipe, 128 represents a gas communication pipe, 129 represents an oil return pipe, 130 represents a discharge pipe, 131 and 132 represent oil-recovery pipes, 133 represents a refrigerant suction pipe and 134 represents a cylinder.

The height h1 from the bottom surface in the first space 125, the height h2 from the bottom surface in the first space 125 to the refrigerant suction pipe 133 and the height h3 from the bottom surface in the first space 125 to the lower end of the cylinder 134 satisfy the relationship $h3<h1<h2$. The upper end of the refrigerant suction pipe 133 penetrates the partition plate 124 and allowed to communicate with the second space 126.

When the liquid level (the oil level) in the refrigerant suction pipe 133 is in a range from h3 to h2, the gas refrigerant is introduced into the second space 126 through the refrigerant suction pipe 133. At this time, the liquid refrigerant has been introduced from the lower end of the cylinder 134 in a quantity corresponding to the liquid level. When the liquid level (the oil level) has been made to be not lower than h2, the liquid refrigerant is introduced into the second space 126 through the refrigerant suction pipe 133. Thus, the liquid level in the first space 125 is lowered. During the operation of the refrigerating and air-conditioning circuit, the gas refrigerant flows from the first space 125 to the second space 126 through the gas communication pipe 128. Therefore, a pressure loss takes place. That is, the pressure in the first space 125 is higher than the pressure in the second space 126. Therefore, the liquid refrigerant moved to the second space 126 is not returned from the refrigerant suction pipe 133 to the first space 125. When the operation of the refrigerating and air-conditioning circuit is interrupted, the difference in the pressure between the inside portion of the first space 125 and that in the second space 126 is eliminated. Thus, the liquid refrigerant accumulated in the second space 126 is recovered from the refrigerant suction pipe 133 to the first space 125 by dint of gravity.

As described above, the substantially constant liquid level (the oil level) of h2 is maintained in the first space 125. Therefore, refrigerating machine oil can be caused to exist adjacent to the height of the oil return pipe 129 so that refrigerating machine oil is selectively returned to the compressor. Moreover, the liquid refrigerant can be accumulated in the second space 126. When refrigerating machine oil having poor solubility with the liquid refrigerant is used in the refrigerating and air-conditioning circuit, the flow rate of refrigerating machine oil which flows from the oil return pipe 129 to the compressor can be made to be constant. As a result, generation of a defect in the compressor can be prevented.

The moving means is structured in such a manner that a plurality of oil-recovery holes are formed in the vertical direction of the refrigerant suction pipe 133. Moreover, the refrigerant suction pipe 133 is arranged to be immersed in the liquid accumulation portion in the second space 126. The highest position of the oil-recovery holes is made to be adjacent to the highest liquid level in the second space 126. If the liquid level in the second space 126 exists at any position, reliability separated above the foregoing liquid can be recovered into the first space 125 by vertically providing the plural oil-recovery holes. The oil recovery pipe 132 for establishing the communication between the lower end of the oil recovery pipe 131 and the suction pipe 127 has an end which is allowed to project toward the inside portion of the suction pipe 127 by, for example, several millimeters.

Similarly to the twenty-first embodiment, the oil-recovery pipes 131 and 132 cause refrigerating machine oil to be introduced into the oil recovery pipe 131 through the oil-recovery holes corresponding to the oil level even if refrigerating machine oil accumulated in the second space 126 is positioned at any position. Thus, the liquid refrigerant is introduced into the oil recovery pipe 131 through the oil-recovery holes facing the liquid refrigerant. As a result of the ejector effect obtained attributable to the internal flow in the suction pipe 127, the pressure at the leading end of the oil recovery pipe 132 is made to be a negative pressure as compared with the surrounding static pressure. Thus, refrigerating machine oil and the liquid refrigerant introduced into the oil recovery pipe 132 are sucked into the suction pipe 127, and then recovered into the first space 125. As described above, refrigerating machine oil introduced into the second space 126 can be recovered into the first space 125 even during the operation of the refrigerating and air-conditioning circuit.

As a result, refrigerating machine oil and the liquid refrigerant accumulated in the second space can efficiently be recovered to the first space regardless of the liquid level and even during the operation and interruption of the operation of the refrigerating and air-conditioning circuit. Moreover, refrigerating machine oil can be recovered to the compressor through the oil return pipe 129.

Since only the suction pipe 127, the oil return pipe 129 and the discharge pipe 130 are connected to the accumulator container 123, an accumulator having a simple appearance can be obtained.

Twenty-Third Embodiment

Figure 30A:
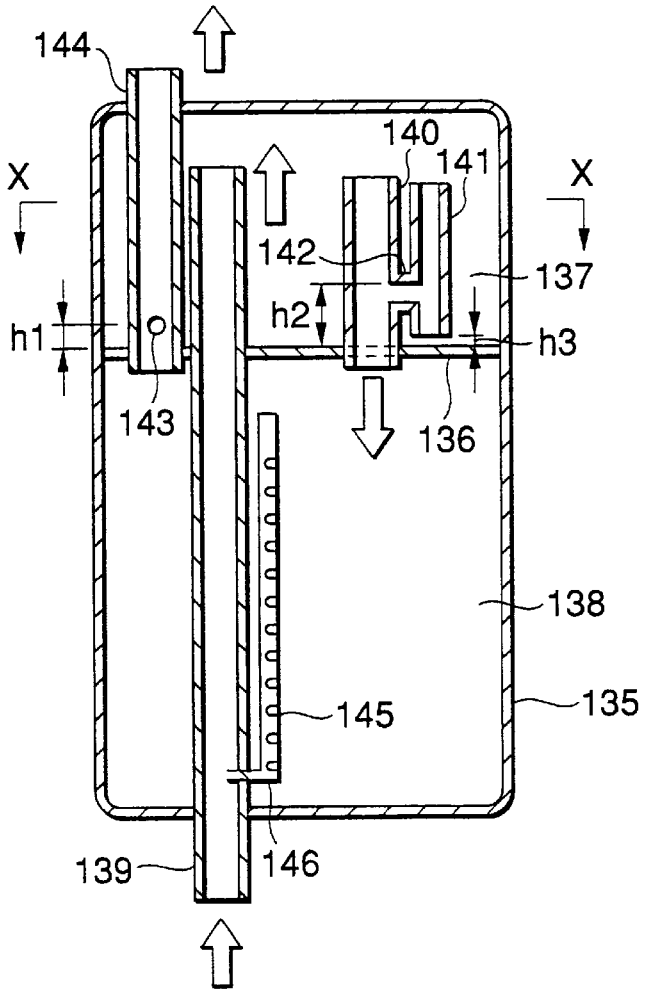
FIGS. 30(*a*) and 30(*b*) are respectively a vertical cross sectional view and a transverse cross sectional view showing an accumulator according to a twenty-third embodiment of the present invention.
Figure 30B:
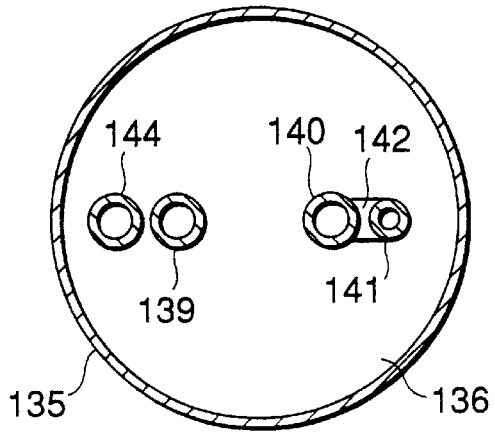

A twenty-third embodiment has a structure that the first container 1 according to the second embodiment and the second container 2 according to the twelfth embodiment are realized by one container. An accumulator according to this embodiment will now be described. FIG. 30 is a cross sectional view showing the twenty-third embodiment. Referring to the drawing, reference numeral 135 represents an accumulator container and 136 represents a partition plate for vertically partitioning the inside portion of the accumulator container 135. Reference numeral 137 represents a first space, 138 represents a second space, 139 represents a suction pipe, 140 represents a gas communication pipe, 141 represents an air-duct pipe, 142 represents a communication pipe, 143 represents an oil return hole corresponding to the oil return pipe and 144 represents a discharge pipe.

The twenty-third embodiment has the structure that the means for maintaining the liquid level in the first space comprises the air-duct pipe and the communication pipe according to the first embodiment. Moreover, the first and second spaces are realized by one container. In addition, the moving means for moving liquid accumulated in the second space to the first space comprises the oil recovery pipe according to the twelfth embodiment. An accumulator according to this embodiment will now be described. FIG. 30 (*a*) is a vertical cross sectional view showing the accumulator according to the twenty-third embodiment. FIG. 30(*b*) is a cross sectional view taken along line X—X.

Referring to the drawings, reference numeral 135 represents an accumulator container and 136 represents a partition plate for vertically partitioning the inside portion of the accumulator container 135. Reference numeral 137 represents a first space, 138 represents a second space, 139 represents a suction pipe, 140 represents a gas communication pipe, 141 represents an air-duct pipe, 142 represents a communication pipe, 143 represents an oil return hole corresponding to the oil return pipe, 144 represents a discharge pipe and 145 and 146 represent oil recovery pipes. In this embodiment, the oil return hole 143 is formed in the surface of the discharge pipe 144 so that the discharge pipe 144 returns the refrigerant gas and refrigerating machine oil to the refrigerating and air-conditioning circuit.

The height h1 from the bottom surface in the first space 137 to the oil return hole 143, the height h2 from the bottom surface in the first space 137 to the communication pipe 142 and the height h3 from the bottom surface in the first space 137 to the lower end of the air-duct pipe 141 satisfy the relationship $h3<h1<h2$. Moreover, the lower end of the gas communication pipe 140 penetrates the partition plate 124 to be allowed to communicate with the second space 138.

When the liquid level (the oil level) in the first space 137 is in a range from h3 to h2, the gas refrigerant is introduced from the air-duct pipe 141 to the communication pipe 142. Then, the gas refrigerant flows from the gas communication pipe 140 to the second space 138. At this time, the liquid refrigerant has been introduced from the lower end of the air-duct pipe 141 in a quantity corresponding to the liquid level. When the liquid level (the oil level) has been raised to be not lower than h2, the liquid refrigerant is allowed to pass through the communication pipe 142. Then, the liquid refrigerant is introduced into the second space 138 from the gas communication pipe 140, and then accumulated in the second space 138. As a result, the liquid level in the first space 137 is lowered.

As described above, the substantially constant liquid level (the oil level) of h2 can be maintained in the first space 137. Therefore, refrigerating machine oil can be caused to exist adjacent to the height of the oil return hole 143 to selectively return refrigerating machine oil to the compressor. Moreover, the liquid refrigerant can be accumulated in the second space 138. When refrigerating machine oil having poor solubility with the liquid refrigerant is used in the refrigerating and air-conditioning circuit, the flow rate of refrigerating machine oil which flows from the oil return hole 143 to the compressor can be made to be constant. As a result, generation of a defect of the compressor can be prevented.

The moving means is structured in such a manner that the oil recovery pipe 145 has a plurality of oil-recovery holes formed at different positions in the vertical direction. Moreover, the oil recovery pipe 145 is disposed in such a manner that the oil recovery pipe 145 is immersed in the liquid accumulation portion in the second space 138. The highest position of the oil-recovery holes is made to be adjacent to the highest liquid level in the second space 138. Even if the level of liquid accumulated in the second space 138 is positioned at any position, refrigerating machine oil separated above the liquid can be returned to the first space 137. To achieve this, a plurality of the oil-recovery holes are formed in the vertical direction. The oil recovery pipe 146 for establishing the communication between the lower end of the oil recovery pipe 145 and the suction pipe 139 has an end which projects toward the inside portion of the suction pipe 139 by about several millimeters.

The operations of the oil recovery pipes 145 and 146 are the same as those according to the twenty-first embodiment. If refrigerating machine oil accumulated in the second space 138 is positioned at any position, refrigerating machine oil is introduced into the oil recovery pipe 145 through the oil-recovery holes corresponding to the oil level. Moreover, the liquid refrigerant is introduced into the oil recovery pipe 145 through the oil-recovery holes facing the liquid refrigerant. The ejector effect exerted on the leading end of the oil recovery pipe 146 obtainable from the internal flow in the suction pipe 139 results in the pressure at the leading end being made to be a negative pressure as compared with the surrounding static pressure. As a result, refrigerating machine oil and the liquid refrigerant introduced into the oil recovery pipe 146 are sucked into the suction pipe 139, and then recovered into the first space 137. As described above, refrigerating machine oil introduced into the second space 138 can be recovered into the first space 137 even during the refrigerating and air-conditioning circuit.

As described above, refrigerating machine oil accumulated in the second space can efficiently be recovered to the first space regardless of the liquid level even during the operation or the interruption of the refrigerating and air-conditioning circuit. Moreover, refrigerating machine oil can be recovered to the compressor through the oil return hole 143 and the discharge pipe 144.

Since only the suction pipe 139 and the discharge pipe 144 are connected to the accumulator container 135, an accumulator having a simple appearance can be obtained.

As described above, the sixteenth to twenty-third embodiments have the structure that one container forms the accumulator. However, another modification may be employed as the method for realizing the structure by one container in such a manner that the first to fifteenth embodiments are combined with each other. In the present invention, the method is not limited to any one of the above-mentioned embodiments. Another structure may be employed to realize the first and second spaces by one container so as to obtain an accumulator having a simple structure and permitting easy operation.

EFFECT OF THE INVENTION

As described above, the structure according to the first aspect of the present invention has the first space into which liquid and a gas which are fluids arranged to circulate in the refrigerating and air-conditioning circuit are introduced by the introducing means; the second space for introducing the gas from the first space by the gas passage means, discharging the gas to the refrigerating and air-conditioning circuit by the discharging means and having the structure capable of accumulating the liquid; the liquid-level maintaining means for preventing the level of the accumulated liquid introduced into the first space from becoming a level not lower than a predetermined height; the liquid passage means for moving the liquid from the first space to the second space when the liquid level has been raised to a level not lower than the predetermined height; and the returning means opened in the first space at the position lower than the predetermined height and arranged to discharge the liquid accumulated in the first space to the refrigerating and air-conditioning circuit. Thus, an accumulator can be obtained which is able to maintain the substantially constant liquid level in the first space, restraining the quantity of introduction of the liquid refrigerant to the compressor, obtaining a required quantity of refrigerating machine oil in the compressor and improving the reliability.

The structure according to the second aspect of the present invention is arranged in such a manner that the liquid passage means and the gas passage means according to the first aspect are formed into the gas passage pipe having ends opened in the gas portion of the first space and the other ends opened in the second space and disposed in the vertical direction across the gas portion and the liquid accumulation portion in the first space, and the liquid-level maintaining means has the communication portion allowed to communicate with the gas passage pipe disposed in the vertical direction in the first space at the predetermined height, the first passage for establishing the communication between the communication portion and the upper portion in the first space and the second passage for establishing the communication between the communication portion and the space in the first space at the position lower than the predetermined height. As a result, an accumulator can be obtained which is capable of maintaining the substantially constant liquid level in the first space to restrain the quantity of introduction the liquid refrigerant into the compressor, obtaining a required quantity of refrigerating machine oil in the compressor and improving the reliability.

The structure according to the third aspect of the present invention has the arrangement according to the first or second aspect and formed to further comprise the moving means for moving the liquid accumulated in the second space to the first space. Thus, an accumulator can be obtained which is able to return refrigerating machine oil accumulated in the second space from the first space to the compressor to obtain refrigerating machine oil required for the compressor.

The structure according to the fourth aspect of the present invention has the arrangement according to the third aspect and formed in such a manner that the second space is formed above the first space, and the moving means is the communication means for establishing the communication between the liquid accumulation portion in the second space and the first space. As a result, an accumulator can be obtained which is capable of returning refrigerating machine oil accumulated in the second space from the first space to the compressor to obtain refrigerating machine oil required for the compressor.

The structure according to the fifth aspect of the present invention has the arrangement according to the third aspect and formed in such a manner that the moving means establishes the communication between the introducing means and the liquid accumulation portion in the second space by dint of one or a plurality of connection means, and the end of the connection means adjacent to the introducing means is allowed to project over the inner surface of the introducing means toward the inside portion so that the liquid accumulated in the second space is caused to follow the fluid when the fluid is introduced into the first space by the introducing means. Thus, an accumulator can be obtained which is capable of returning refrigerating machine oil accumulated in the second space from the first space to the compressor without a necessity of interrupting the operation of the refrigerating and air-conditioning circuit to obtain refrigerating machine oil required for the compressor.

The structure according to the sixth aspect of the present invention has the arrangement according to the third aspect and formed in such a manner that the moving means is composed of the liquid-recovery means vertically disposed in the liquid accumulation portion in the second space and arranged to be capable of recovering the liquid positioned at different positions in the vertical direction and the connection means for establishing the communication between the introducing means and the liquid-recovery means, and the end of the connection means adjacent to the introducing means is allowed to project over the inner surface of the introducing means toward the inside portion so that the liquid accumulated in the second space is caused to follow the fluid when the fluid is introduced into the first space by the introducing means. Thus, an accumulator can be obtained which is capable of returning refrigerating machine oil accumulated in the second space from the first space to the compressor without a necessity of interrupting the operation of the refrigerating and air-conditioning circuit to obtain refrigerating machine oil required for the compressor.

The structure according to the seventh aspect of the present invention has the arrangement according to the third aspect and formed in such a manner that the second space is disposed above the first space, and the moving means is composed of the third space formed at an intermediate position between the second space and the first space, the first opening/closing valve disposed between the first space and the third space and the second opening/closing valve disposed between the second space and the third space so that the first opening/closing valve is closed when the second opening/closing valve is opened and the first opening/closing valve is opened when the second opening/closing valve is closed in order to move the liquid accumulated in the second space to the first space through the third space. Therefore, an accumulator can be obtained which is capable of returning refrigerating machine oil accumulated in the second space from the first space to the compressor without a necessity of interrupting the operation of the refrigerating and air-conditioning circuit to obtain refrigerating machine oil required for the compressor.

The structure according to the eighth aspect of the present invention has the arrangement to any one of the first to seventh aspects and formed in such a manner that liquid-level stabilizing means for stabilizing the liquid level in the space is provided for either of the first space or the second space. Thus, an accumulator can be obtained which is capable of stabilizing the liquid level in each of the first space and the second space and effectively performing gas-liquid separation.

What is claimed is:

1. An accumulator for use in a refrigerating and air-conditioning circuit, said accumulator comprising:

container means for defining first and second spaces;

introducing means for introducing, into said first space, liquid and a gas which are fluids arranged to circulate in said refrigerating and air-conditioning circuit;

gas passage means for introducing said gas from said first space into said second space;

discharging means for discharging said gas from said second space to said refrigerating and air-conditioning circuit while permitting said liquid to be accumulated in said second space;

liquid-level maintaining means for preventing said liquid introduced into and accumulated in said first space from becoming a level not lower than a predetermined height;

liquid passage means for moving said liquid from said first space to said second space when said liquid in said first space becomes a level not lower than said predetermined height; and returning means, opened in said first space at a position lower than said predetermined height, for discharging said liquid accumulated in said first space to said refrigerating and air-conditioning circuit.

2. An accumulator according to claim 1, wherein said liquid passage means and said gas passage means includes a common gas passage pipe having:

one end opened in a gas portion of said first space, the other end opened in said second space, and a portion disposed in a vertical direction across said gas portion and a liquid accumulation portion in said first space, and wherein said liquid-level maintaining means includes:

a communication portion communicating with said portion of said gas passage pipe at said predetermined height;

a first passage for communication between said communication portion and an upper portion in said first space; and a second passage for communication between said communication portion and a space in said first space at a position lower than said predetermined height.

3. An accumulator according to claim 2, further comprising:

moving means for moving said liquid accumulated in said second space to said first space.

4. An accumulator according to claim 3, wherein:

said second space is disposed above said first space, and said moving means includes communication means for communication between said liquid accumulation portion in said second space and said first space.

5. An accumulator according to claim 3, wherein:

said moving means includes at least one connection means for communication between said introducing means and said liquid accumulation portion in said second space; and an end of said connection means adjacent to said introducing means projects inwardly over the inner surface of said introducing means so that said liquid accumulated in said second space is caused to follow said fluid when said fluid is introduced into said first space by said introducing means.

6. An accumulator according to claim 3, wherein:

said moving means includes:

liquid-recovery means vertically disposed in said liquid accumulation portion in said second space and arranged to be capable of recovering said liquid at vertically different positions, and connection means for communication between said introducing means and said liquid-recovery means; and an end of said connection means adjacent to said introducing means projects inwardly over the inner surface of said introducing means so that said liquid accumulated in said second space is caused to follow said fluid when said fluid is introduced into said first space by said introducing means.

7. An accumulator according to claim 3, wherein:

said second space is disposed above said first space; and said moving means includes:

a third space formed at an intermediate position between said second space and said first space;

a first opening/closing valve disposed between said first space and said third space; and a second opening/closing valve disposed between said second space and said third space; and said first opening/closing valve is closed when said second opening/closing valve is opened and said first opening/closing valve is opened when said second opening/closing valve is closed in order to move said liquid accumulated in said second space to said first space through said third space.

8. An accumulator according to claim 1, wherein said container means includes a first container defining said first space therein, a second container defining said second space therein, and said first and second containers are separately disposed from each other.

9. An accumulator according to claim 1, wherein said container means includes a single container defining said first and second spaces therein with a partition.

10. An accumulator according to claim 1, further comprising 172890/cmcg liquid-level stabilizing means disposed in one of said first and second spaces for stabilizing the liquid level in said first or second space, respectively.

* * * * *

UNITED STATES PATENT AND TRADEMARK OFFICE

CERTIFICATE OF CORRECTION

PATENT NO. : 5,996,372
DATED : December 7, 1999
INVENTOR(S) : Koda et al.

It is certified that error appears in the above-identified patent and that said Letters Patent is hereby corrected as shown below:

Column 44,
Line 59, delete "172890/cmcg".

Signed and Sealed this

Twentieth Day of November, 2001

*Attest:*

Nicholas P. Godici

*Attesting Officer*

NICHOLAS P. GODICI
*Acting Director of the United States Patent and Trademark Office*